US011058941B2

(12) United States Patent
Sasaki et al.

(10) Patent No.: US 11,058,941 B2
(45) Date of Patent: Jul. 13, 2021

(54) GAME APPARATUS

(71) Applicant: KONAMI AMUSEMENT CO., LTD., Ichinomiya (JP)

(72) Inventors: Ken Sasaki, Ichinomiya (JP); Kenji Gennozono, Ichinomiya (JP); Takahiro Yoshino, Ichinomiya (JP); Hitoshi Arisawa, Ichinomiya (JP); Etsushi Takahashi, Ichinomiya (JP); Kensaku Yoshida, Ichinomiya (JP); Norifumi Kawai, Ichinomiya (JP)

(73) Assignee: KONAMI AMUSEMENT CO., LTD., Ichinomiya (JP)

( * ) Notice: Subject to any disclaimer, the term of this patent is extended or adjusted under 35 U.S.C. 154(b) by 0 days.

(21) Appl. No.: 16/801,762

(22) Filed: Feb. 26, 2020

(65) Prior Publication Data

US 2020/0188773 A1 Jun. 18, 2020

Related U.S. Application Data

(63) Continuation of application No. PCT/JP2018/032158, filed on Aug. 30, 2018.

(30) Foreign Application Priority Data

Aug. 31, 2017 (JP) ..... JP2017-167837
Jul. 11, 2018 (JP) ..... JP2018/131888

(51) Int. Cl.
*A63F 7/02* (2006.01)
*A63F 9/28* (2006.01)
(Continued)

(52) U.S. Cl.
CPC ..... *A63F 9/28* (2013.01); *A63F 7/02* (2013.01); *A63F 2007/3666* (2013.01); *A63F 2007/4018* (2013.01); *G07F 17/3297* (2013.01)

(58) Field of Classification Search
CPC ..... G07F 17/3297; A63F 7/02; A63F 7/28; A63F 2007/4018; A63F 2007/3666
(Continued)

(56) References Cited

U.S. PATENT DOCUMENTS

2010/0230895 A1* 9/2010 Okuaki ..... G07F 17/3297 273/138.3

FOREIGN PATENT DOCUMENTS

JP 48-101793 U 11/1973
JP 61-176375 A 8/1986
(Continued)

OTHER PUBLICATIONS

International Search Report dated Nov. 13, 2018 in International Application No. PCT/JP2018/032158.
Written Opinion of the International Searching Authority dated Nov. 13, 2018 in International Application No. PCT/JP2018/032158.
Office Action dated Jun. 19, 2018 in Japanese Application No. 2017-167837.
(Continued)

*Primary Examiner* — Benjamin Layno
(74) *Attorney, Agent, or Firm* — Sughrue Mion, PLLC

(57) ABSTRACT

A game apparatus provides a game using three-dimensional game objects rollable regardless of their orientation, and includes a circulating mechanism configured to circulate the three-dimensional game objects. The circulating mechanism includes: a conveyor device configured to transport the three-dimensional game objects from a first position to a second position higher than the first position; a first path configured to move the three-dimensional game objects from the second position to a third position lower than the second position; a supply path for supply of a part of the three-dimensional game objects to a game object utilizer that uses the supplied three-dimensional game objects in the game, the part entering the supply path at a position between the second position and the third position; and a second path
(Continued)

configured to move a part of the three-dimensional game objects not entering the supply path, to the first position lower than the third position.

15 Claims, 23 Drawing Sheets

(51) Int. Cl.
*A63F 7/40* (2006.01)
*A63F 7/36* (2006.01)
*G07F 17/32* (2006.01)

(58) Field of Classification Search
USPC ..... 273/109, 118 R, 123 R, 125 R, 118 D, 273/127 C
See application file for complete search history.

(56) References Cited

FOREIGN PATENT DOCUMENTS

| | | | | |
|---|---|---|---|---|
| JP | 10-277247 | A | 10/1998 | |
| JP | 10-314432 | A | 12/1998 | |
| JP | 11-333066 | A | 12/1999 | |
| JP | 2000-189655 | A | 7/2000 | |
| JP | 2004-113565 | A | 4/2004 | |
| JP | 2005-80861 | A | 3/2005 | |
| JP | 2005-80915 | A | 3/2005 | |
| JP | 2005-124624 | A | 5/2005 | |
| JP | 2006-102401 | A | 4/2006 | |
| JP | 2009-136316 | A | 6/2009 | |
| JP | 2009-148555 | A | 7/2009 | |
| JP | 2010-233749 | A | 10/2010 | |
| JP | 2011-36423 | A | 2/2011 | |
| JP | 2011-98098 | A | 5/2011 | |
| JP | 2011-125460 | A | 6/2011 | |
| JP | 2012-5765 | A | 1/2012 | |
| JP | 2013-85838 | A | 5/2013 | |
| JP | 2013-99632 | A | 5/2013 | |
| JP | 2013-141540 | A | 7/2013 | |
| JP | 2013-226320 | A | 11/2013 | |
| JP | 2014-117462 | A | 6/2014 | |
| JP | 2016-52466 | A | 4/2016 | |
| JP | 2016-77811 | A | 5/2016 | |
| JP | 2016-140426 | A | 8/2016 | |
| JP | 2017-18824 | A | 1/2017 | |
| JP | 2017-23481 | A | 2/2017 | |
| WO | WO-2004055747 | A1 * | 7/2004 | ..... G07F 17/3297 |

OTHER PUBLICATIONS

Office Action dated Jun. 25, 2019 in Japanese Application No. 2018-131888.
Office Action dated Sep. 3, 2019 in Japanese Application No. 2018-136084.
Office Action dated Aug. 13, 2019 in Japanese Application No. 2018-136085.
Office Action dated Mar. 10, 2020 in Japanese Application No. 2018-136085.
Office Action dated Aug. 27, 2019 in Japanese Application No. 2018-136087.
Office Action dated Mar. 3, 2020 in Japanese Application No. 2018-136087.
Office Action dated Dec. 18, 2018 in Japanese Application No. 2018-136088.
Office Action dated Apr. 2, 2019 in Japanese Application No. 2018-136088.
Office Action dated Sep. 10, 2019 in Japanese Application No. 2018-136089.
Office Action dated Mar. 31, 2020 in Japanese Application No. 2018-136089.
Office Action dated Jul. 31, 2019 in Taiwanese Application No. 107130361.
International Search Report dated Oct. 30, 2018 in International Application No. PCT/JP2018/032156.
Written Opinion of the International Searching Authority dated Oct. 30, 2018 in International Application No. PCT/JP2018/032156.
Office Action dated Jan. 9, 2018 in Japanese Application No. 2017-167832.
Office Action dated Sep. 3, 2019 in Taiwanese Application No. 107130353.
Office Action dated Jan. 9, 2018 in Japanese Application No. 2017-167833.
Office Action dated Apr. 17, 2018 in Japanese Application No. 2017-167833.
Office Action dated Feb. 13, 2018 in Japanese Application No. 2017-167834.
Office Action dated May 8, 2018 in Japanese Application No. 2017-167834.
Office Action dated Aug. 7, 2018 in Japanese Application No. 2017-167836.
Office Action dated Dec. 18, 2018 in Japanese Application No. 2017-167836.
Communication dated Dec. 22, 2020, from the Japanese Patent Office in application No. 2018-136085.

* cited by examiner

GAME APPARATUS

CROSS REFERENCE TO RELATED APPLICATIONS

This application is a Continuation Application of PCT Application No. PCT/JP2018/032158, filed Aug. 30, 2018, which is based on and claims priority from Japanese Patent Application No. 2017-167837, filed Aug. 31, 2017, and Japanese Patent Application No. 2018-131888, filed Jul. 11, 2018, the entire contents of which are incorporated herein by reference.

BACKGROUND OF THE INVENTION

Field of the Invention

The present invention relates to a game apparatus.

Description of Related Art

There has been proposed in the art a pusher game apparatus in which disk-shaped token coins (medals) fed into a game field are moved, as is disclosed for example in Japanese Patent Application Laid-Open Publication No. 2013-99632. A lift hopper or the like that moves token coins along a rail is used in the conventional pusher game apparatus to transport the token coins to a feeding portion.

Assumed is use of game objects (for example, spherical game objects) that are rollable regardless of an orientation of the game objects instead of use of token coins as used in the conventional pusher game apparatus. In a configuration in which three-dimensional game objects are used, necessity arises for a mechanism suitable for transporting the three-dimensional game objects in place of a lift hopper that transports token coins.

SUMMARY OF THE INVENTION

In view of the above circumstances, an object of the present invention is to provide a technique that enables efficient transport of three-dimensional game objects.

In one aspect, a game apparatus according to a preferred aspect of the present invention is a game apparatus for providing a game in which three-dimensional game objects that are rollable regardless of an orientation of the three-dimensional game objects are used, the game apparatus including a circulating mechanism configured to circulate the three-dimensional game objects. The circulating mechanism includes: a conveyor device configured to transport the three-dimensional game objects from a first position to a second position that is higher than the first position; a first path configured to move the three-dimensional game objects from the second position to a third position that is lower than the second position; a supply path for supply of a part of the three-dimensional game objects to a game object utilizer that uses the supplied three-dimensional game objects in the game, the part of the three-dimensional game objects entering the supply path at a position between the second position and the third position; and a second path configured to move a part of the three-dimensional game objects not entering the supply path, to the first position that is lower than the third position.

DESCRIPTION OF THE EMBODIMENTS

Figure 1:
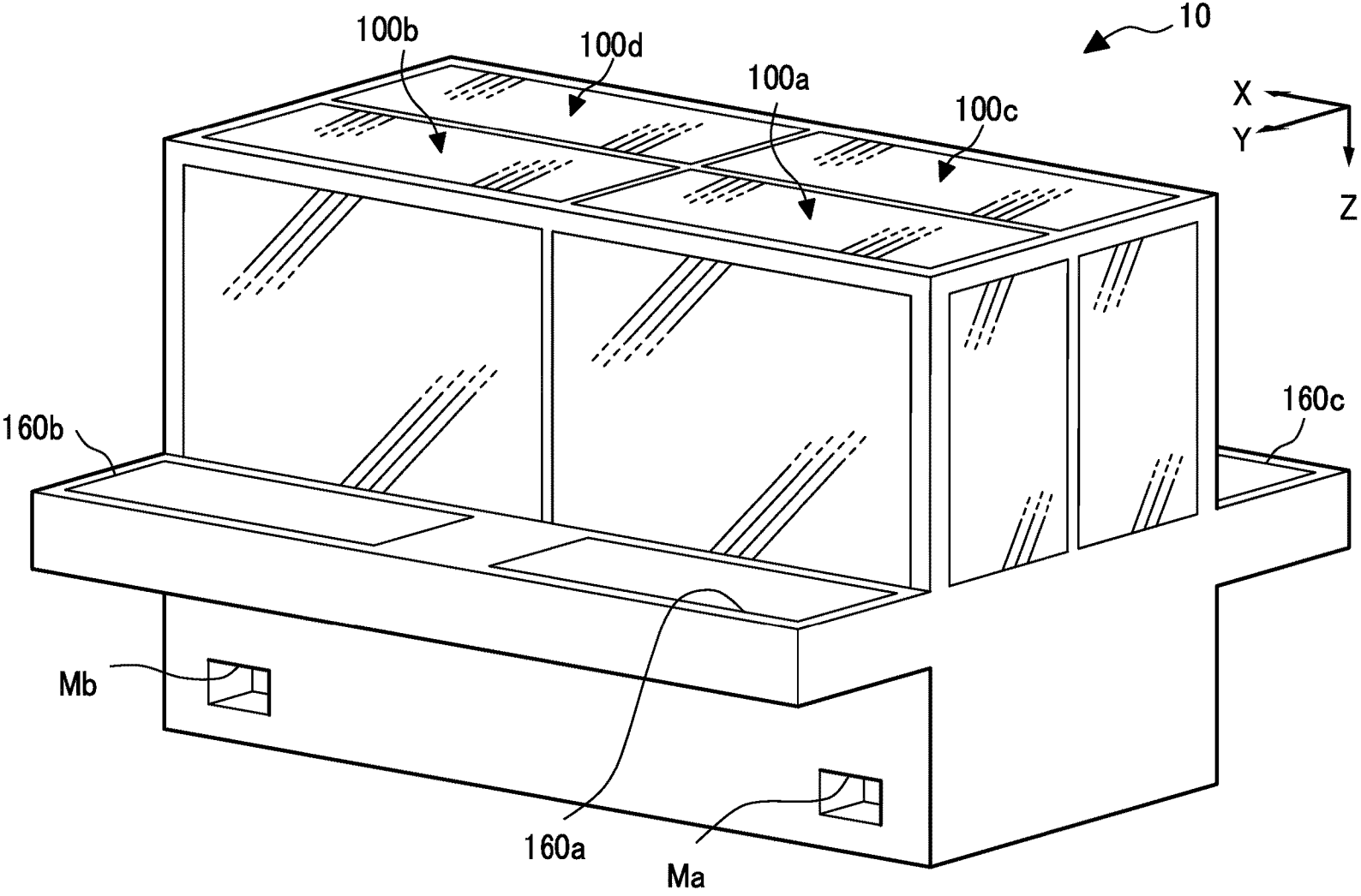
FIG. 1 is an external view illustrating a game apparatus according to a first embodiment.

Embodiments of the present invention are explained below with reference to the drawings. The dimensions and scales of parts in the drawings may be different from the dimensions and scales of actual configurations as appropriate. Various technically preferable limitations are included in the embodiments described below. The scope of the present invention is not limited to these embodiments exemplified below.

First Embodiment

FIG. 1 is an external view illustrating a game apparatus 10 according to a first embodiment. The game apparatus 10 is installed in, for example, an entertainment facility (such as a game arcade or a casino) or a retail facility (such as a shopping mall). The game apparatus 10 is also referred to as a gaming machine when it is used in a casino.

A player plays a game of the game apparatus 10 by spending game values (value media). A game value is, for example, a tangible medium having a value, such as a token coin (a medal), a coin (money), or a ticket, or an intangible medium having a value, such as a credit or a point. The term "game value" can be reworded either as "game token" or "substitute money." A player plays a game of the game apparatus 10 by spending game values. It is of note that a player may select and spend either a tangible game value, such as a token coin, or an intangible game value, such as a credit.

Game values are provided as a reward to a player in accordance with a result of a play of a game on the game apparatus 10. Game values spent on a play of a game may be of the same type as or of a different type from game values provided as a reward to the player. For example, assuming a case in which the play of a game starts with input of a predetermined number of token coins, a number of token coins (game values of the same type) may be provided to the player in accordance with a result of the play, or a number of tickets (game values of a different type) may be provided to the player in accordance with the result of the play. It is of note that the term "spending game values" can be reworded as inputting (inserting) game values; and the term "granting game values" can be reworded as pay-out of game values.

In a case where intangible game values, such as credits, are provided as rewards to a player, the rewards may be converted into tangible game values, such as token coins, and paid to the player, with such conversion and payout being triggered, for example, by a predetermined user operation. The intangible game values, such as credits, are electronically managed by a management device, with the intangible game values being associated with identification information of the player. The management device is, for example, a computer installed in an entertainment facility or a commercial facility. The player may spend some or all of intangible game values managed by the management device in a game, or may deposit intangible game values provided as a reward into the management device.

A fixed value is set for a game value. However, the value of a game value may become a variable value by storing a quantity of game values or identification information representative of the quantity in a storage circuit (for example, an IC tag) or by printing a code (for example, a barcode or a QR code (registered trademark)) representative of the quantity of game values on the game values. Game values provided to a player may be exchanged for various goods, such as premium goods. In the first embodiment, a case is assumed in which game values spent on a game and game values provided to a player as a reward that accords with the result of the gameplay are token coins.

A game in which game objects are used is played on the game apparatus 10. For example, game objects are used for a game responsive to expenditure of game values. For example, game objects that accord with the game values spent are fed into a game field. Tangible game values spent may be used directly in a game, or game objects that differ from the spent tangible game values may be used in a game. For example, token coins inserted by a player may be used directly as the game objects for a game, or balls different from the token coins inserted by a player may be used as the game objects for the game. In a configuration in which a different type of game object from spent game values are used in a game, a relation between an amount of spent game values and a quantity of game objects used in a game responsive to expenditure of the game objects can be changed, as appropriate. For example, two game objects may be fed into a game field in exchange for expenditure of one token coin, or one game object may be fed in exchange for expenditure of one token coin. When a player plays a game by spending intangible game values such as credits, game objects are fed into a game field, for example, by an operation of a predetermined operator (not shown) by the player.

While the game objects may be of any shape, in the first embodiment a case is assumed in which game objects of a three-dimensional shape (hereafter, "three-dimensional game objects") are used. The three-dimensional game objects may be of a disk shape as in the case of token coins or coins, or of a solid shape as in the case of balls or cuboids. Particularly, in the first embodiment, there are used three-dimensional game objects that are rollable regardless of their orientation. Typical as an example of a three-dimensional game object that is rollable regardless of orientation is a spherical object (for example, a marble). However, the concept of three-dimensional game objects that are rollable regardless of orientation of the three-dimensional game objects also include, for example, a substantially spherical polyhedron, such as a truncated polyhedron. It is of note that some of the configurations adopted in the first embodiment are also applicable to a three-dimensional game object (for example, a disk-shaped three-dimensional game object) that does not roll in specific orientation.

In the first embodiment, two kinds of spherical objects having different diameters are used as the three-dimensional game objects. In the following explanations, a spherical object having a larger diameter between the two kinds of spherical objects is referred to as a "large ball" and a spherical object having a smaller diameter is referred to as a "small ball." The three-dimensional game objects (the small balls and the large balls) in the first embodiment are formed from a light transmissive material.

As shown in FIG. 1, the game apparatus 10 of the first embodiment includes four stations 100 (100*a*, 100*b*, 100*c*, and 100*d*) for use in playing games by different players, and four operating panels 160 (160*a*, 160*b*, 160*c*, and 160*d*) respectively operated by the players. The four stations 100 are able to provide independent games of the same kind to different players in parallel. The stations 100 provide games that progress with movement of the three-dimensional game objects to players. Each of the four stations 100 are also able to individually function as a game apparatus. The total number of the stations 100 included in the game apparatus 10 is not limited to four and may be any number equal to or greater than one.

The two stations 100*a* and 100*c* are adjacent to each other in a front-back direction of players (a Y direction in FIG. 1). Similarly, the two stations 100*b* and 100*d* are adjacent to each other in the front-back direction. The two stations 100*a* and 100*b* are adjacent to each other in a right-left direction of players (an X direction in FIG. 1). Similarly, the two stations 100*c* and 100*d* are adjacent to each other in the right-left direction.

The four stations 100 have the same configuration. In the following explanation, the station 100*a* is focused on, and explanations of the other stations 100*b*, 100*c*, and 100*d* are omitted, as appropriate. A suffix "a" is appended to signs of elements constituting the station 100*a*. For elements constituting other stations 100*b*, 100*c*, and 100*d*, the suffix "a" of the elements of the station 100*a* is replaced with "b," "c," and "d," respectively. Elements having signs to which a combination of two suffixes is appended are elements shared by two stations 100 that respectively correspond to the two suffixes. For example, an element having a sign to which the suffix "ab" is appended is shared by the station 100*a* and the station 100*b*.

As shown in FIG. 1, the station 100*a* includes a payout port Ma. The payout port Ma is an opening for paying game values to a player in accordance with a result of a game.

Figure 2:
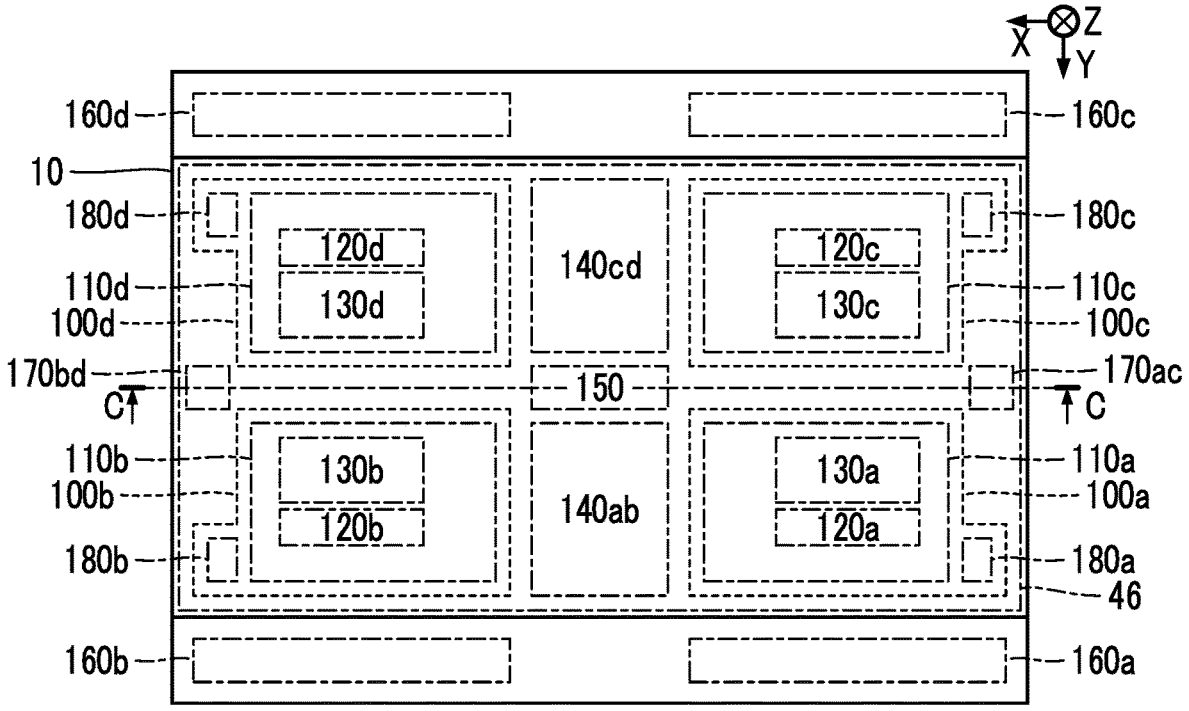
FIG. 2 is a plan view of the game apparatus viewed from above in a vertical direction.

FIG. 2 is a schematic diagram showing the elements of the game apparatus 10 as viewed from above (in a Z direction in FIG. 1) in a vertical direction. As shown in FIG. 2, the station 100*a* includes a game field 110*a*, a first lottery portion 120*a*, a second lottery portion 130*a*, and a conveyor device 180*a*. The game apparatus 10 includes conveyor devices 170*ac* and 170*bd*, third lottery portions 140*ab* and 140*cd*, and a JP (jackpot) payout portion 150 in addition to the four stations 100.

Figure 4:
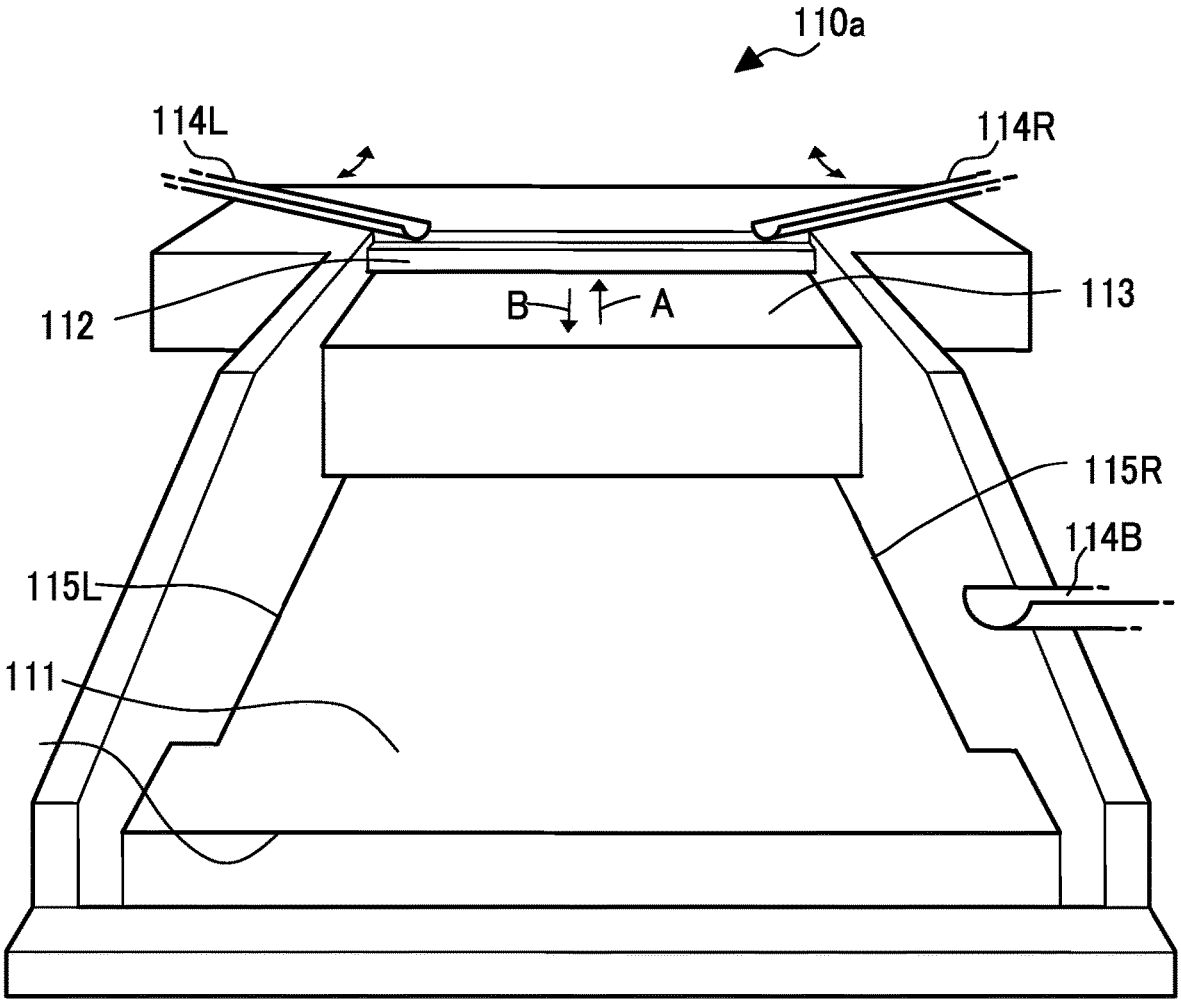
FIG. 4 is a perspective view of a game field.
Figure 5:
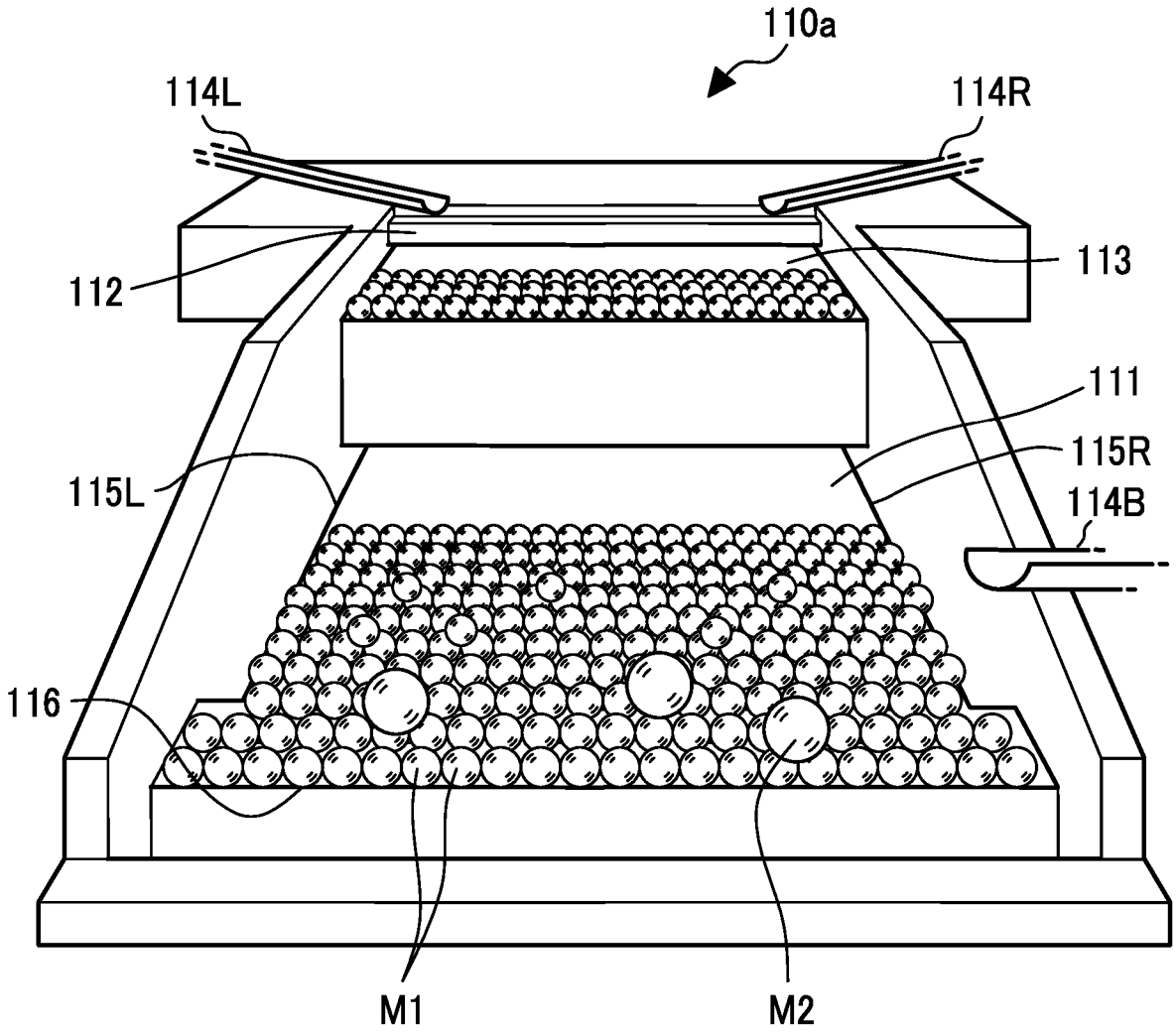
FIG. 5 is a perspective view of a state in which three-dimensional game objects are placed in the game field.

The game field 110*a* is a space in which a game using three-dimensional game objects is performed. In the first embodiment, a pusher game using three-dimensional game objects is performed in the game field 110*a*. FIG. 4 is a perspective view illustrating the game field 110*a*, and FIG. 5 is a perspective view showing a state in which small balls M1 and large balls M2 have been supplied to the game field 110*a*. As shown in FIGS. 4 and 5, a table 111, a wall portion 112, a pusher table 113, feeding portions 114L and 114R, and a large ball feeding portion 114B are arranged in the game field 110*a*.

The table 111 is a flat member fixed substantially horizontally. There is formed in the left periphery of the table 111*a* cutout 115L and in the right periphery a cutout 115R. The cutouts 115L and 115R are of a dimension and shape that do not allow passage of the large balls M2, but do allow passage of the small balls M1. The pusher table 113 is a structure that reciprocates in front and back directions (a direction A and a direction B in FIG. 4) on the face of the table 111. The wall portion 112 is arranged in such a manner that the bottom surface thereof faces the surface of the pusher table 113.

The feeding portion 114L feeds the small balls M1 from the left side of the game field 110*a* onto the face of the pusher table 113. The feeding portion 114R feeds the small balls M1 from the right side of the game field 110*a* onto the face of the pusher table 113. The large ball feeding portion 114B feeds the large balls M2 onto the face of the table 111.

In a state in which a game is actually performed, many small balls M1 are placed on the faces of the table 111 and the pusher table 113 as shown in FIG. 5. The large balls M2 fed from the large ball feeding portion 114B are placed on the face of the table 111. The small balls M1 fed from the feeding portion 114L or 114R onto the face of the pusher table 113 are pushed by the wall portion 112 when the pusher table 113 moves backward (in the direction A in FIG. 4). The small balls M1 sequentially move in the direction B as a result of being pushed by the wall portion 112, and surplus small balls M1 located near a forward edge of the pusher table 113 fall from the forward edge of the pusher table 113 onto the face of the table 111. The small balls M1 on the face of the table 111 sequentially move in the direction B as a result of being pushed by the pusher table 113 moving in the direction B, and surplus small balls M located near a forward edge 116 of the table 111 fall from the forward edge 116.

A quantity of the game values corresponding to the number of small balls M1 having fallen from the forward edge 116 is provided as a reward to the player. Meanwhile, small balls M1 passing through the cutout 115L or 115R are not included in determining the quantity of the game values to be provided to the player.

The first lottery portion 120*a* in FIG. 2 is a physical lottery portion used for a first lottery. The first lottery is a physical lottery for determining the number of small balls M1 to be used in a second lottery, as will be described later. The first lottery using the first lottery portion 120*a* is performed each time a first condition is met. The first condition is, for example, falling of m large balls M2 from the game field 110*a* (where m is an integer equal to or greater than 1). In the following explanations, a case in which m is 1 is assumed. That is, the first lottery is performed each time one large ball M2 falls from the forward edge 116 of the game field 110*a*. The first condition is not limited to this example.

The second lottery portion 130*a* is a physical lottery portion used for a second lottery. The second lottery is a physical lottery for determining whether to perform a third lottery, as will be described later. The second lottery using the second lottery portion 130*a* is performed each time a second condition is met. The second condition is, for example, falling of n large balls M2 from the game field 110*a*. A case in which the number n is 3 is assumed in the following explanations. That is, the second lottery is performed each time three large balls M2 fall from the game field 110*a*.

The number of small balls M1 used in the second lottery is the sum of results of n times of the first lottery performed before the second lottery is started. That is, the number of small balls M1 determined according to a progress status of the game is used in the second lottery.

The third lottery portion 140*ab* is a physical lottery portion shared by the stations 100*a* and 100*b* and used in the third lottery. The third lottery is a physical lottery for determining whether the JP payout portion 150 pays out many small balls M1. The third lottery using the third lottery portion 140*ab* is performed when in the second lottery it is determined that the third lottery is to be performed. Specifically, when the third lottery is determined to be performed in the second lottery using the second lottery portion 130*a*, whether many small balls M1 are to be paid out by the JP payout portion 150 to be fed into the game field 110*a* is determined in the third lottery using the third lottery portion 140*ab*. Further, when the third lottery is determined to be performed in the second lottery using the second lottery portion 130*a*, whether many small balls M1 are to be paid out by the JP payout portion 150 to be fed into the game field 110*b* is determined by the third lottery using the third lottery portion 140*ab*. Although description is given above that the third lottery portion 140*ab* is shared by the stations 100*a* and 100*b*, it is of note that the same applies to the third lottery portion 140*cd* shared by the stations 100*c* and 100*d*.

The JP payout portion 150 is shared by the four stations 100 (100*a*, 100*b*, 100*c*, and 100*d*). As shown in FIG. 2, the JP payout portion 150 is located at the center of the game apparatus 10, as seen in a planar view in a vertical direction. The JP payout portion 150 in the first embodiment can switch a payout destination of the small balls M1 to one of the game fields 110*a*, 110*b*, 110*c*, and 110*d*.

Figure 3:
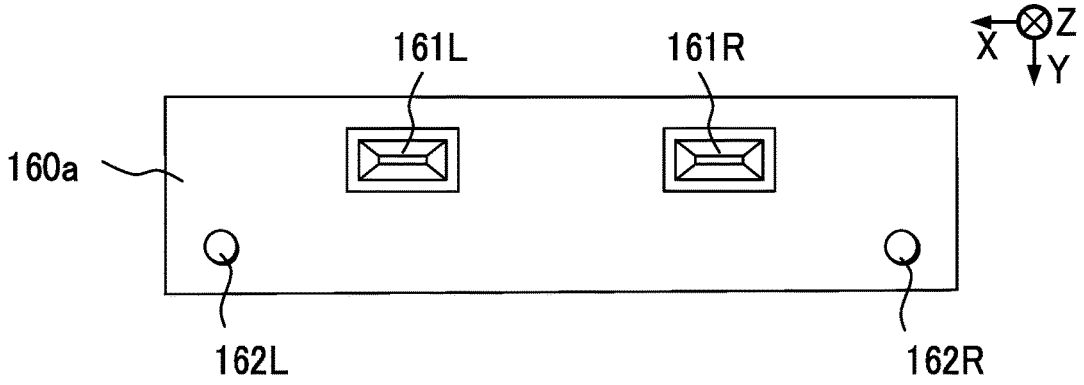
FIG. 3 is a plan view illustrating a configuration of an operating panel.

The operating panel 160*a* in FIG. 2 receives operations from the player. FIG. 3 is a plan view illustrating a configuration of the operating panel 160*a*. As shown in FIG. 3, the operating panel 160*a* is configured to include slots 161L and 161R, and switch operation portions 162L and 162R. Tangible game values are inserted into the slots 161L and 161R by the player.

When a tangible game value is inserted into the slot 161L, a small ball M1 is fed into the game field 110*a* from the feeding portion 114L on the left side of the game field 110*a*. The switch operation portion 162L is operated by the player to change the feeding direction of the small ball M1 from the feeding portion 114L. When a game value is inserted into the slot 161R, a small ball M1 is fed into the game field 110*a* from the feeding portion 114R on the right side of the game field 110*a*. The switch operation portion 162R is operated by the player to change the feeding direction of the small ball M1 from the feeding portion 114R.

The conveyor device 170*ac* in FIG. 2 transports small balls M1. Specifically, the conveyor device 170*ac* is shared by the stations 100*a* and 100*c* and transports, for example, small balls M1 that have fallen from the game field 110*a* or 110*c* to a higher position. The small balls M1 transported by the conveyor device 170*ac* are used by multiple elements (the stations 100, for example). The conveyor device 170*bd* is shared by the stations 100*b* and 100*d* and transports small balls M1 that have fallen from the game field 110*b* or 110*d* to a higher position.

The conveyor device 180*a* transports small balls M1, for example, in the vertical direction. For example, an air lifter that transports small balls M1 by sending air into a circular pipe that houses the small balls M is preferably used as the conveyor device 180*a*. The inside diameter of the circular pipe is larger than the outside diameter of the small ball M1 and is smaller than the size of 1.5 times of the outside diameter. As a difference (hereafter, "diameter difference") between the inside diameter of the circular pipe and the outside diameter of the small ball M1 approaches zero, an external force produced by the sending of air is more likely to act on the small balls M1 in the circular pipe, whereby the small balls M1 can be transported in a shorter time. Therefore, it is desirable that the diameter difference is close to zero. Further, when the diameter difference is close to zero, the outside diameter of the circular pipe is reduced and downscaling of the conveyor device 180*a* can be realized. It is of note that the transport direction of the small balls M1 by the conveyor device 180*a* is not limited to the vertical direction. The small balls M1 transported by the conveyor device 180*a* are supplied to the third lottery portion 140*ab* or a game object housing space 46 (see FIG. 28), as will be described later.

Figure 6:
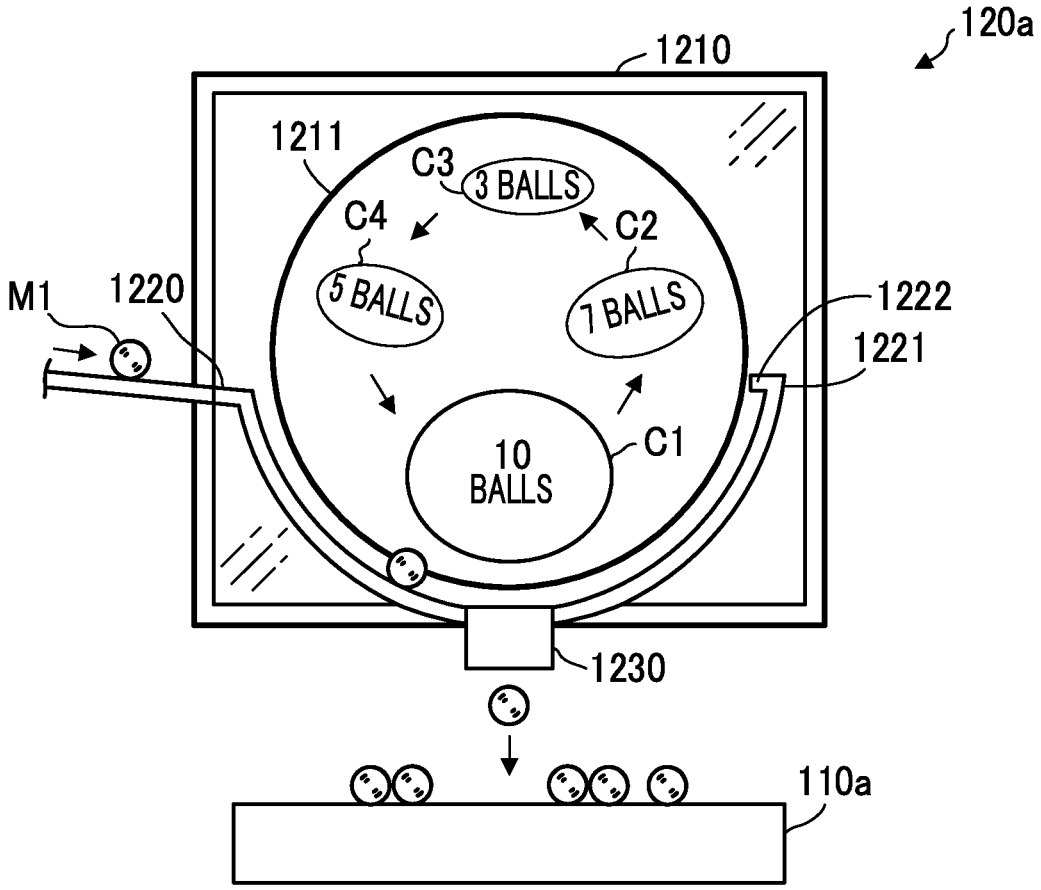
FIG. 6 is a plan view illustrating a configuration of a first lottery portion.

First lottery portion 120*a* FIG. 6 is a plan view illustrating a configuration of the first lottery portion 120*a*. As shown in FIG. 6, the first lottery portion 120*a* includes a display 1210 and a passage 1220.

The display 1210 includes a circular screen 1211. Candidates C1 to C4 for the number of small balls M1 to be used in the second lottery are displayed on the screen 1211. The candidate C1 indicates "ten balls," the candidate C2 indicates "seven balls," the candidate C3 indicates "three balls," and the candidate C4 indicates "five balls." The total number of candidates displayed on the screen 1211 and the number of small balls M1 indicated by each candidate are not limited to the above examples and may freely be changed.

Each time one large ball M2 falls from the forward edge 116, the candidates C1 to C4 are displayed on the screen 1211 and a small ball M1 is fed to the passage 1220. The passage 1220 is arc-shaped along the outer circumference of the screen 1211. A protrusion 1222 for preventing the small ball M1 from jumping out is placed at an end 1221 of the passage 1220. A discharger 1230 passed by the small ball M1 is formed in the middle of the passage 1220.

The display 1210 changes the positions of the candidates C1 to C4 on the screen 1211 with a lapse of time. The small ball M1 fed to the passage 1220 moves along the passage 1220 and finally passes through the discharger 1230. At a point in time when the small ball M1 passes through the discharger 1230, the movement of the candidates C1 to C4 on the screen 1211 stops. A number indicated by a candidate having stopped at a position closest to the discharger 1230 among the candidates C1 to C4 is determined as the number of small balls M1 to be used in the second lottery. The small ball M1 having passed through the discharger 1230 falls onto the game field 110*a* (the pusher table 113, for example).

Figure 7:
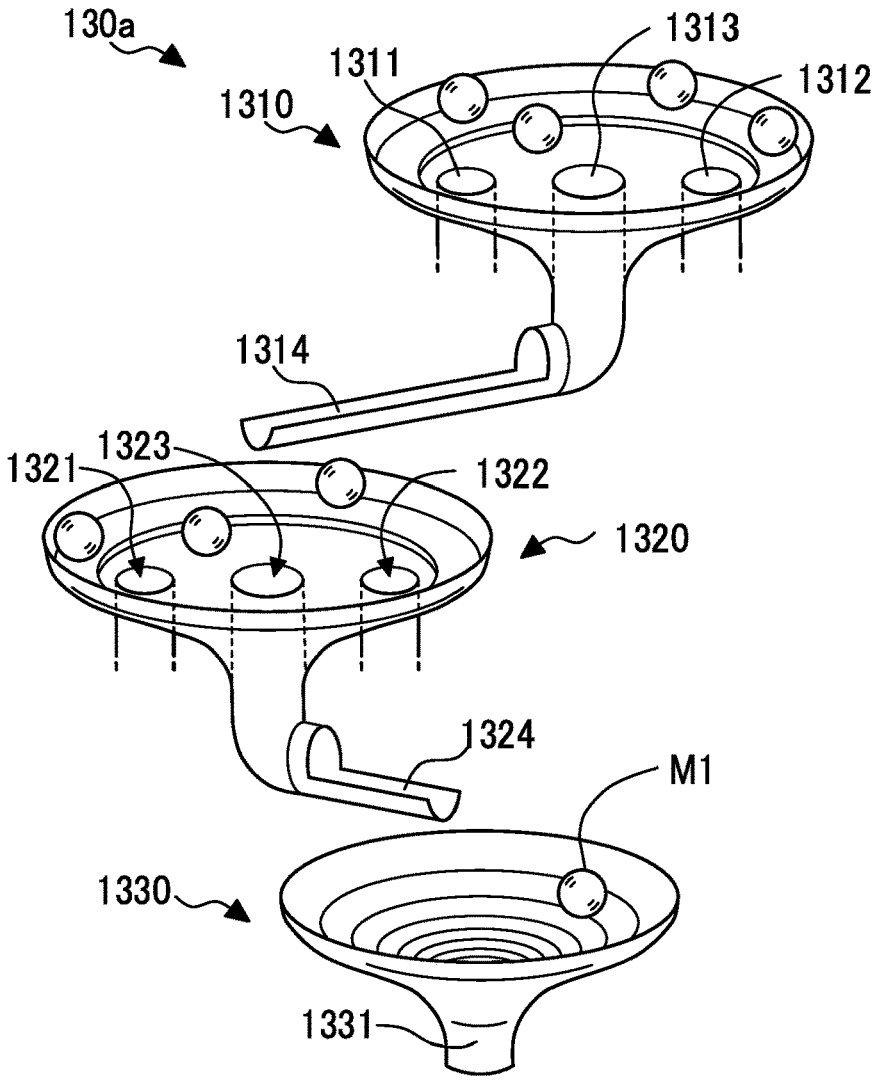
FIG. 7 is a perspective view illustrating a configuration of a second lottery portion.

Second lottery portion 130*a* FIG. 7 is a perspective view illustrating a configuration of the second lottery portion 130*a*. The second lottery portion 130*a* includes a first distributer 1310, a second distributer 1320, and an accessory 1330. Each of the first distributer 1310 and the second distributer 1320 is a structure (a distributer or a sorter) that distributes small balls M1 to a plurality of paths. When three large balls M2 fall from the forward edge 116 (that is, when the second condition is met), small balls M1 are fed to the first distributer 1310 each time one of the three large balls M2 falls. The number of small balls M1 fed each time is the sum of the numbers of small balls M1 determined in the first lottery.

The small balls M1 fed to the first distributer 1310 pass through any of through-holes 1311, 1312, and 1313 formed on the first distributer 1310. Small balls M having passed through either the through-hole 1311 or 1312 are collected without being fed to the second distributer 1320. Meanwhile, small balls M1 having passed through the through-hole 1313 are fed to the second distributer 1320 via a passage 1314.

The small balls M1 fed to the second distributer 1320 pass through any of through-holes 1321, 1322, and 1323 formed on the second distributer 1320. Small balls M1 having passed through either the through-hole 1321 or 1322 are collected without being fed to the accessory 1330. Meanwhile, small balls M1 having passed through the through-hole 1323 are fed to the accessory 1330 via a passage 1324.

The small balls M1 fed to the accessory 1330 are discharged from a discharger 1331 formed on the accessory 1330. When the small balls M1 are discharged from the discharger 1331, the third lottery using the third lottery portion 140*ab* is carried out.

Figure 8:
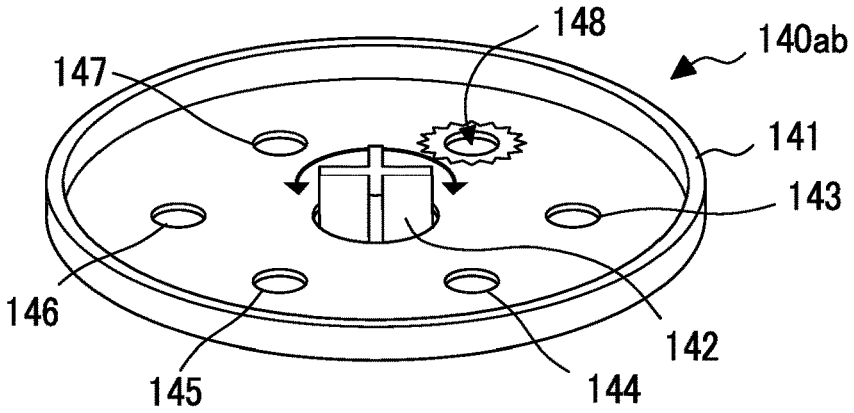
FIG. 8 is a perspective view illustrating a configuration of a third lottery portion.

Third lottery portion 140*ab* FIG. 8 is a perspective view illustrating a configuration of the third lottery portion 140*ab*. The third lottery portion 140*ab* includes a distributer 141 and a small ball mover 142. When small balls M1 are discharged from the discharger 1331 of the second lottery portion 130*a*, the small balls M1 are fed to the distributer 141 of the third lottery portion 140*ab*.

The small ball mover 142 is mounted at the center of the distributer 141 and rotates in both directions. The small balls M1 fed to the distributer 141 hit the small ball mover 142, thereby moving toward the outer circumference of the distributer 141. As the above state is repeated, a small ball M1 passes through any of through-holes 143 to 148 formed on the distributer 141. When a small ball M1 passes through any of the through-holes 143 to 147, payout of many small balls M1 by the JP payout portion 150 is not carried out. On the other hand, when a small ball M1 passes through the through-hole 148, payout of many small balls M1 by the JP payout portion 150 is carried out.

Figure 9:
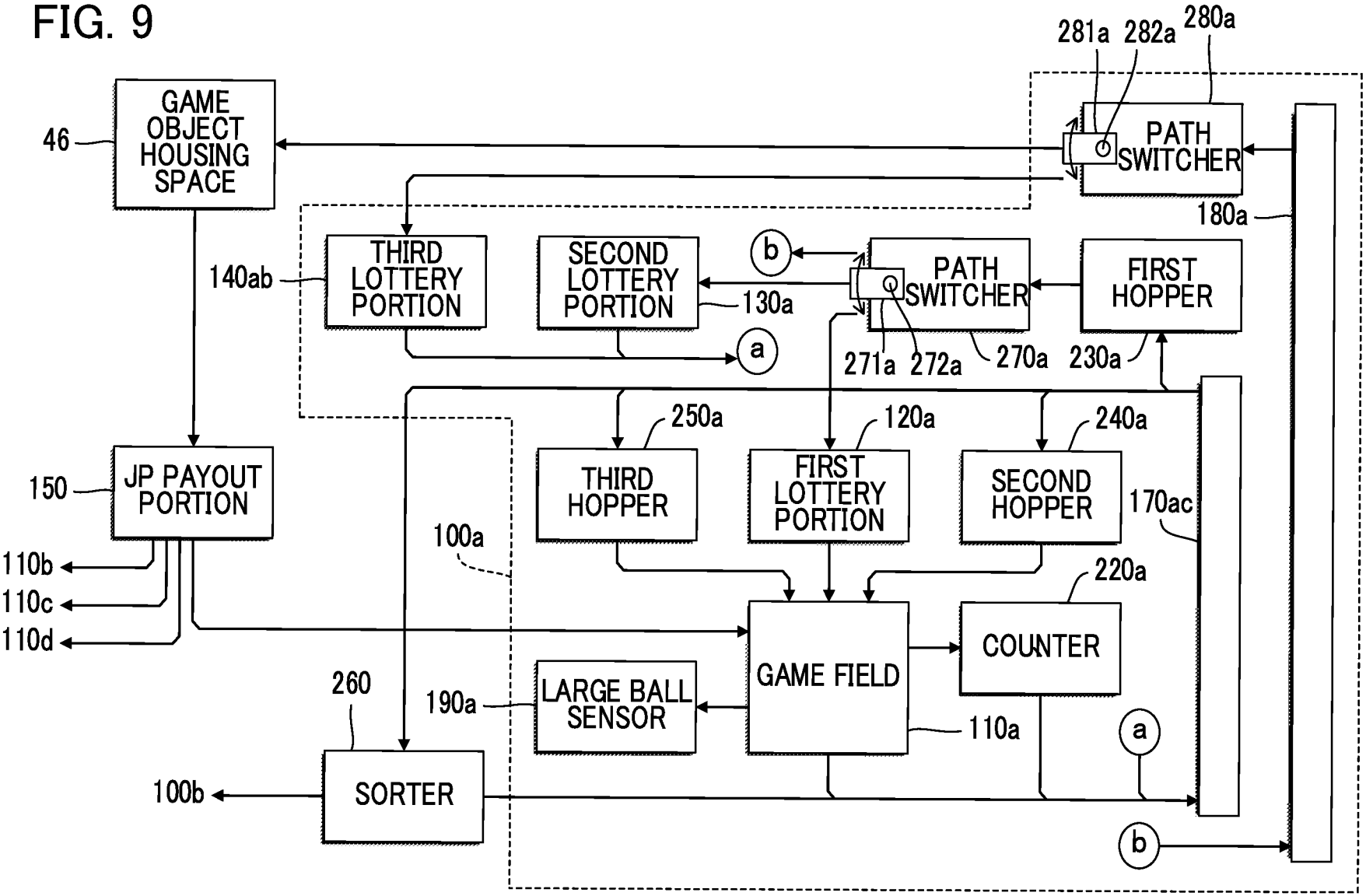
FIG. 9 is a block diagram for explaining a flow of three-dimensional game objects.

Flow of three-dimensional game objects (small balls M1 and large balls M2) FIG. 9 is a block diagram for explaining a flow of small balls M1 and large balls M2 in the station 100*a*. As shown in FIG. 9, the station 100*a* includes a large ball sensor 190*a*, a counter 220*a*, a first hopper 230*a*, a second hopper 240*a*, a third hopper 250*a*, and path switchers 270*a* and 280*a* in addition to the configuration shown in FIG. 2. It is of note that for convenience the conveyor device 170*ac* is shown in the inner side of a frame border representing the station 100*a* in FIG. 9, although the conveyor device 170*ac* is an element shared by the two stations 100*a* and 100*c*.

The large ball sensor 190*a* detects large balls M2 that have fallen from the forward edge 116 of the table 111 in the game field 110*a*. The first lottery using the first lottery portion 120*a* and the second lottery using the second lottery portion 130*a* are carried out in accordance with a result of the detection using the large ball sensor 190*a*.

Small balls M that have fallen from the forward edge 116 in the game field 110*a* are supplied to the counter 220*a*. The counter 220*a* is a count hopper that reserves the small balls M1 supplied from the forward edge 116 and counts the small balls M1. A count value of the counter 220*a* is used to determine the quantity of the game values provided as a reward to a player. The counter 220*a* discharges counted small balls M1.

The conveyor device 170*ac* transports up small balls M1 used in a game and small balls M not used in the game from a lower part to an upper part in the vertical direction. The small balls M1 used in a game are small balls M1 discharged from the counter 220*a*, small balls M1 that have fallen from the cutout 115L or 115R, and small balls M1 used in the second lottery portion 130*a* or the third lottery portion 140*ab*. The small balls M1 not used in a game are small balls M1 sorted into the station 100*a* by a sorter 260, which will be described later. The small balls M1 transported by the conveyor device 170*ac* are supplied to a first path 310*ac*.

The first path 310*ac* is a path on which small balls M1 move. There are provided on the first path 310*ac* openings (supply paths) for respectively supplying small balls M1 to the first hopper 230*a*, the second hopper 240*a*, and the third hopper 250*a*. Small balls M1 transported by the conveyor device 170*ac* can enter the first hopper 230*a*. The first hopper 230*a* reserves small balls M1 that are supplied from the first path 310*ac*, and sequentially supplies the small balls M to the path switcher 270*a*.

Figure 10:
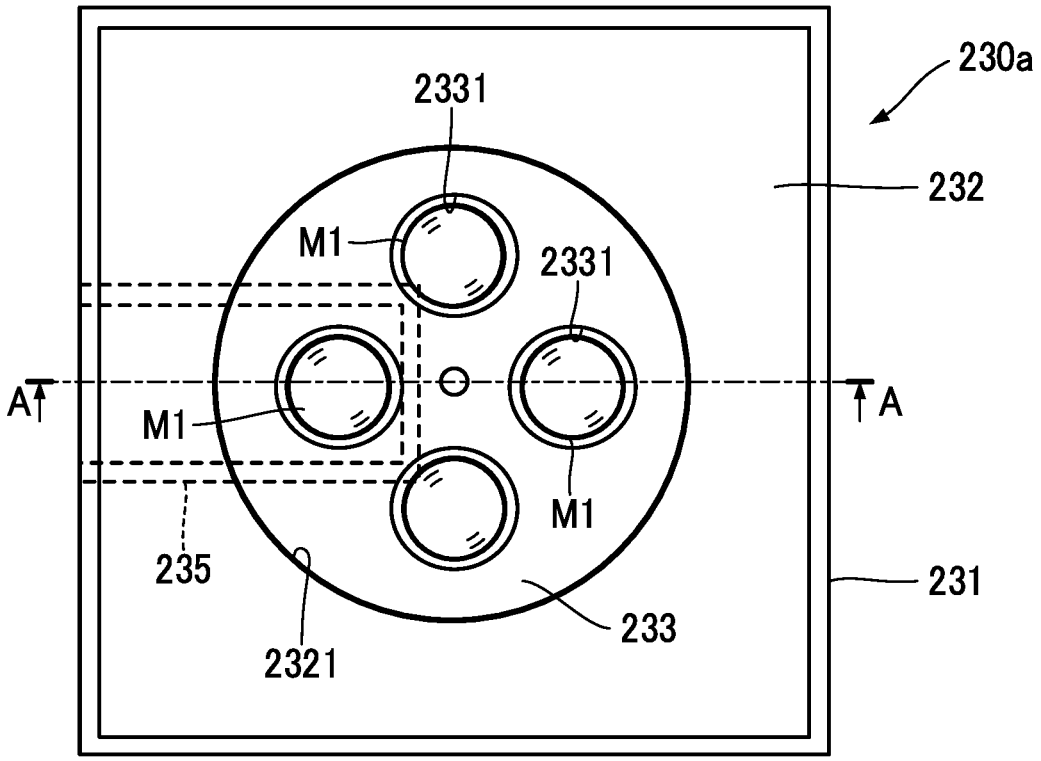
FIG. 10 is a plan view of a first hopper.
Figure 11:
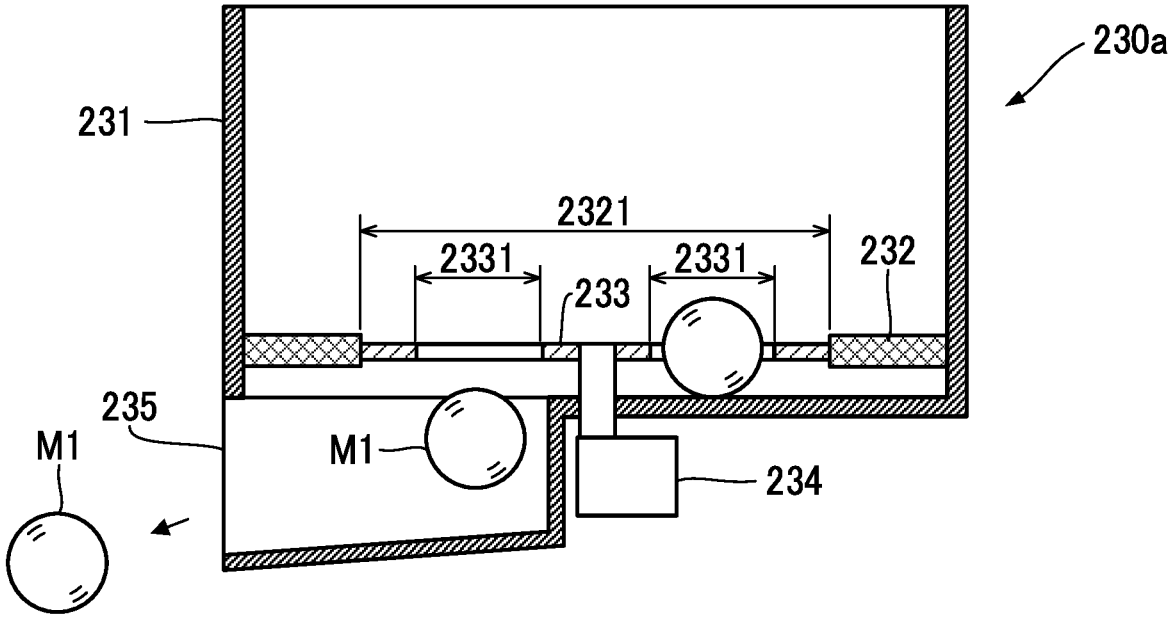
FIG. 11 is a sectional view along a line A-A in FIG. 10.

First hopper 230*a* FIG. 10 is a plan view of the first hopper 230*a*. FIG. 11 is a sectional view along a line A-A in FIG. 10. As shown in FIGS. 10 and 11, the first hopper 230*a* includes a reserving container 231, a bottom portion 232, a rotating body 233, and a drive mechanism 234.

The reserving container 231 is a container for reserving small balls M1. Formed on the bottom surface of the reserving container 231 is a discharge path 235 through which the small balls M1 can pass. The bottom portion 232 is a plate-like member facing the bottom surface of the reserving container 231 with a gap smaller than the outer dimension of the small ball M1 between the bottom portion 232 and the bottom surface of the reserving container 231. There is formed a circular opening 2321 on the bottom portion 232. The rotating body 233 is a disk-shaped member mounted in the opening 2321. There are formed through-holes 2331 on the rotating body 233 at equal intervals in a circumferential direction. The small balls M1 reserved in the reserving container 231 can pass through the through-holes 2331. The drive mechanism 234 is configured to include, for example, a motor and rotates the rotating body 233.

The small balls M1 reserved in the reserving container 231 are held in the through-holes 2331 of the rotating body 233. When a through-hole 2331 reaches just above the discharge path 235 upon rotation of the rotating body 233, the small ball M1 in the through-hole 2331 falls in the discharge path 235 and is discharged outside the first hopper 230*a*. That is, the first hopper 230*a* allows the small balls M1 reserved in the reserving container 231 to be sequentially discharged one by one. Detailed explanations of the second hopper 240*a* and the third hopper 250*a* are omitted because the configurations are substantially the same as that of the first hopper 230*a*.

The path switcher 270*a* in FIG. 9 switches the supply destination of the small ball M1 discharged from the first hopper 230*a*. Specifically, the path switcher 270*a* switches the supply destination of the small ball M1 to be any of the first lottery portion 120*a*, the second lottery portion 130*a*, and the conveyor device 180*a*. For example, the path switcher 270*a* includes a discharger 271*a* that discharges the small ball M1 supplied from the first hopper 230*a*. The discharger 271*a* is pivoted about a rotation shaft 272*a*. By turning the discharger 271*a* with a drive mechanism (not shown) such as a motor, the small ball M1 is supplied to any of the first lottery portion 120*a*, the second lottery portion 130*a*, and the conveyor device 180*a*.

As will be understood from the above explanations, the first hopper 230*a* corresponds to a game object utilizer that uses small balls M1 in the first lottery carried out by the first lottery portion 120*a*, or the second lottery carried out by the second lottery portion 130*a* (that is, a physical lottery performed by a physical lottery portion).

When the first hopper 230*a* is full, a supply path 231*a* is blocked by small balls M1 and therefore small balls M1 transported by the conveyor device 170*ac* to the first path 310*ac* cannot enter the first hopper 230*a*. Small balls M1 that have not entered the first hopper 230*a* from among the small balls M1 transported by the conveyor device 170*ac* may enter the second hopper 240*a*. The second hopper 240*a* reserves small balls M1 that are supplied from the first path 310*ac* and uses the small balls M1. Specifically, the second hopper 240*a* sequentially feeds the small balls M1 from the feeding portion 1141R onto the game field 110*a* (specifically, the pusher table 113).

When the first hopper 230*a* and the second hopper 240*a* are full, the supply path 231*a* and a supply path 241*a* are blocked by small balls M1 and therefore the small balls M1 transported by the conveyor device 170*ac* to the first path 310*ac* cannot enter the first hopper 230*a* or the second hopper 240*a*. Small balls M1 that have entered neither the first hopper 230*a* nor the second hopper 240*a* among the small balls M1 transported by the conveyor device 170*ac* may enter the third hopper 250*a*. The third hopper 250*a* reserves the small balls M1 supplied from the first path 310*ac* and uses the small balls M1. Specifically, the third hopper 250*a* sequentially feeds the small balls M1 from the feeding portion 114L onto the game field 110*a* (namely, the pusher table 113). As will be understood from the above explanations, the second hopper 240*a* or 240*c* and the third hopper 250*a* or 250*c* are game object utilizers that use small balls M1 for a game in the game field 110*a*.

When the first hopper 230*a*, the second hopper 240*a*, and the third hopper 250*a* are full, the supply paths 231*a* and 241*a* and a supply path 251*a* are blocked by small balls M1, and as a result the small balls M1 transported by the conveyor device 170*ac* to the first path 310*ac* are unable to enter any of the first hopper 230*a*, the second hopper 240*a*, or the third hopper 250*a*. Small balls M1 that have not entered the first hopper 230*a*, the second hopper 240*a*, or the third hopper 250*a* from among the small balls M1 transported by the conveyor device 170*ac* are returned to the conveyor device 170*ac* via the sorter 260 in FIG. 9 and the like. That is, small balls M1 circulate through a path including the conveyor device 170*ac* and the first path 310*ac*. The circulation of small balls M1 will be described later.

The conveyor device 180*a* sequentially transports small balls M1 supplied from the first hopper 230*a* via the path switcher 270*a* to supply the small balls M1 to the path switcher 280*a*. The path switcher 280*a* switches the supply destination of the small balls M1 transported by the conveyor device 180*a*. Specifically, the path switcher 280*a* switches the supply destination of the small balls M1 to either the third lottery portion 140*ab* or the game object housing space 46. For example, the path switcher 280*a* may include a discharger 281*a* that discharges the small balls M1 supplied from the conveyor device 180*a*. The discharger 281*a* is pivoted about a rotation shaft 282*a*. By turning the discharger 281*a* with a drive mechanism (not shown) such as a motor, the small balls M are supplied to either the third lottery portion 140*ab* or the game object housing space 46.

The game object housing space 46 is shared by the four stations 100 (100*a*, 100*b*, 100*c*, and 100*d*). The game object housing space 46 houses small balls M1 to be discharged from the JP payout portion 150 to any of the four game fields 110 (110*a*, 110*b*, 110*c*, and 110*d*).

As will be understood from the above explanations, small balls M1 moving on the first path 310*ac* are used in common by the game in the game field 110*a* and the physical lotteries carried out by the physical lottery portions (120*a*, 130*a*, and 140*ab*) in the first embodiment. An advantage is obtained thereby in that the configuration of the game apparatus 10 can be made simple as compared to a configuration in which a mechanism that supplies small balls M to the game field 110*a* and a mechanism that supplies small balls M1 to the physical lottery portions are provided independently of each other. Because a circulating mechanism 20*ac* continuously circulates small balls M1, small balls M1 used in the physical lotteries are continuously supplied from the first path 310*ac*. Therefore, any number of small balls M1 as determined in accordance with the progress status of the game can be used for the physical lotteries.

Figure 12:
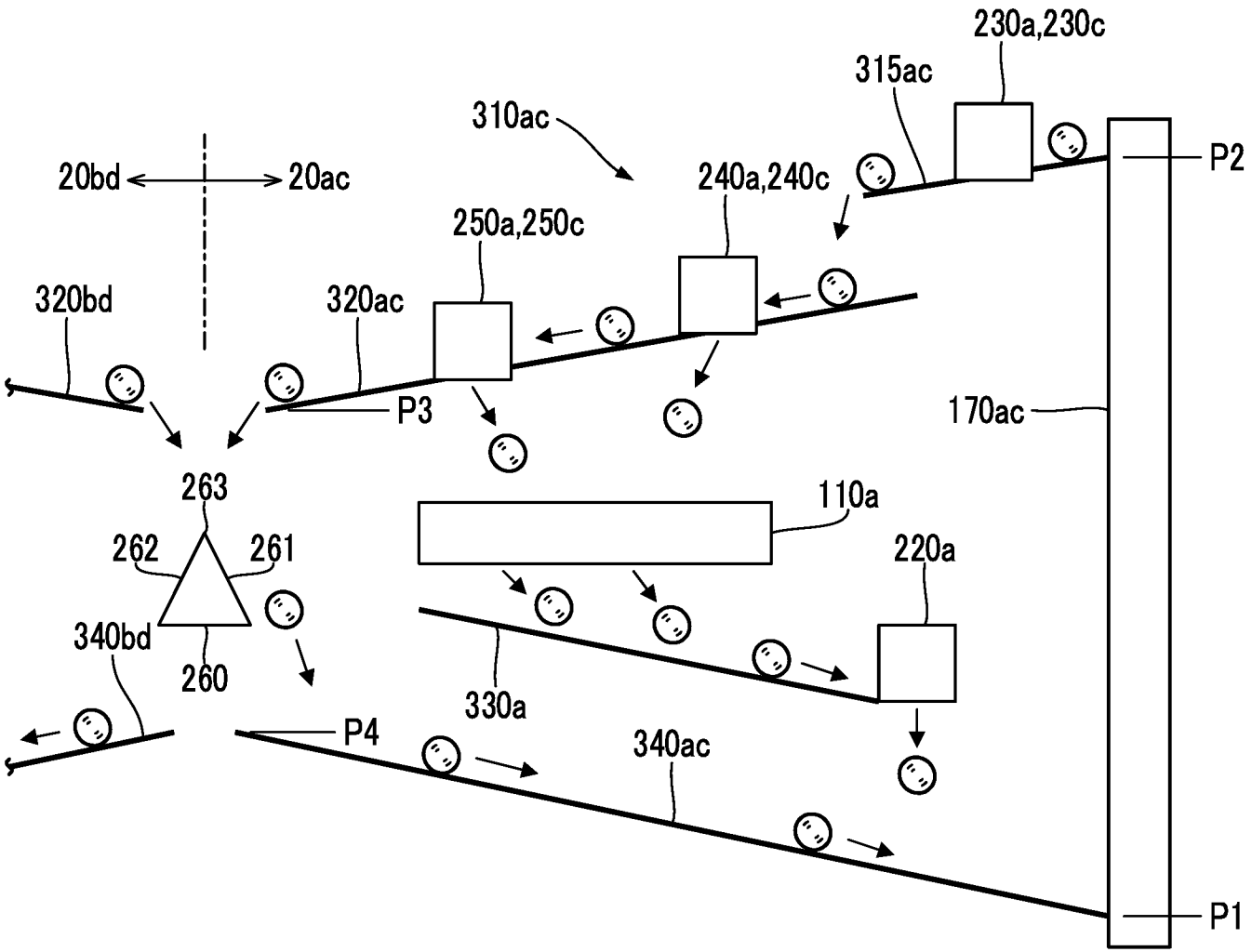
FIG. 12 is an explanatory diagram of a circulating mechanism.

As described above, the game apparatus 10 includes a mechanism (hereafter, "circulating mechanism") that circulates small balls M1. The circulating mechanism is installed for each pair of two stations 100 adjacent in the front-back direction. FIG. 12 is an explanatory diagram of the circulating mechanism 20*ac* corresponding to the two stations 100*a* and 100*c*. A circulating mechanism 20*bd* corresponding to the two stations 100*b* and 100*d* has a configuration substantially the same as that of the circulating mechanism 20*ac* shown in FIG. 12.

As shown in FIG. 12, the circulating mechanism 20*ac* includes the first path 310*ac*, a second path 340*ac*, a collection path 330*a*, and the conveyor device 170*ac*. The first path 310*ac*, the second path 340*ac*, and the conveyor device 170*ac* are shared by the stations 100*a* and 100*c*. A path for circulating small balls M1 is constituted by the first path 310*ac*, the second path 340*ac*, a space in which small balls M1 fall between the both paths (a space including the sorter 260), and the conveyor device 170*ac*. A path for collecting small balls M1 used in the game field 110*a* is constituted by the collection path 330*a*, and a space in which small balls M1 fall between the collection path 330*a* and the second path 340*ac*. As shown in FIG. 12, the counter 220*a* that counts small balls M1 can be installed in the middle of the path for collecting the small balls M1 used in the game field 110*a*. A sidewall (for example, a sidewall 311 in FIG. 13) for preventing falling of small balls M1 is in practice mounted along the edge of each of the first path 310*ac*, the second path 340*ac*, and the collection path 330*a*. However, for convenience, illustrations of the sidewalls are omitted from FIG. 12.

The conveyor device 170*ac* transports small balls M1 from a first position P1 to a second position P2. The second position P2 is higher than the first position P1. Specifically, the second position P2 is located above the first position P1 in the vertical direction. The first path 310*ac* is a path that moves small balls M1 transported to the second position P2 by the conveyor device 170*ac* to a third position P3. The third position P3 is lower than the second position P2. The second position P2 and the third position P3 are different in the horizontal position.

The first path 310*ac* is configured to include a first discrete path 315*ac* and a second discrete path 320*ac*. Each of the first discrete path 315*ac* and the second discrete path 320*ac* includes a slope descending from the second position P2 toward the third position P3. Therefore, small balls M1 roll on the slopes and move toward the third position P3. The small balls M1 transported by the conveyor device 170*ac* are discharged to the first discrete path 315*ac*. The second discrete path 320*ac* is placed downstream of the first discrete path 315*ac*. That is, the first path 310*ac* in the first embodiment consists of the first discrete path 315*ac*, the second discrete path 320*ac*, and a space in which the small balls M1 fall between the two paths. Because the small balls M1 roll on the first path 310*ac* as described above, there is no need for a power source to move the small balls M1 on the first path 310*ac*.

Figure 13:
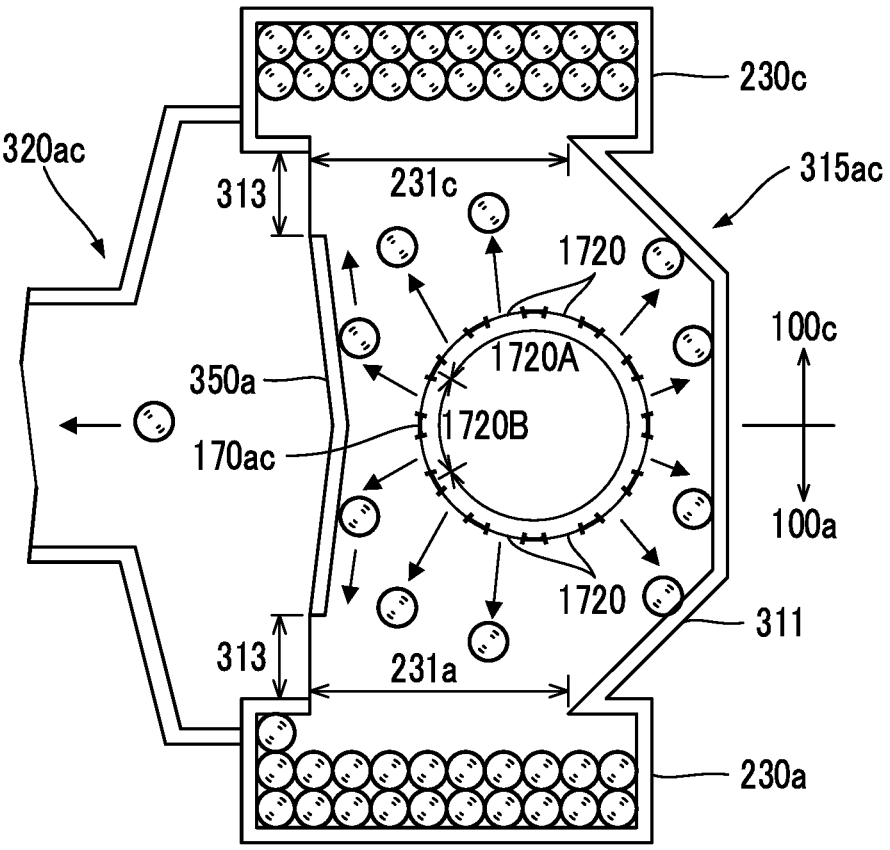
FIG. 13 is a plan view of a part of a first path near a first discrete path.

FIG. 13 is a plan view of a part of the first path 310*ac* near the first discrete path 315*ac*. The right side in FIG. 13 corresponds to the upstream side of the first discrete path 315*ac* and the left side in FIG. 13 corresponds to the downstream side of the first discrete path 315*ac*. The surface of the first discrete path 315*ac* is a slope descending to the downstream from the upstream.

As shown in FIG. 13, the supply path 231*a* and a supply path 231*c* are formed on the first discrete path 315*ac*. The supply path 231*a* is an opening for supplying small balls M1 to the first hopper 230*a*. That is, small balls M1 that have entered the supply path 231*a* are supplied to the first hopper 230*a*. Meanwhile, the supply path 231*c* is an opening for supplying small balls M1 to a first hopper 230*c*. That is, small balls M1 that have entered the supply path 231*c* are supplied to the first hopper 230*c*.

In a configuration where the first discrete path 315*ac* and the first hopper 230*a* are separated, a duct coupling the supply path 231*a* on the first discrete path 315*ac* and the first hopper 230*a* is formed, for example. In the configuration described above, small balls M can be further reserved in the duct even in a state where the reserving container 231 is full. The state where the first hopper 230*a* (the reserving container 231) is full means that the duct as well as the reserving container 231 is full. As will be understood from the above explanations, the duct coupling the supply path 231*a* and the first hopper 230*a* function as a reserver that temporarily reserves small balls M1. The duct can be considered as a part of the reserving container 231. The same holds true for the second hopper 240*a* and the third hopper 250*a*.

The conveyor device 170*a* is a structure having a substantially cylindrical shape that is oriented in a vertical direction. The supply paths 231*a* and 231*c* are provided in opposing relation to each other across the conveyor device 170*ac*. Discharge ports 1720 are formed near the top end of the conveyor device 170*ac* in the circumferential direction. The small balls M1 transported by the conveyor device 170*ac* are radially discharged from the discharge ports 1720. That is, the small balls M1 are discharged in different directions from the discharge ports 1720. The small balls M1 radially discharged from the conveyor device 170*ac* are supplied to destinations corresponding to the discharge directions of the small balls M1. The positions of the discharge ports 1720 of the conveyor device 170*ac* correspond to the second position P2 described above.

Specifically, small balls M1 discharged from the conveyor device 170*ac* toward the supply path 231*a* enter the supply path 231*a*. Similarly, small balls M1 discharged from the conveyor device 170*ac* toward the supply path 231*c* enter the supply path 231*c*. Small balls M1 discharged to an upstream of the supply paths 231*a* and 231*c* in the first discrete path 315*ac* roll along the sidewall 311 of the first discrete path 315*ac* and enter the supply path 231*a* or 231*c*.

On the first discrete path 315*ac* a wall portion (hereafter, "regulator") 350*a* is formed downstream of the conveyor device 170*ac*. Communication paths 313 are formed on both sides of the regulator 350*a*. The communication paths 313 are openings for moving small balls M1 from the first discrete path 315*ac* to the second discrete path 320*ac*. Small balls M1 discharged from the conveyor device 170*ac* toward the communication paths 313 move on the communication paths 313, to fall from the first discrete path 315*ac* to the second discrete path 320*ac*. Small balls M1 discharged from the conveyor device 170*ac* to the downstream roll along the regulator 350*a* to reach the communication paths 313, to fall from the communication paths 313 to the second discrete path 320*ac*. That is, the small balls M1 are guided by the regulator 350*a* to the communication paths 313. When the first hopper 230*a* or 230*c* is full, the small balls M1 roll to fall from the communication paths 313 to the second discrete path 320*ac* without entering the supply paths 231*a* and 231*c*. That is, the small balls M1 discharged from the conveyor device 170*ac* are supplied to any of the supply path 231*a*, the supply path 231*c*, and the second discrete path 320*ac* depending on the discharge directions.

As will be understood from FIG. 13, the size of the opening of the supply path 231*a* corresponding to the first hopper 230*a* is different from that of the openings of the communication paths 313 corresponding to the second discrete path 320*ac*. The size of the opening of a supply path is the area of the opening through which small balls M1 enter the supply path. The openings of the communication paths 313 correspond to the opening to the second hopper 240*a* and the third hopper 250*a*. By use of the above configuration, it is possible to control the number of small balls M1 supplied to the first hopper 230*a* so as to be different from the number of small balls M1 supplied to the second hopper 240*a* or the third hopper 250*a*. In the first embodiment, the opening of the supply path 231*a* is larger than the openings of the communication paths 313. Therefore, small balls M1 can be preferentially supplied to the first hopper 230*a* over the second hopper 240*a* or the third hopper 250*a*.

Figure 14:
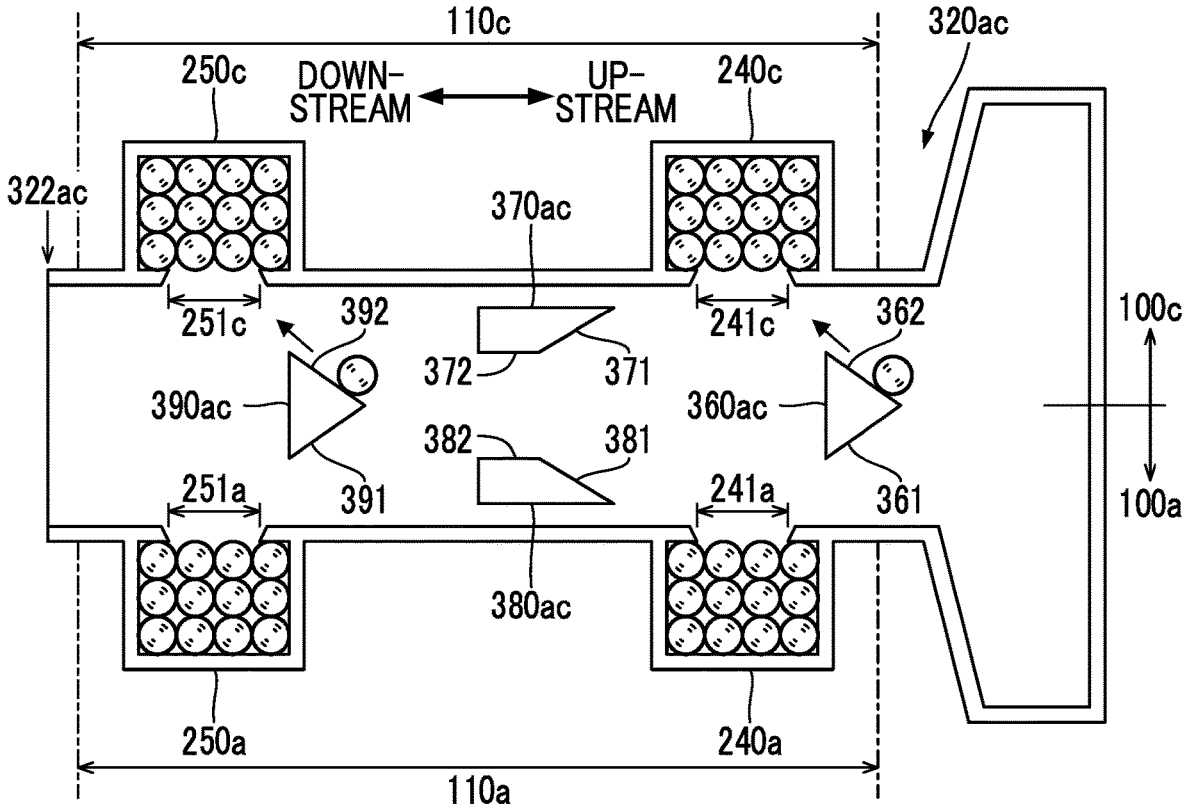
FIG. 14 is a plan view of a part of the first path near a second discrete path.

FIG. 14 is a plan view of the second discrete path 320*ac* of the first path 310*ac*. Similarly to FIG. 13, the right side in FIG. 14 corresponds to the upstream side of the second discrete path 320*ac* and the left side in FIG. 14 corresponds to the downstream side of the second discrete path 320*ac*. The surface of the second discrete path 320*ac* is a slope descending to the downstream from the upstream. The position of an end 322*ac* of the second discrete path 320*ac* on the downstream side corresponds to the third position P3 described above.

As shown in FIG. 14, there are formed on the second discrete path 320*ac* supply paths 241*a* and 251*a* and supply paths 241*c* and 251*c*. The supply paths 241*a* and 241*c* are formed on opposite sides of the second discrete path 320*ac*, and the supply paths 251*a* and 251*c* are formed on opposite sides of the second discrete path 320*ac*.

The supply path 241*a* is an opening for supplying small balls M1 to the second hopper 240*a* and the supply path 251*a* is an opening for supplying small balls M1 to the third hopper 250*a*. Similarly, the supply path 241*c* is an opening for supplying small balls M1 to the second hopper 240*c* and the supply path 251*c* is an opening for supplying small balls M1 to the third hopper 250*c*. The supply paths 241*a* and 241*c* are located further upstream than are the supply paths 251*a* and 251*c*.

As described above, in the first embodiment the circulating mechanism 20*ac* is shared by the game field 110*a* and the game field 110*c*. Therefore, an advantage is obtained in that the configuration of the game apparatus 10 can be kept simple as compared to a configuration in which different circulating mechanisms are installed in the game field 110*a* and the game field 110*c*, respectively.

Small balls M1 rolling on the slope of the second discrete path 320*ac* toward the third position P3 can enter the supply path 241*a* or 241 *c*. Small balls M1 that have entered the supply path 241*a* are supplied to the second hopper 240*a* and small balls M1 that have entered the supply path 241*c* are supplied to the second hopper 240*c*. However, for example, when the second hoppers 240*a* and 240*c* are full, small balls M1 on the second discrete path 320*ac* cannot enter the second hopper 240*a* or 240*c* because the supply paths 241*a* and 241*c* are blocked by small balls M1. It is of note that some of the small balls M1 rolling on the slope cannot enter the supply path 241*a* or 241*c*, for example, due to changes in directions of the movement caused by collision between small balls M1 even if the second hoppers 240*a* or 240*c* is not full; namely, when the supply paths 241*a* and 241*c* are not blocked by small balls M1.

Small balls M1 that do not enter either the supply path 241*a* or 241*c* on the second discrete path 320*ac* are able to enter the supply path 251*a* or 251*c*. Small balls M1 that have entered the supply path 251*a* are supplied to the third hopper 250*a*; and small balls M1 that have entered the supply path 251*c* are supplied to the third hopper 250*c*. However, when the third hoppers 250*a* and 250*c* are full, the small balls M1 on the second discrete path 320*ac* are not able to enter the third hoppers 250*a* or 250*c* because the supply paths 251*a* and 251*c* are blocked by small balls M1. It is of note that some of the small balls M1 rolling on the slope are not able to enter the supply path 251*a* or 251 *c*, for example, due to changes in directions of movement caused by collision between small balls M1 even if the third hoppers 250*a* and 250*c* are not full; namely, when the supply paths 251*a* and 251*c* are not blocked by small balls M1.

As in the example shown above, the supply path 231*a* for supplying small balls M1 to the first hopper 230*a*, and the supply path 241*a* or 251*a* downstream of the supply path 231*a* are formed on the first path 310*ac*. Small balls M1 traveling from the second position P2 toward the supply path 231*a* move toward the third position P3 when the first hopper 230*a* is full; namely, when small balls M1 are not able to enter the supply path 231*a*, but are allowed to enter the supply path 241*a* or 2511*a*. Accordingly, small balls M1 can be preferentially supplied to the first hopper 230*a* over the second hopper 240*a* or the third hopper 250*a*.

Similarly, there are formed on the first path 310*ac* the supply path 241*a* for supplying small balls M to the second hopper 240*a*, and the supply path 251*a* at the downstream of the supply path 241*a*. Small balls M1 traveling from the second position P2 toward the supply path 241*a* move toward the third position P3 when the second hopper 240*a* is full; namely, when the small balls M1 are not able to enter the supply path 241*a*, but are able to enter the supply path 251*a*. Therefore, small balls M1 can be preferentially supplied to the second hopper 240*a* over the third hopper 250*a*.

As shown in FIG. 13, small balls M1 discharged from upstream discharge ports 1720 (hereafter, "first discharge ports 1720A") among the discharge ports 1720 move toward the respective openings of the supply path 231*a* corresponding to the first hopper 230*a* and the supply path 231*c* corresponding to the first hopper 230*c*. Small balls M1 discharged from downstream discharge ports 1720 (hereafter, "second discharge ports 1720B") among the discharge ports 1720 move toward the openings of the communication paths 313. As shown in FIG. 13, the number of the first discharge ports 1720A (ten ports) and the number of the second discharge ports 1720B (two ports) are different. Assuming a case in which the same number of small balls M1 are discharged from each of the discharge ports 1720 of the conveyor device 170*ac*, the number of small balls M1 discharged from the first discharge ports 1720A is greater than the number of those discharged from the second discharge ports 1720B since the number of the first discharge ports 1720A is greater than that of the second discharge ports 1720B. Therefore, small balls M1 can be preferentially supplied to the first hopper 230*a* over the second hopper 240*a* or the third hopper 250*a*.

Figure 26:
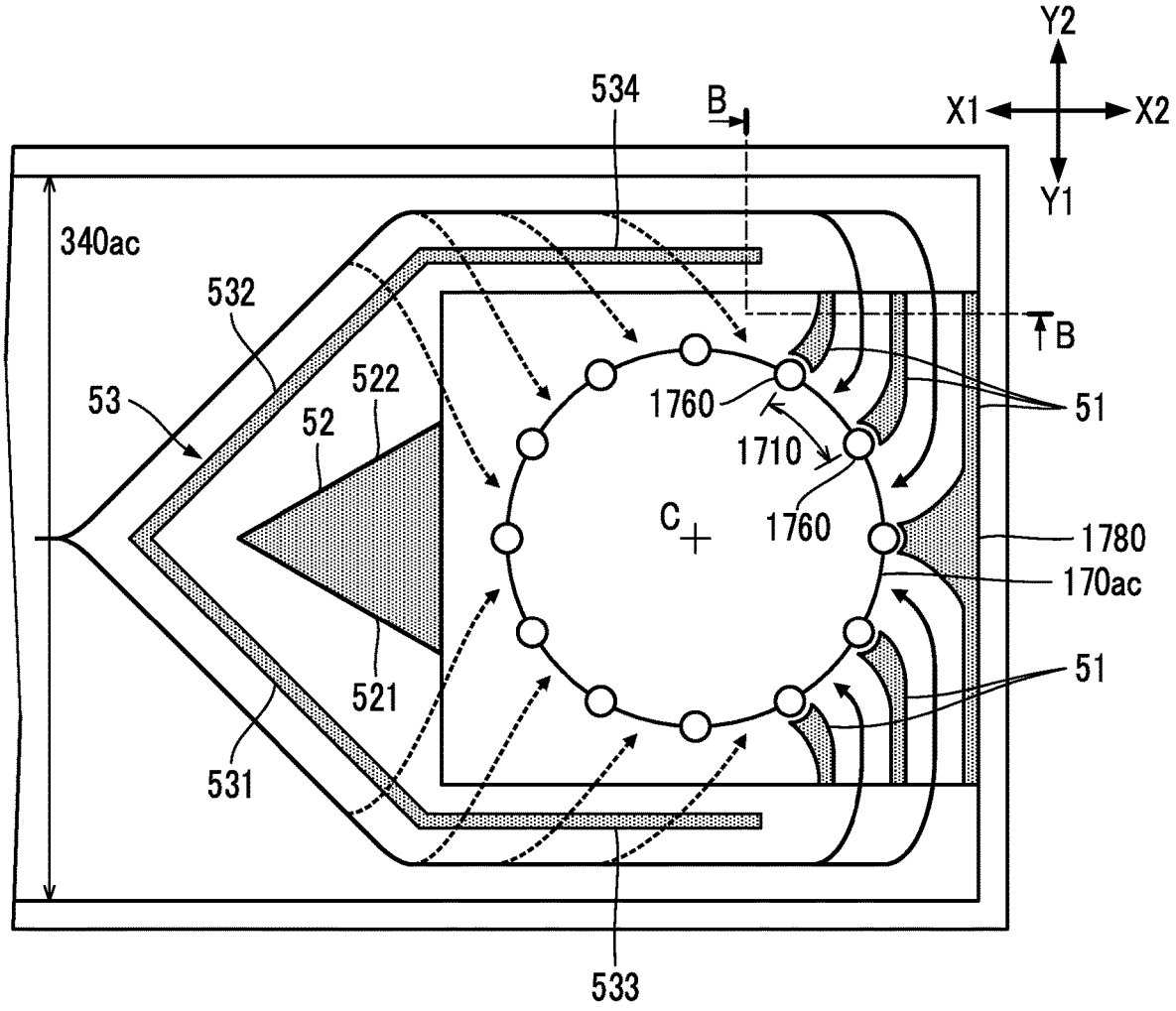
FIG. 26 is a plan view of a part near a supplier viewed from above in a vertical direction.

Supply of the small balls M1 to the conveyor device 170*ac* may be adjusted to cause the number of small balls M1 discharged from the first discharge ports 1720A to be larger than the number of small balls M1 discharged from the second discharge ports 1720B. While a detailed configuration will be described later, the conveyor device 170*ac* of the first embodiment includes intake ports 1710 respectively corresponding to the discharge ports 1720 as shown in FIG. 26. Small balls M1 supplied to any one of the intake ports 1710 are discharged from the discharge port 1720 corresponding to the intake port 1710. Supply quantities of small balls M1 to the intake ports 1710 are controlled such that small balls M1 are preferentially supplied to intake ports 1710 corresponding to the first discharge ports 1720A (intake ports 1710 on an X2 side in an X direction and in a Y direction in FIG. 26) over intake ports 1710 corresponding to the second discharge ports 1720B (intake ports 1710 on an X1 side in the X direction). According to this configuration, small balls M1 can be preferentially supplied to the first hopper 230*a* over the second hopper 240*a* or the third hopper 250*a*, for example, even when the numbers of the first discharge ports 1720A and the second discharge ports 1720B are equal.

As described above, in the first embodiment the number of small balls M1 traveling from the first discharge ports 1720A to the first hopper 230*a* is different from the number of small balls M1 traveling from the second discharge ports 1720B to the second hopper (240*a*, 240*c*) or the third hopper (250*a*, 250*c*). Therefore, the ratio between the number of small balls M1 supplied to the first hopper 230*a* and the number of small balls M1 supplied to the second hopper or the third hopper can be brought close to a predetermined value. As shown in the above example, the total number of game object utilizers being the supply destinations of small balls M1 discharged from the conveyor device 170*ac* (which is six, including the first hoppers 230*a* and 230*c*, the second hoppers 240*a* and 240*c*, and the third hoppers 250*a* and 250*c*) is less than the total number of the discharge ports 1720 (12 ports) in the conveyor device 170*ac*. In other words, since a transport path is formed for each of the discharge ports 1720, the total number of game object utilizers is less than the total number of transport paths.

As shown in FIG. 14, guides 360*ac*, 370*ac*, 380*ac*, and 390*ac* for regulating movement of small balls M1 are placed on the slope of the second discrete path 320*ac*. Each of the guides 360*ac*, 370*ac*, 380*ac*, and 390*ac* is a protrusion extending from the slope of the second discrete path 320*ac*.

The guide 360*ac* is mounted further upstream than the supply paths 241*a* and 241*c*, and guides small balls M1 to the supply path 241*a* or 241*c*. The guide 360*ac* is a protrusion including faces 361 and 362. The faces 361 and 362 are flat surfaces or curved surfaces at an angle to a direction (hereafter, "path direction") in which the second discrete path 320*ac* extends. Small balls M1 brought into contact with the face 361 roll along the face 361 to be guided to the supply path 241*a*. Similarly, small balls M1 brought into contact with the face 362 roll along the face 362 to be guided to the supply path 241*c*. That is, small balls M1 are likely to enter the supply path 241*a* or 241*c*. As explained above, small balls M1 can be preferentially reserved in the second hoppers 240*a* and 240*c* over the third hoppers 250*a* and 250*c* with the guide 360*ac*.

The guides 370*ac* and 380*ac* are mounted further downstream than the supply paths 241*a* and 241*c* and further upstream than the supply paths 251*a* and 251*c*. The guide 370*ac* is a protrusion including a face 371 at an angle to the path direction, and a face 372 parallel to the path direction. Small balls M1 brought into contact with the face 371 roll along the face 371 to be guided to the supply path 241*c*. Similarly, a guide 380*ac* is a protrusion including a face 381 at an angle with respect to the path direction, and a face 382 parallel to the path direction. Small balls M1 brought into contact with the face 381 roll along the face 381 to be guided to the supply path 241*a*. Small balls M1 brought into contact with the face 372 of the guide 370*ac* or the face 382 of the guide 380*ac* are guided to the guide 390*ac*.

The guide 390*ac* is mounted further upstream than the supply paths 251*a* and 251*c*, and guides small balls M1 to the supply path 251*a* or 251*c*. The guide 390*ac* is a protrusion including faces 391 and 392 at an angle to the path direction. Small balls M1 brought into contact with the face 391 are guided to the supply path 251*a*, and small balls M1 brought into contact with the face 392 are guided to the supply path 251*c*.

As explained above, small balls M1 are preferentially supplied to a hopper (a game object utilizer) that is located upstream of the first path 310*ac*. Small balls M1 that do not enter any of the supply paths 231*a* and 231*c*, the supply paths 241*a* and 241*c*, and the supply paths 2511*a* and 251*c* on the first path 310*ac* fall from the end 322*ac* on the downstream of the second discrete path 320*ac*.

As shown in FIG. 12, the second path 340*ac* is a path that moves small balls M1 that have fallen from the first path 310*ac* without entering any of the supply paths on the first path 310*ac* to the first position P. The first position P1 is lower than the third position P3. Specifically, the second path 340*ac* moves small balls M1 that have fallen from the third position P3 to a fourth position P4 in a space between the first path 310*ac* and the second path 340*ac* to the first position P. The fourth position P4 is lower than the third position P3 and higher than the first position P1. The second path 340*ac* includes a slope descending from the fourth position P4 to the first position P1. Therefore, the small balls M1 that have fallen from the first path 310*ac* to the fourth position P4 move from the fourth position P4 to the first position P1 while rolling on the slope of the second path 340*ac*. That is, the second path 340*ac* is a path that brings the small balls M1 back to the first position P1. It is of note that the second path 340*ac* may be coupled to the first path 310*ac*. That is, the space between the first path 310*ac* and the second path 340*ac* and the sorter 260 may be omitted. In a configuration where the first path 310*ac* and the second path 340*ac* are coupled, the second path 340*ac* is a path that moves the small balls M1 from the third position P3 to the first position P1.

As shown in FIG. 12, an upstream end of the first path 310*ac* is located above a downstream end of the second path 340*ac* in a vertical direction. That is, the upstream end of the first path 310*ac* and the downstream end of the second path 340*ac* are close to each other in the horizontal position. Therefore, small balls M1 that have reached the downstream of the second path 340*ac* can be supplied to the first path 310*ac* by way of a simple configuration of transporting small balls M1 from a lower part to an upper part in a vertical direction. Further, a downstream end of the first path 310*ac* is located above an upstream end of the second path 340*ac* in a vertical direction. That is, the downstream end of the first path 310*ac* and the upstream end of the second path 340*ac* are close to each other in the horizontal position. Therefore, small balls M1 that have reached the downstream of the first path 310*ac* can be supplied to the second path 340*ac* by way of a simple configuration in which small balls M1 fall from the first path 310*ac*. Because the first path 310*ac* and the second path 340*ac* are slopes that allow small balls M to roll, respective directions of the paths are not limited to linear directions and any direction can be selected. Consequently, the downstream end of the first path 310*ac* and the upstream end of the second path 340*ac* can be easily connected in such a manner that the horizontal positions become close to each other.

The conveyor device 170*ac* of the first embodiment continues to be in a state (hereafter, "operation state") of transporting the small balls M1. Therefore, the small balls M1 are continuously supplied to each of the game object utilizers (for example, the first hopper, 230*a*, the second hopper 240*a*, or the third hopper 250*a*) of the circulating mechanism 20*ac*. That is, it is not that the conveyor device 170*ac* intermittently transports small balls M each time small balls M1 are required by each of the game object utilizers of the circulating mechanism 20*ac*, but rather the conveyor device 170*ac* continues to be operational regardless of whether small balls M1 are used by each of the game object utilizers. As described above, in the first embodiment the conveyor device 170*ac* remains operational when small balls M1 are transportable even when the game object utilizers of the circulating mechanism 20*ac* do not actually use any small balls M1. The conveyor device 170*ac* remains operational, for example, even when no player plays a game (regardless of a presence or absence of a player).

There can be assumed a configuration of supplying small balls M1 to a game object utilizer on the circulating mechanism 20*ac* in a limited case in which the game object utilizer needs small balls M1. However, in this configuration, it is necessary to detect whether there are small balls M1 in the game object utilizers, which gives rise to a problem in that the configuration of the game apparatus 10 becomes complex. The above problem is particularly serious in a configuration where many game object utilizers are mounted. According to the first embodiment, the operation state of the conveyor device 170*ac* continues as described above. As a result, an advantage is obtained in that there is no need for a configuration to detect whether there are small balls M1 in the game object utilizers, or to control the conveyor device 170*ac* in accordance with a result of the detection. Further, due to constant circulation of small balls M1 by the circulating mechanism 20*ac* even when a game is not actually being played, people in the vicinity of the game apparatus 10 are made aware that the apparatus is in operation. A visually dramatic effect is also promising.

Sorter 260

While the first path 310*ac* and the second path 340*ac* corresponding to the two stations 100*a* and 100*c* are illustrated in the above explanations, a first path 310*bd* and a second path 340*bd* that have substantially the same configurations are also provided for the pair of stations 100*b* and 100*d*. As shown in FIG. 12, the sorter 260 is placed at a point where small balls M1 falling from the downstream end of the first path 310*ac* and small balls M1 falling from a downstream end of the first path 310*bd* merge. The sorter 260 is placed in a space between the first paths 310*ac* and 310*bd*, and the second paths 340*ac* and 340*bd*. Because small balls M1 rolling on each of the first path 310*ac* and the first path 310*bd* fall from the paths in an accelerated state due to rolling, trajectories of falling (hereafter, "falling paths") of the small balls M1 form parabolas. The sorter 260 is installed at the intersection between the falling path from the first path 310*ac* and the falling path from the first path 310*bd*.

The sorter 260 sorts the small balls M1 falling from the first path 310*ac* and the small balls M1 falling from the first path 310*bd* into the second path 340*ac* of the circulating mechanism 20*ac* and the second path 340*bd* of the circulating mechanism 20*bd*. That is, the sorter 260 is shared by the circulating mechanism 20*ac* and the circulating mechanism 20*bd*.

The sorter 260 is a structure including a first face 261 facing the circulating mechanism 20*ac* and a second face 262 facing the circulating mechanism 20*bd*. The first face 261 and the second face 262 are flat surfaces or curved surfaces at an angle to the vertical direction. The first face 261 is a slope that allows small balls M1 brought into contact with the first face 261 to roll in a direction toward the second path 340*ac* of the circulating mechanism 20*ac*. The second face 262 is a slope that allows small balls M1 brought into contact with the second face 262 to roll in a direction toward the second path 340*bd* of the circulating mechanism 20*bd*. An apex 263 where the first face 261 and the second face 262 intersect is the highest part in the sorter 260.

The small balls M1 falling from the first path 310*ac* may differ in their speed depending on rolling states on the slope, or may differ in their falling trajectory due to collision between small balls M1. Therefore, the small balls M1 that fall from the first path 310*ac* are grouped into small balls M1 that have cleared the apex 263 and are brought into contact with the second face 262 across the apex 263 and small balls M1 that are brought into contact with the first face 261 without clearing the apex 263. Similarly, the small balls M1 that fall from the first path 310*bd* are grouped into small balls M1 that have cleared the apex 263 and are brought into contact with the first face 261 across the apex 263 and small balls M1 that are brought into contact with the second face 262 without clearing the apex 263. Collision occurs also between small balls M1 that fall from the first path 310*ac* and small balls M1 that fall from the first path 310*bd*. Small balls M that have a reduced speed due to collision are not able to clear the apex 263 and are brought into contact with the first face 261 or the second face 262.

As described above, small balls M1 that fall from the first path 310*ac* or 310*bd* are sorted by the sorter 260 into the second paths 340*ac* and 340*bd*. The probability of small balls M1 moving from the sorter 260 to the second path 340*ac* and the probability of small balls M1 moving therefrom to the second path 340*bd* are substantially equal. That is, small balls M1 that fall from the first path 310*ac* or 310*bd* are sorted into the second paths 340*ac* and 340*bd* substantially equally.

There is a case in which many small balls M1 are located in one of the circulating mechanisms 20*ac* and 20*bd*, for example, immediately after many small balls M1 are paid by the JP payout portion 150 to a specific game field 110. That is, the number of small balls M1 circulated by the circulating mechanism 20*ac* and the number of small balls M1 circulated by the circulating mechanism 20*bd* may greatly differ. In the first embodiment, small balls M1 that fall from the first path 310*ac* or 310*bd* are sorted by the sorter 260 into the second paths 340*ac* and 340*bd*, as described above. Further, because the conveyor devices 170*ac* and 170*bd* each maintain a state of operation and are thus capable of transporting small balls M1, small balls M1 continuously circulate in the circulating mechanism 20*ac* and the circulating mechanism 20*bd*, respectively. Therefore, even in a case in which the number of small balls M1 circulating in the circulating mechanism 20*ac* and the number of small balls M1 circulating in the circulating mechanism 20*bd* temporarily substantially differ from each other, over time these numbers can be equalized.

Figure 15:
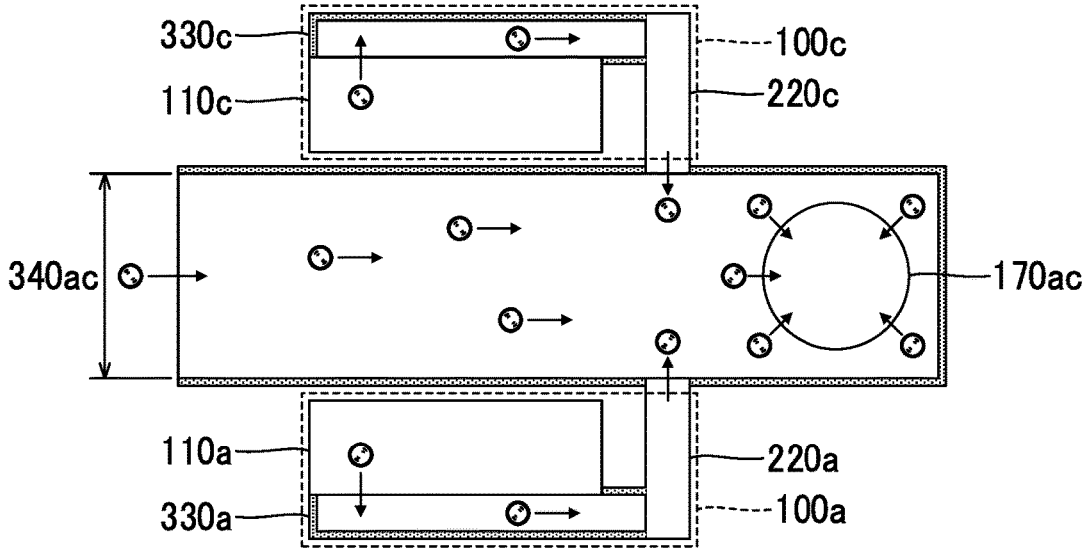
FIG. 15 is a plan view of a second path.

FIG. 15 is a plan view of the second path 340*ac*. The left side in FIG. 15 corresponds to the upstream side of the second path 340*ac* and the right side in FIG. 15 corresponds to the downstream side of the second path 340*ac*. The surface of the second path 340*ac* is a slope descending to the downstream from the upstream. The conveyor device 170*ac* is located downstream of the second path 340*ac*. Therefore, small balls M1 supplied to the second path 340*ac* roll toward the conveyor device 170*ac*. Small balls M1 sorted by the sorter 260 to the circulating mechanism 20*ac* move from the fourth position P4 that is an upstream end of the second path 340*ac* to the first position P1 that is a downstream end thereof, namely; the small balls M1 move to the conveyor device 170*ac*.

As shown in FIG. 12, the second hopper 240*a* and the third hopper 250*a* serving as the game object utilizers that feed small balls M1 to the game field 110*a* are positioned lower than the first path 310*ac* and higher than the first position P1. As shown in FIGS. 12 and 15, small balls M1 that fall from the forward edge 116 among the small balls M1 fed onto the game field 110*a* are supplied to the collection path 330*a*. On the collection path 330*a* a slope is formed that allows small balls M1 to roll. The small balls M1 supplied to the collection path 330*a* roll on the slope to enter the counter 220*a*. The small balls M1 counted by the counter 220*a* are supplied from the counter 220*a* to the second path 340*ac*. Small balls M1 that fall from the forward edge 116 of the game field 110*c* are also supplied to the counter 220*c* through the collection path 330*c*, and are supplied to the second path 340*ac* after being counted by the counter 220*c*. As will be understood from the above explanations, small balls M1 that have been used for games in the game fields 110*a* and 110*c* are collected by the second path 340*ac* by moving downward in the vertical direction (that is, by falling). According to the above configuration, an advantage is obtained in that no power source is required to collect the small balls M1 that have been used in the game fields 110*a* and 110*c*.

Small balls M1 that fall from the cutout 115L or 115R of the game fields 110*a* and 110*c* are also supplied to the second path 340*ac* in addition to the small balls M1 sorted by the sorter 260 and the small balls M1 discharged from the counters 220*a* and 220*c*. Small balls M1 used in the physical lottery portions (120*a*, 130*a*, 140*ab*, 120*c*, 130*c*, and 140*cd*) are also supplied to the second path 340*ac*.

As will be understood from the above explanations, the conveyor device 170*ac* of the first embodiment collects small balls M1 used by the first hopper 230*a* in a physical lottery (the first lottery, the second lottery, or the third lottery) and small balls M1 used by the second hopper 240*a* or the third hopper 250*a* in a game in the game field 110*a* and transports the collected small balls M1 to the upstream of the first path 310*ac*. That is, the small balls M1 used in a physical lottery and the small balls M1 used in a game are transported to the upstream of the first path 310*ac* and are reused.

Configuration of Conveyor Device 170*ac*

Figure 16:
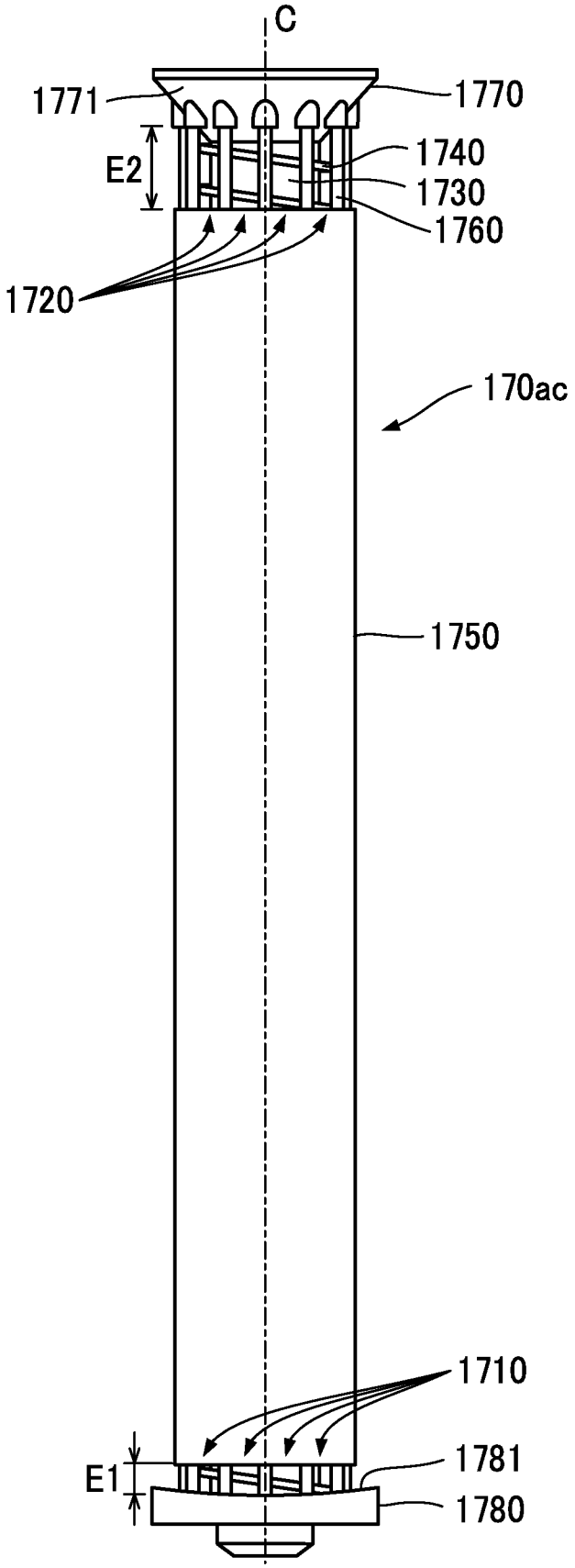
FIG. 16 is a side view of a conveyor device.

FIG. 16 shows a side view of the conveyor device 170*ac*. As shown in FIG. 16, the conveyor device 170*ac* of the first embodiment is an elongated columnar body oriented in a vertical direction and includes a rotating body 1730, a supporter 1740, an encircling member 1750, guides 1760, a holder 1770, and a supplier 1780. The holder 1770 constitutes the top end of the conveyor device 170*ac* and the supplier 1780 constitutes the bottom end of the conveyor device 170*ac*. The rotating body 1730, the supporter 1740, the encircling member 1750, and the guides 1760 are located between the holder 1770 and the supplier 1780. While there is assumed a case in which a rotation axis C of the conveyor device 170*ac* is parallel to the vertical direction in the first embodiment, the rotation axis C may be at an angle to the vertical direction. If the angle of the rotation axis C relative to the vertical direction is equal to or smaller than 30°, it can be said that the conveyor device 170*ac* is oriented in the vertical direction.

Figure 17:
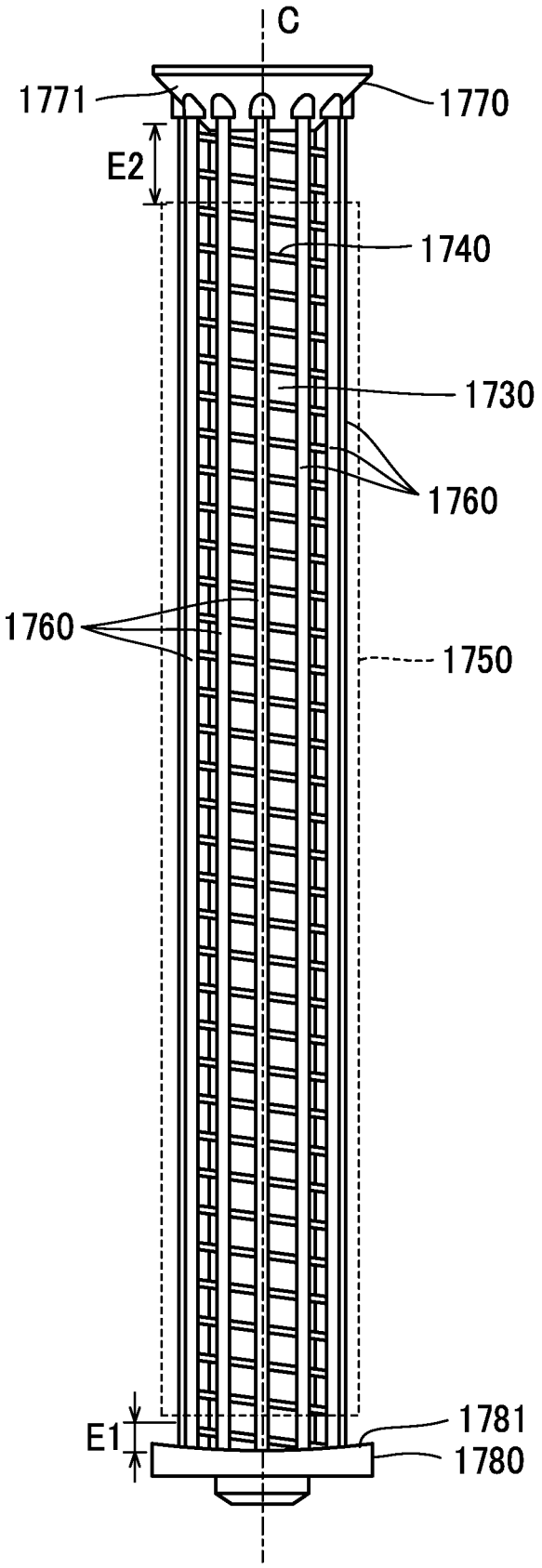
FIG. 17 is a side view of the conveyor device, in which view an encircling member is not shown.
Figure 18:
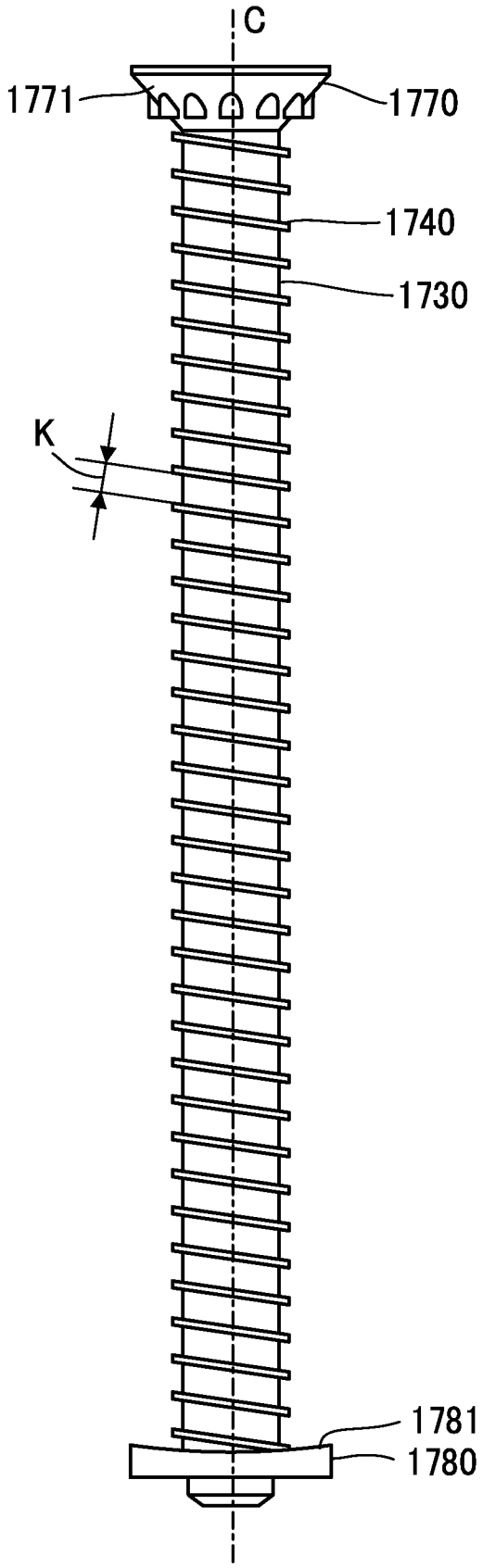
FIG. 18 is a side view of the conveyor device, in which view the encircling member and guides are not shown.

FIG. 17 is a side view of the conveyor device 170*ac* in which the encircling member 1750 is not shown. FIG. 18 is a side view of the conveyor device 170*ac* in which the encircling member 1750 and the guides 1760 are not shown.

The rotating body 1730 is a columnar member rotating about the rotation axis C and constitutes a central shaft of the conveyor device 170*ac*. The rotation axis C is a virtual axis parallel to the vertical direction. The rotating body 1730 rotates counterclockwise when viewed from above in a vertical direction. The rotating body 1730 of the first embodiment is rotatably pivoted on an axis between the holder 1770 and the supplier 1780. The operation state of the conveyor device 170*ac* described above is a state in which the rotating body 1730 is rotating about the rotation axis C.

The supporter 1740 is a helical member along the rotation axis C. Specifically, the supporter 1740 is configured to extend from a lower part to an upper part in the vertical direction in a clockwise helical manner when viewed from above in the vertical direction. The supporter 1740 of the first embodiment is placed on the outer circumferential surface of the rotating body 1730. Specifically, the inner circumferential surface of the supporter 1740 and the outer circumferential surface of the rotating body 1730 are joined, and thus the supporter 1740 rotates with the rotating body 1730 about the rotation axis C. The supporter 1740 can be reworded as a portion that protrudes from the outer circumferential surface of the rotating body 1730. As explained above, the conveyor device 170*ac* of the first embodiment is a screw lifter that transports small balls M1 with a helix.

It is of note that the supporter 1740 may be formed as a body separate from the rotating body 1730 to be fixed to the rotating body 1730; or may be formed as a single body integral with the rotating body 1730. Alternatively, the rotating body 1730 and the supporter 1740 may be constituted by coupling unit members each constituting a partial section in the direction of the rotation axis C (for example, a section corresponding to one cycle of the supporter 1740) of the rotating body 1730 and the supporter 1740 in the direction of the rotation axis C.

Figure 19:
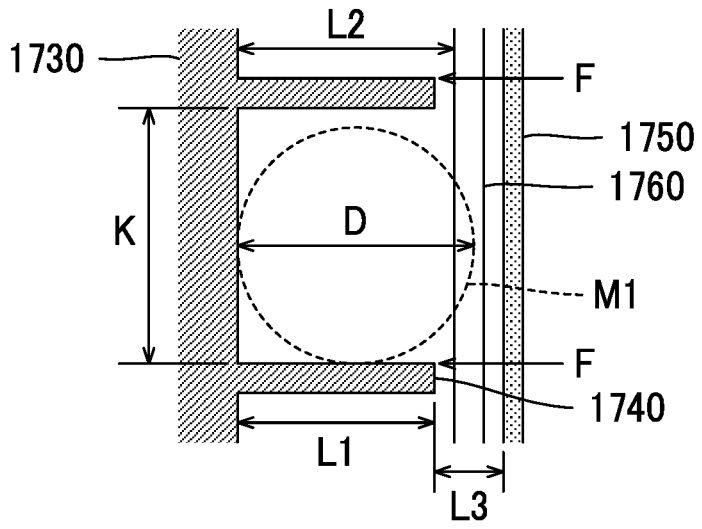
FIG. 19 is an enlarged sectional view of a part of the conveyor device.
Figure 20:
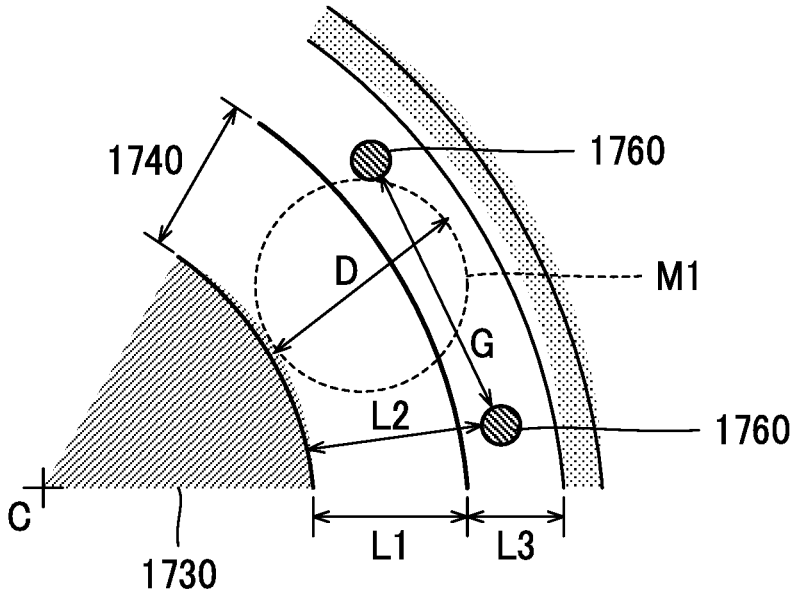
FIG. 20 is a sectional view of a part of the conveyor device along a plane perpendicular to a rotation axis.

FIG. 19 is a partially enlarged sectional view of the conveyor device 170*ac*. FIG. 20 is a sectional view of the conveyor device 170*ac* along a plane perpendicular to the rotation axis C. As shown in FIGS. 19 and 20, a small ball M1 is transported from a lower part to an upper part in the vertical direction in a state that it is placed on an upper face (hereafter, "mount face") F of the supporter 1740. The mount face F is a flat surface or a curved surface substantially perpendicular to the rotation axis C (that is, substantially parallel to the horizontal axis). An interval K in the helix of the supporter 1740 is larger than an outside diameter D of the small ball M1.

As shown in FIGS. 19 and 20, a width L1 of the mount face F is larger than a radius D/2 of the small ball M1 (L1>D/2). For example, the radius D/2 of the small ball M1 is about 8.5 millimeters while the width L1 of the mount face F is about 12 millimeters. Therefore, the center of mass (the center) of the small ball M1 can be positioned on the mount face F. It is of note that the width L1 of the mount face F is the distance between the inner periphery and the outer periphery of the supporter 1740 and is rephrased as the height of the supporter 1740 from the outer circumferential surface of the rotating body 1730. By the above configuration in which the width L1 of the mount face F is larger than the radius D/2 of the small ball M1, the possibility of the small ball M1 falling from the mount face F can be reduced.

Each of the guides 1760 is a rod-like member mounted on an outer side of the supporter 1740 (on the opposite side across the supporter 1740 from the rotation axis C) and extending along the rotation axis C. Circular or rectangular cylinder members, for example, are suitable for use as the guides 1760. The guides 1760 face the outer circumferential surface of the rotating body 1730 across the supporter 1740. The top end of each of the guides 1760 is fixed to the holder 1770 and the bottom end of each of the guides 1760 is fixed to the supplier 1780. The guides 1760 are placed apart from the rotating body 1730, and thus do not rotate regardless of rotation of the rotating body 1730. While a configuration in which 12 guides 1760 are mounted is shown as an example in the first embodiment, the number of the guides 1760 can be freely selected.

The guides 1760 are arranged at intervals G along the entire periphery in the circumferential direction about the rotation axis C. That is, a total number of gaps corresponding to the number of the guides 1760 is formed around the supporter 1740. The interval G between two guides 1760 adjacent to each other is larger than the outer diameter (the diameter) D of the small ball M1. Therefore, the small ball M1 can pass through the gap between two guides 1760.

As shown in FIGS. 19 and 20, an interval L2 between the outer circumferential surface of the rotating body 1730 (the inner periphery of the supporter 1740) and each of the guides 1760 is smaller than the outside diameter D of the small ball M1 (L2<D). For example, the outside diameter D of the small ball M1 is about 17 millimeters and the interval L2 is about 14 millimeters. It is of note that the interval G between two guides 1760 adjacent to each other is smaller than two outside diameters D of the small ball M1 (G<2D) in the first embodiment. Therefore, one small ball M1 can be located in the interval G of two guides 1760.

The encircling member 1750 is a member located on the opposite side across the guides 1760 relative to the supporter 1740. The encircling member 1750 of the first embodiment encircles the rotating body 1730, the supporter 1740, and the guides 1760. Specifically, a cylindrical member that has the rotation axis C as a central axis is used as the encircling member 1750. The guides 1760 are placed in a space between the outer circumferential surface of the rotating body 1730 and the inner circumferential surface of the encircling member 1750. It is of note that the guides 1760 may be or may not be in contact with the inner circumferential surface of the encircling member 1750. The encircling member 1750 is placed separately from the rotating body 1730. Therefore, the encircling member 1750 does not rotate even when the rotating body 1730 rotates.

As shown in FIGS. 19 and 20, an interval L3 between the outer periphery of the supporter 1740 and the inner periphery of the encircling member 1750 is smaller than the outside diameter D of the small ball M1 (L3<D). For example, the outside diameter D of the small ball M1 is about 17 millimeters and the interval L3 is 9 millimeters. According to the above configuration, even when the small ball M1 moves in the radial direction of the rotation axis C on the mount face F, the small ball M1 is brought into contact with the inner circumferential surface of the encircling member 1750 before falling from the mount face F. Therefore, the small ball M1 can be prevented from falling from the supporter 1740 in a region encircled by the encircling member 1750.

In a state in FIG. 19 where a small ball M1 is placed on the mount face F in contact with the outer circumferential surface of the rotating body 1730, an interval (hereafter, "circumference interval") between the small ball M1 and the inner circumferential surface of the encircling member 1750 is about 4 millimeters (L1+L3−D). When an appropriate circumference interval is established, a possibility is reduced of collision of small balls M1 against the lower end face of the encircling member 1750 when taking in small balls M1 from the intake ports 1710. The circumference interval is desirably within a range not smaller than 1 millimeter and not larger than the radius D/2 of the small ball M1 and, in a more preferable mode, is set to an appropriate dimension within a range not smaller than 2 millimeters and not larger than a half (D/4) of the radius D/2 of the small ball M1. In a configuration where the circumference interval is large, more small balls M1 are transported while being in contact with the inner circumferential surface of the encircling member 1750 on the mount face F. Although small balls M1 can be transported even if the small balls M1 are in contact with the inner circumferential surface of the encircling member 1750, a possibility of scratches occurring over time on the inner circumferential surface of the encircling member 1750 due to contact of the small balls M1 is increased. According to the configuration in which an appropriate circumference interval is ensured, contact of the small balls M1 with the inner circumferential surface of the encircling member 1750 is reduced and thus an advantage is obtained in that scratches on the inner circumferential surface caused by the contact can be prevented.

The shape of the encircling member 1750 is not limited to a cylindrical shape having an inner circumferential surface. For example, the encircling member 1750 can be constituted by rod-like members placed on the opposite side across the rotation axis C relative to the guides 1760. Each of the rod-like members is a member extending along the rotation axis C and is located between two guides 1760 adjacent to each other when viewed from the rotation axis C. A virtual inner circumferential surface is formed from the rod-like members and small balls M1 are brought into contact with the inner circumferential surface, whereby the small balls M1 is prevented from falling.

A part or the whole of the encircling member 1750 in the circumferential direction or the vertical direction is formed, for example, from a light transmissive material. For example, the encircling member 1750 is formed from a transparent resin material. According to a configuration in which the encircling member 1750 is formed from a light transmissive material or a configuration in which the encircling member 1750 is formed from rod-like members as illustrated above, players or persons in the vicinity are able to view how the conveyor device 170*ac* transports many small balls M1. Therefore, an effect of dynamic presentation using the small balls M1 is also promising. Visual entertainment can also be provided to players. According to the configuration in which an appropriate circumference interval is ensured, scratches on the inner circumferential surface of the encircling member 1750 can be prevented as described above. Therefore, in the configuration where the encircling member 1750 is formed from a light transmissive material, it is possible to suppress aging reduction of the effect described above that the manner of transport of many small balls M1 can be viewed from outside. However, light transmissivity of the encircling member 1750 is not essential.

The entire length of the encircling member 1750 is shorter than the entire length of the guide 1760. As shown in FIGS. 16 and 17, a part (hereafter, "first end part") E1 of each of the guides 1760 on the lower side in the vertical direction is exposed downward in the vertical direction from the lower end face of the encircling member 1750. The entire length of the first end part E1 is larger than the outside diameter D of the small ball M1. Meanwhile, a part (hereafter, "second end part") E2 of each of the guides 1760 on the upper side in the vertical direction is exposed upward in the vertical direction from the upper end face of the encircling member 1750. The entire length of the second end part E2 is larger than the outside diameter D of the small ball M1. A part of each of the guides 1760 between the first end part E1 and the second end part E2 faces the inner circumferential surface of the encircling member 1750.

A gap between the first end parts E1 of two guides 1760 adjacent in the circumferential direction of the rotation axis C functions as the intake port 1710 for taking a small ball M1 into the conveyor device 170*ac*. The intake port 1710 of the first embodiment is a space surrounded by the lower end face of the encircling member 1750, a supply surface 1781 being the surface of the supplier 1780, and the two first end parts E1 adjacent to each other. Small balls M1 supplied to the conveyor device 170*ac* pass through the intake ports 1710 and are placed on the mount face F of the supporter 1740.

As described above, the guides 1760 are arranged in the circumferential direction of the rotation axis C with the interval G spaced from each other. Therefore, a number (for example, 12) of the intake ports 1710 corresponding to the number of the guides 1760 are formed on the bottom end of the conveyor device 170*ac* along the circumferential direction of the rotation axis C. That is, small balls M1 supplied around the bottom end of the conveyor device 170*ac* are sequentially taken in from the intake ports 1710 along with rotation of the supporter 1740. As explained above, according to the first embodiment, small balls M1 can be taken in the conveyor device 170*ac* by use of a relatively simple configuration in which the first end parts E1 of the guides 1760 are not covered by the encircling member 1750.

A gap between the second end parts E2 of two guides 1760 adjacent in the circumferential direction of the rotation axis C functions as the discharge port 1720 for discharging a small ball M1 from the conveyor device 170*ac*. The discharge port 1720 of the first embodiment is a space surrounded by the upper end face of the encircling member 1750, a surface (a slope 1771 described later) of the holder 1770, and two second end parts E2 adjacent to each other. A small ball M1 transported by the conveyor device 170*ac* passes through the discharge ports 1720 and is discharged from the conveyor device 170*ac* to outside.

As described above, the guides 1760 are arranged in the circumferential direction of the rotation axis C with the interval G spaced from each other. Therefore, a number (for example, 12) of the discharge ports 1720 corresponding to the number of the guides 1760 are formed at the top end of the conveyor device 170*ac* along the circumferential direction of the rotation axis C. Accordingly, small balls M1 transported by the conveyor device 170*ac* are discharged radially from the discharge ports 1720. As explained above, according to the first embodiment, small balls M1 can be discharged from the conveyor device 170*ac* with a quite simple configuration in which the second end parts E2 of the guides 1760 are not covered by the encircling member 1750.

In the above configuration, the helical supporter 1740 rotates in a state where small balls M that have passed through the intake ports 1710 are brought into contact with the outer circumferential surface of the rotating body 1730 and are placed on the mount faces F. Circumferential movement of the small balls M1 on the mount faces F is restricted by contact of the small balls M1 with the guides 1760. That is, a small ball M1 housed in a gap between specific two guides 1760 is not able to pass through another adjacent gap in the circumferential direction of the rotation axis C. Therefore, a small ball M1 is transported while being in contact at three positions including the outer circumferential surface of the rotating body 1730, the mount face F, and one guide 1760, from the lower side to the upper side in the vertical direction along the guide 1760. That is, the small ball M is supported at three points including a contact point with the outer circumferential surface of the rotating body 1730, a contact point with the mount face F, and a contact point with the guide 1760. The small ball M1 supported by the supporter 1740 in the above state is transported to the upper side in the vertical direction while being urged against one guide 1760.

Movement of the small balls M1 in a direction away from the rotation axis C is restricted by contact of the small balls M1 with the inner circumferential surface of the encircling member 1750. Therefore, a small ball M1 may be transported while being in contact at three positions including the mount face F of the supporter 1740, the surface of the guide 1760, and the inner circumferential surface of the encircling member 1750. That is, according to the first embodiment, the small balls M1 can be reliably transported while the possibility of the small balls M1 falling from the supporter 1740 is reduced.

As will be understood from the above explanations, a transport path for moving a small ball M1 from the lower side to the upper side in the vertical direction is formed for each of the guides 1760 in the conveyor device 170*ac* of the first embodiment. That is, plural (12) transport paths each for transporting a small ball M1 from an intake port 1710 to a discharge port 1720 are formed. Each of the transport paths is an elongated space extending in the direction of the rotation axis C at a place among one of the outer circumferential surface of the rotating body 1730, the inner circumferential surface of the encircling member 1750, and two guides 1760 adjacent in the circumferential direction. By use of the above configuration, many small balls M supplied to the supplier 1780 can be efficiently transported in parallel by the transport paths.

Figure 21:
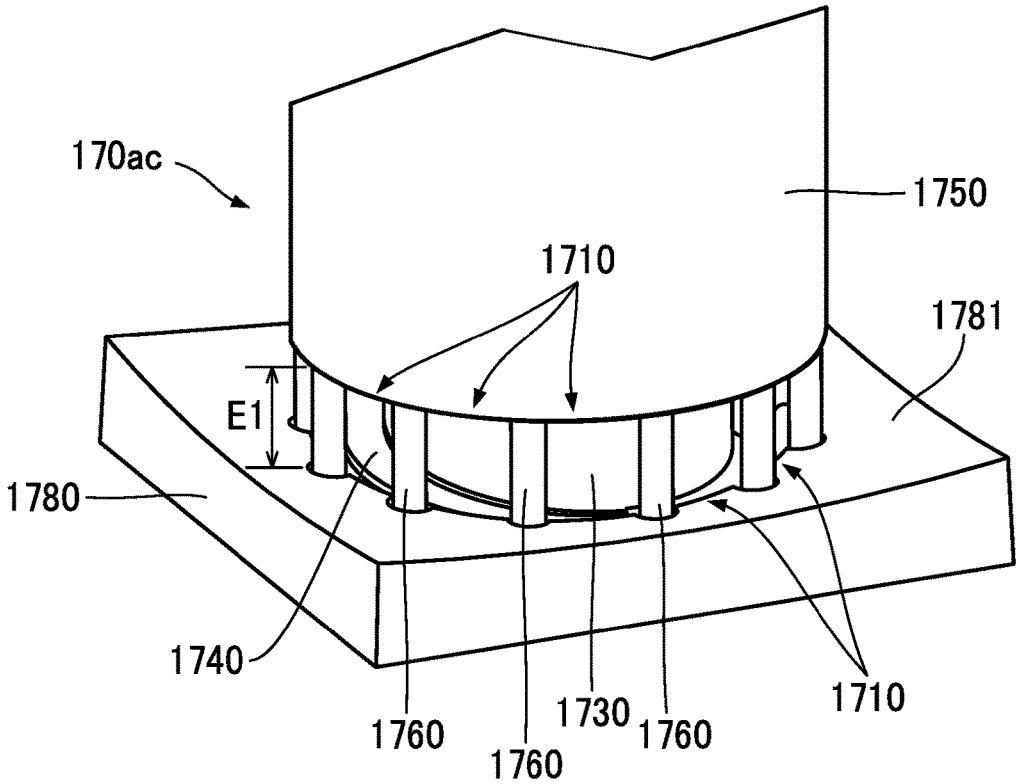
FIG. 21 is a perspective view illustrating in enlargement a part of the conveyor device near intake ports.
Figure 22:
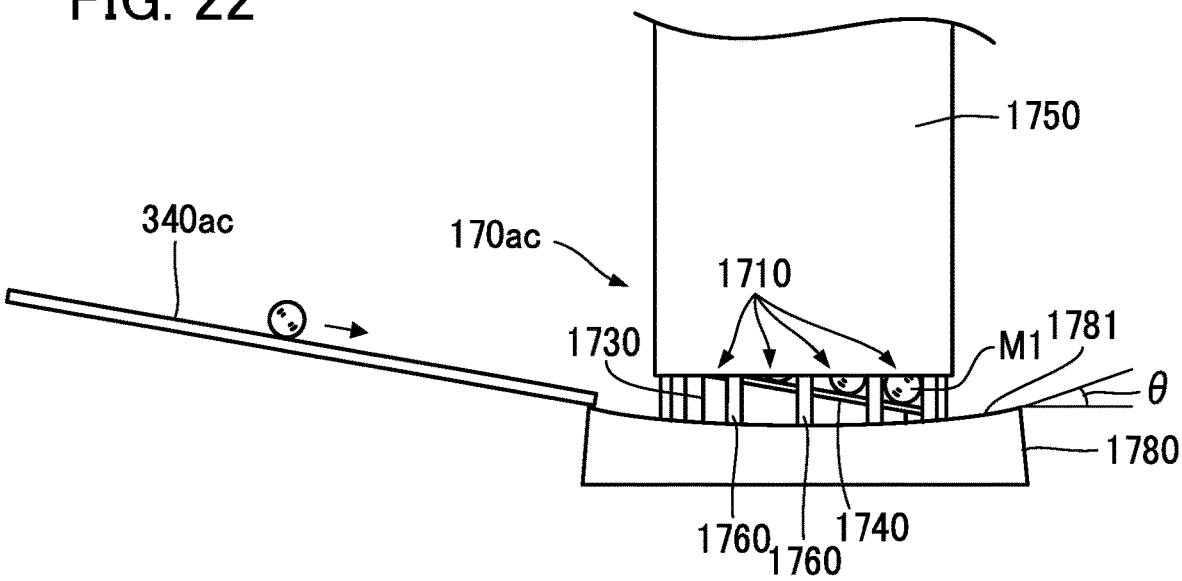
FIG. 22 is a schematic diagram illustrating relations among the intake ports of the conveyor device and the second path.

FIG. 21 is a perspective view illustrating a part of the conveyor device 170*ac* near the intake ports 1710 in an enlarged manner. FIG. 22 is a schematic diagram illustrating a relation among the intake ports 1710 of the conveyor device 170*ac* and the second path 340*ac*.

As shown in FIGS. 21 and 22, small balls M1 that have moved on the second path 340*ac* are supplied to the supplier 1780. The supplier 1780 is a member constituting the bottom end of the conveyor device 170*ac*. A top surface (hereafter, "supply surface") 1781 of the supplier 1780 is a slope that allows small balls M1 supplied from the second path 340*ac* to roll toward the intake ports 1710. The supply surface 1781 is a flat surface or a curved surface, and is lower at a position nearer the intake ports 1710. As explained above, because the supply surface 1781 that allows small balls M to roll toward the intake ports 1710 is formed on the supplier 1780 of the first embodiment, many small balls M1 can be efficiently taken in the transport paths.

Figure 23:
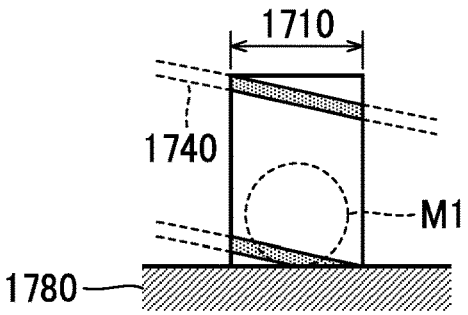
FIG. 23 is an explanatory diagram of a relation between an intake port and an outer periphery of a supporter.
Figure 24:
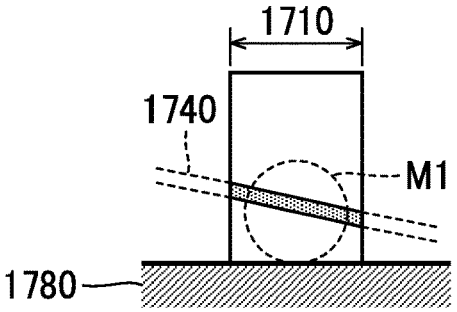
FIG. 24 is an explanatory diagram of a relation between the intake port and the outer periphery of the supporter.

FIGS. 23 and 24 are explanatory diagrams of a relation between a freely-selected intake port 1710 and the outer periphery of the supporter 1740. As shown in FIGS. 23 and 24, the positional relation of the outer periphery of the supporter 1740 with respect to the intake port 1710 changes with time in conjunction with rotation of the supporter 1740.

As shown in FIG. 23, in a state where the outer periphery of the supporter 1740 is near the bottom of the intake port 1710, a small ball M1 passes through the intake port 1710 to be taken in the transport path. On the other hand, in a state where the outer periphery of the supporter 1740 is located at a position higher than the bottom of the intake port 1710, a small ball M approaching the intake port 1710 comes into contact with the outer periphery as shown in FIG. 24. That is, entry of the small ball M1 into the intake port 1710 is blocked by the supporter 1740. When the supporter 1740 further rotates to change the outer periphery of the supporter 1740 to a position lower than the bottom of the intake port 1710 (FIG. 23), the small ball M1 that have waited outside the intake port 1710 enters the intake port 1710 to be taken in the transport path.

As explained above, a small ball M1 that has arrived at an intake port 1710 on the supply surface 1781 of the supplier 1780 does not enter the intake port 1710 immediately upon arrival, but enters the intake port 1710 at a stage when the outer periphery of the supporter 1740 moves to a position near the bottom of the intake port 1710. That is, the small ball M1 temporarily waits outside the intake port 1710. As will be understood from the above explanations, the supplier 1780 of the first embodiment functions as a reserver that temporarily reserves small balls M1 that are traveling toward the conveyor device 170*ac*.

Because the supporter 1740 continuously rotates, there is a possibility that a small ball M1 upon entering one of the intake ports 1710 will be flicked out due to collision with the outer periphery of the supporter 1740. That is, a case is assumed in which a small ball M1 is not taken into an intake port 1710 even in a state where the outer periphery of the supporter 1740 is near the bottom of the intake port 1710. As described above, small balls M1 moving toward the conveyor device 170*ac* are temporarily reserved in the supplier 1780 of the first embodiment. By the above configuration, a small ball M1 that is entering an intake port 1710 is urged by the small balls M1 reserved in the supplier 1780 toward the intake port 1710. Therefore, a possibility is reduced that a small ball M1 will be flicked out due to collision with the outer periphery of the supporter 1740. That is, according to the first embodiment, there is no need for a complicated mechanism to suppress small balls M1 from being flicked out due to collision with the outer periphery of the supporter 1740, and thus an advantage is obtained in that the configuration of the intake ports 1710 can be simplified.

As will be understood from FIG. 22, small balls M1 are sequentially supplied to each of the intake ports 1710 of the conveyor device 170*ac* from a direction (a lateral direction) close to the horizontal direction. Therefore, even when many small balls M1 are supplied to the supplier 1780, the possibility of small balls M1 being stacked in a vertical direction is minimized. In a configuration in which many small balls M1 are stacked, a phenomenon (hereafter, "bridge phenomenon") may occur in which mutual forces of small balls M1 remain in equilibrium in a state where small balls M1 are in contact with each other on a path leading to the intake ports 1710, as a consequence of which movement of the small balls M1 stops. When the bridge phenomenon occurs, intake of small balls M1 into the intake ports 1710 is hindered. According to the first embodiment, the possibility of small balls M1 being stacked in the vertical direction is reduced, and therefore a possible occurrence of the bridge phenomenon is likewise reduced. That is, many small balls M1 can be efficiently taken into the transport paths. Particularly in the first embodiment, the intake ports 1710 are formed in the circumferential direction of the rotation axis C and thus, even if the bridge phenomenon occurs near some of the intake ports 1710, small balls M1 are taken from other intake ports 1710. Therefore, defects caused by the bridge phenomenon in transporting small balls M1 can be prevented.

To reduce the possibility of stacking of small balls M1 supplied to the supplier 1780, a configuration is preferable in which the slope angle of the supply surface 1781 is shallow. Specifically, as shown in FIG. 22, a maximum angle θ of the supply surface 1781 with respect to the horizontal plane is set to, for example, 20° or lower (more preferably 10° or lower). According to the above configuration, the possibility of stacking of small balls M1 on the supply surface 1781 is reduced. Therefore, occurrence of the bridge phenomenon near each of the intake ports 1710 (that is, clogging of small balls M1) can be effectively suppressed.

As shown in FIGS. 21 and 22, the supply surface 1781 of the first embodiment is a curved surface around the rotation axis C. Specifically, a surface (an arc surface) of a sphere that has the center on the rotation axis C is preferable as the supply surface 1781. According to the above configuration, small balls M1 are supplied to the intake ports 1710 from all directions around the rotation axis C. Therefore, a notable significant effect is realized whereby many small balls M1 can be efficiently supplied to the transport paths.

Figure 25:
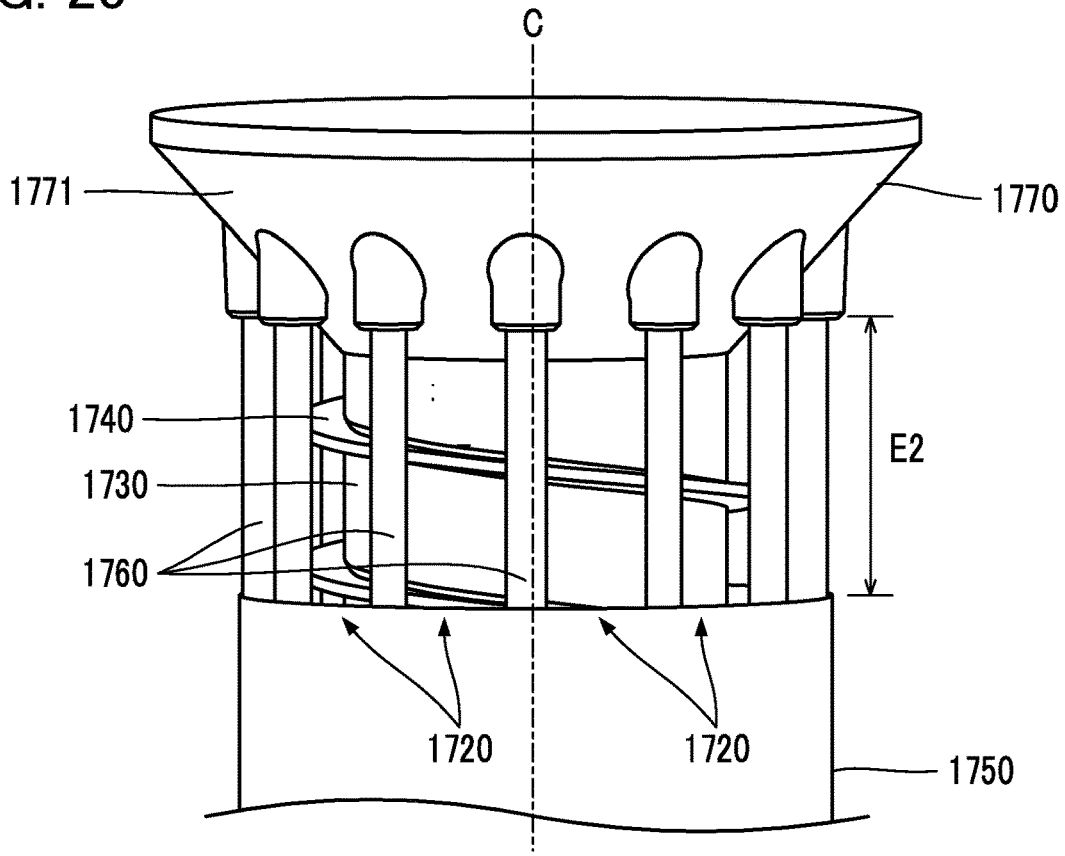
FIG. 25 is a perspective view illustrating in enlargement a part of the conveyor device near discharge ports.

FIG. 25 is a perspective view illustrating in enlargement a part of the conveyor device 170*ac* near the discharge ports 1720. As shown in FIG. 25, the holder 1770 of the first embodiment is a member in the shape of a truncated cone including the slope 1771 at an angle to the rotation axis C. Small balls M1 transported in the direction of the rotation axis C change the direction of travel to directions intersecting with the rotation axis C due to contact with the slope 1771. The small balls M1 that have their directions changed due to the contact with the slope 1771 pass through the discharge ports 1720 and are discharged from the transport paths. That is, as described with reference to FIG. 13, small balls M1 transported by the conveyor device 170*ac* are radially discharged from the discharge ports 1720. As will be understood from the above explanations, the holder 1770 (particularly the slope 1771) functions as a discharge guide that moves small balls M1 transported by the transport paths in directions away from the rotation axis C. Therefore, a possibility of small balls M1 remaining on the transport paths for longer than necessary is reduced.

Figure 27:
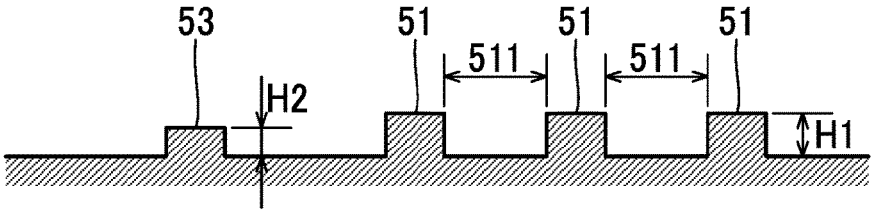
FIG. 27 is a sectional view along a line B-B in FIG. 26.

FIG. 26 is a plan view of a part near the supplier 1780 viewed from above in a vertical direction. FIG. 27 is a sectional view along a line B-B in FIG. 26. As shown in FIG. 26, an X axis along the second path 340*ac* and a Y axis orthogonal to the X axis are assumed. Upstream of the second path 340*ac* as viewed from a given point in the X axis is referred to as the "X1 direction," and downstream of the second path 340*ac* is referred to as the "X2 direction." The conveyor device 170*ac* is located in the X2 direction as viewed from the second path 340*ac*. One side in the Y axis is referred to as the "Y1 direction," and the other side is referred to as the "Y2 direction." The station 100*a* is located in the Y direction as viewed from the conveyor device 170*ac*, and the station 100*c* is located in the Y2 direction as viewed from the conveyor device 170*ac*.

As shown in FIG. 26, first guides 51, a second guide 52, and a third guide 53 are provided near the supplier 1780. In FIG. 26, for convenience, the first guides 51, the second guide 52, and the third guide 53 are shaded.

First Guides 51

As shown in FIG. 26, the first guides 51 are formed on the supply surface 1781 of the supplier 1780. The first guides 51 are structures for guiding small balls M1 to the intake ports 1710. According to the above configuration, small balls M1 can be efficiently supplied to the intake ports 1710.

Each of the first guides 51 of the first embodiment is a protrusion extending from the supply surface 1781. As shown in FIG. 27, a height H1 of each of the first guides 51 is smaller than the outside diameter D of the small ball M1. Two first guides 51 adjacent to each other function as a guide path 511 for guiding small balls M1 to the corresponding intake port 1710. It is of note that the first guides 51 as bodies separate from the supplier 1780 can be fixed to the supply surface 1781; or the first guides 51 can be formed as a single body integral with the supplier 1780.

The width of each of the guide paths 511 formed by the first guides 51 is larger than the outside diameter D of the small ball M1 and is less than twice as large as the outside diameter D. Therefore, small balls M1 are arrayed in a line along each guide path 511 to the corresponding intake port 1710. As will be understood from the above explanations, the first guides 51 of the first embodiment guide small balls M1 such that the small balls M1 are arrayed toward the intake ports 1710. Therefore, the possibility of the bridge phenomenon caused by a concentration of small balls M1 can be reduced.

The first guides 51 of the first embodiment are arranged in the X2 direction (that is, downstream of the second path 340*ac*) as viewed from the conveyor device 170*ac*. That is, the first guides 51 array small balls M1 from the second path 340*ac* that have reached an area in the X2 direction of the conveyor device 170*ac* such that the small balls M are arranged toward some intake ports 1710 that are in the X2 direction from among the intake ports 1710.

Second Guide 52

As shown in FIG. 26, the second guide 52 is mounted on the second path 340*ac*. The second guide 52 is a structure for guiding small balls M1 traveling from the second path 340*ac* to the supplier 1780 toward a lateral side of the conveyor device 170*ac*. The lateral side of the conveyor device 170*ac* is in the Y1 direction or in the Y2 direction as viewed from the conveyor device 170*ac*. According to the above configuration, small balls M1 can be preferentially supplied to intake ports 1710 located between the lateral sides and the back side (that is, the opposite side from the second path 340*ac*) among the intake ports 1710 of the conveyor device 170*ac*. As will be understood from the above explanations, the second guide 52 functions as a regulator that regulates movement of small balls M1 supplied from the second path 340*ac* to the supplier 1780.

The second guide 52 is mounted in the X1 direction (that is, in the direction of the second path 340*ac*) as viewed from the conveyor device 170*ac*. That is, the second guide 52 is mounted on the opposite side from the conveyor device 170*ac* relative to the first guides 51. The second guide 52 is located substantially at the widthwise center line of the second path 340*ac*. It is of note that the second guide 52 as a body separate from the second path 340*ac* can be fixed to the second path 340*ac*; or the second guide 52 can be formed as a single body integral with the second path 340*ac*. Further, the second guide 52 may be placed on the supplier 1780.

As shown in FIG. 26, the second guide 52 of the first embodiment includes slopes 521 and 522 at an angle to the X direction. The slopes 521 and 522 are flat surfaces or curved surfaces. The slope 521 is a Y1 side surface of the second guide 52, and the slope 522 is a Y2 side surface of the second guide 52. The heights of the slopes 521 and 522 are larger than the outside diameter D of the small balls M1. Therefore, the small balls M1 cannot pass over the second guide 52.

A small ball M1 that has moved on the second path 340*ac* and brought into contact with the slope 521 is guided to the Y1 direction as viewed from the conveyor device 170*ac*. A small ball M1 brought into contact with the slope 522 is guided to the Y2 direction as viewed from the conveyor device 170*ac*. That is, the second guide 52 distributes small balls M1 that have moved on the second path 340*ac* to the Y1 side and the Y2 side of the conveyor device 170*ac*. That is, small balls M1 do not directly move to intake ports 1710 that are on the second path 340*ac* side (the X1 side) among the intake ports 1710 of the conveyor device 170*ac*. As will be understood from the above explanations, the second guide 52 guides small balls M1 moving toward the supplier 1780 to move toward intake ports 1710 on the opposite side (the X2 side) of the second path 340*ac* without moving toward intake ports 1710 on the second path 340*ac* side (the X1 side) among the intake ports 1710 of the conveyor device 170*ac*.

In a configuration in which the second guide 52 is not mounted, many small balls M1 are likely to be supplied to intake ports 1710 on the second path 340*ac* side among the intake ports 1710 of the conveyor device 170*ac*. In the first embodiment, the second guide 52 guides small balls M1 to move toward intake ports 1710 on the X2 side without directly moving toward intake ports 1710 on the X1 side among the intake ports 1710. Therefore, a possibility of many small balls M1 being concentrated at the intake ports 1710 on the X1 side can be reduced.

Third Guide 53

As shown in FIG. 26, the third guide 53 is mounted on the second path 340*ac*. The third guide 53 is a structure that guides small balls M1 moving on the second path 340*ac* to the opposite side of the conveyor device 170*ac* to the second path 340*ac* (that is, the X2 side). According to the above configuration, small balls M1 can be preferentially supplied to intake ports 1710 located between the lateral sides and the back side (that is, on the opposite side from the second path 340*ac*) among the intake ports 1710 of the conveyor device 170*ac*. As will be understood from the above explanations, the third guide 53 functions as a regulator that regulates movement of small balls M1 supplied from the second path 340*ac* to the supplier 1780.

The third guide 53 of the first embodiment is a protrusion protruding from the slope of the second path 340*ac*. As shown in FIG. 27, a height H2 of the third guide 53 is lower than the height H1 of the first guide 51 and the height of the second guide 52. The height H2 of the third guide 53 is lower than the outside diameter D of the small balls M1. Therefore, the small balls M1 can pass over the third guide 53. Specifically, in a state where one small ball M1 moves alone on the second path 340*ac*, the small ball M1 cannot pass over the third guide 53. However, in a state where many small balls M1 are on the second path 340*ac*, a small ball M1 may pass over the third guide 53 by being pushed by other small balls M1. The third guide 53 being a separate body from the second path 340*ac* may be fixed to the second path 340*ac* or the third guide 53 may be formed as a single body integral with the second path 340*ac*. Further, the third guide 53 may be mounted on the supplier 1780.

As shown in FIG. 26, the third guide 53 of the first embodiment is configured to include angled parts 531 and 532 and straight parts 533 and 534. Each of the elements constituting the third guide 53 is a protrusion extending linearly in a planar view. The angled parts 531 and 532 are parts extending in a direction at an angle to the X direction and intersect with each other at a point in the X1 direction as viewed from the conveyor device 170*ac*. The straight parts 533 and 534 are linear parts extending in the X direction. The straight part 533 is continuous with an end of the angled part 531 on the opposite side from the angled part 532 (an X2 side end). The straight part 534 is continuous with an end of the angled part 532 on the opposite side from the angled part 531 (an X2 side end).

A small ball M1 brought into contact with the angled part 531 on the second path 340*ac* is guided toward the Y1 side along the angled part 531 and moves in the X direction along the straight part 533 located at the subsequent stage. Similarly, a small ball M1 brought into contact with the angled part 532 is guided toward the Y2 side along the angled part 532 and moves in the X direction along the straight part 534 located at the subsequent stage. That is, the third guide 53 diverges small balls M1 in two lines to bypass the conveyor device 170*ac* and the second guide 52, to guide the small balls M1 to the X2 side of the conveyor device 170*ac* as indicated by solid arrows in FIG. 26. Small balls M1 guided by the third guide 53 are arrayed by the first guides 51 and then are supplied to intake ports 1710 on the X2 side of the conveyor device 170*ac*. That is, small balls M1 are supplied preferentially to intake ports 1710 on the X2 side among the intake ports 1710.

As explained above, the small balls M1 are guided by the third guide 53 usually to the X2 side of the conveyor device 170*ac*. However, in a state where there are many small balls M1 on the second path 340*ac*, some small balls M1 may pass over the third guide 53 by being pushed by other small balls M1 as indicated by broken arrows in FIG. 26. The small balls M1 that have moved over the third guide 53 are supplied to intake ports 1710 on the X1 side (the side of the second path 340*ac*) among the intake ports 1710.

In the configuration in which small balls M1 are supplied preferentially to intake ports 1710 on the X2 side among the intake ports 1710, there is a possibility that many small balls M1 may excessively concentrate at the X2 side of the conveyor device 170*ac*. If many small balls M1 are concentrated at a specific intake port 1710, a problem arises in that the bridge phenomenon is likely to occur. In the first embodiment, in a state that many small balls M1 are concentrated at the X2 side of the conveyor device 170*ac*, small balls M1 that have moved over the third guide 53 by being pushed by other small balls M1 are supplied to intake ports 1710 on the second path 340*ac* side (the X1 side). Therefore, excessive concentration of many small balls M1 can be suppressed.

Game Object Housing Space 46

Figure 28:
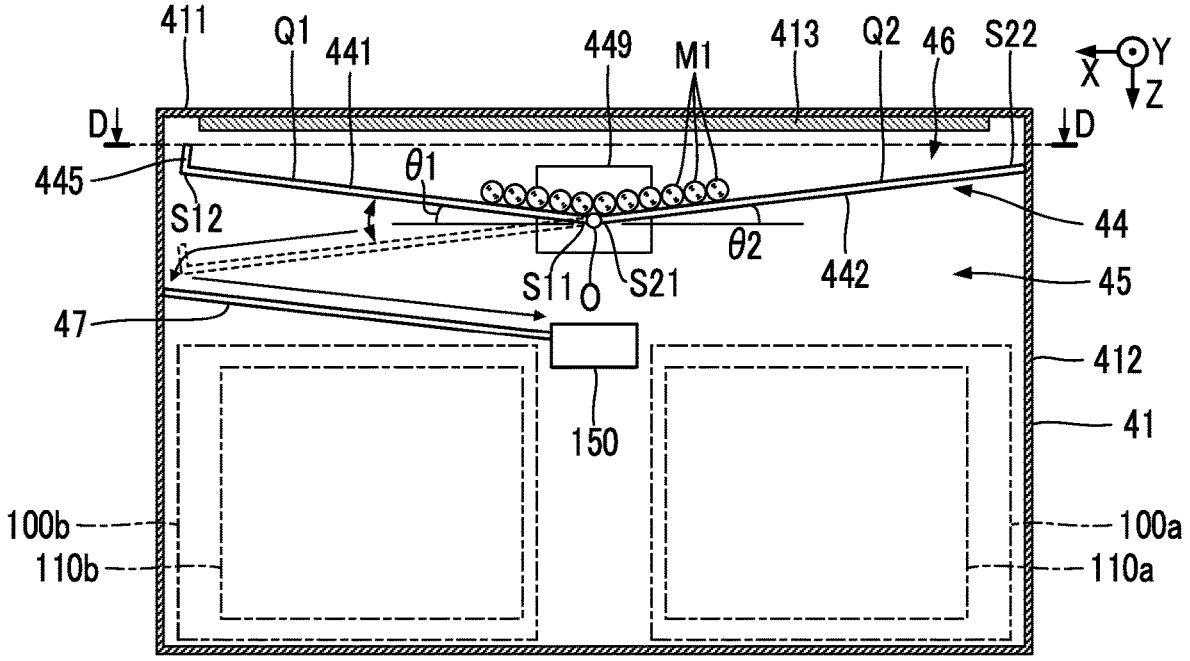
FIG. 28 is a sectional view of the game apparatus focusing on a game object housing space.

FIG. 28 is a sectional view of the game apparatus 10 focusing on the game object housing space 46. A cross section along a line C-C in FIG. 2 is shown in FIG. 28. The game object housing space 46 is a space that houses small balls M1 to be discharged from the JP payout portion 150 to any of the four game fields 110 (110*a*, 110*b*, 110*c*, and 110*d*) as described above.

As shown in FIG. 28, the game apparatus 10 of the first embodiment includes a hollow housing 41 in the shape of a cuboid. The housing 41 includes a top surface portion 411 and a side surface portion 412. The top surface portion 411 constitutes the top surface (that is, the ceiling surface) of the housing 41 and the side surface portion 412 constitutes side surfaces of the housing 41. The top surface portion 411 and the side surface portion 412 are plate-like members formed from a light transmissive material. The side surface portion 412 is located between a player playing a game of the game apparatus 10 and each of the game fields 110. That is, the side surface portion 412 includes a part located in front of each player.

A mount portion 44 is placed in the housing 41. The internal space of the housing 41 is divided by the mount portion 44 into a game housing space 45 and the game object housing space 46. The game housing space 45 is a space under the mount portion 44. The four game fields 110 (110*a*, 110*b*, 110*c*, and 110*d*), the conveyor devices 170*ac* and 170*bd*, the third lottery portions 140*ab* and 140*cd*, and the JP payout portion 150 are housed in the game housing space 45.

The game object housing space 46 is a space above the mount portion 44. The game object housing space 46 can be rephrased as a space between the mount portion 44 and the top surface portion 411. The game object housing space 46 is a space located above the four game fields 110. As shown in FIG. 28, a light source 413 is mounted on an inner surface (a surface facing the mount portion 44) of the top surface portion 411. The light source 413 is a planar illuminating device extending over the four game fields 110 as viewed from above in the vertical direction. That is, the light source 413 is mounted on the opposite side across the mount portion 44 relative to the four game fields 110. The light source 413 emits light toward the mount portion 44. The light source 413 has a configuration such that a luminous body is formed in a planar manner; or has a configuration such that, for example, point light sources or line light sources are arrayed in a planar manner.

Figure 29:
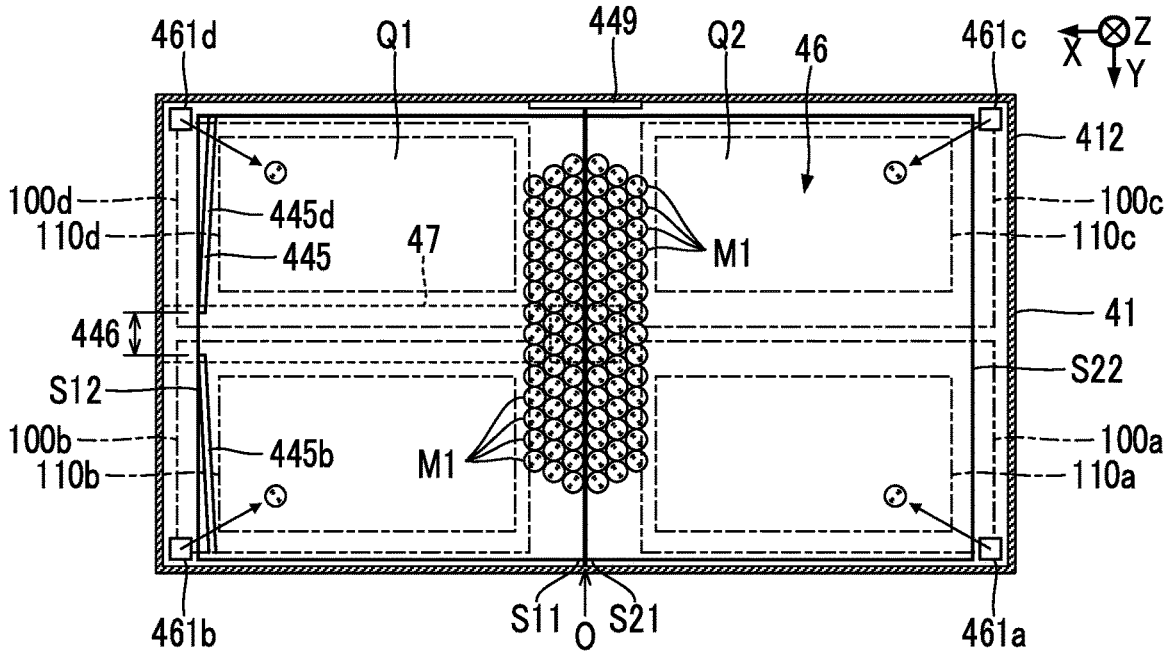
FIG. 29 is a plan view of the inside of the game object housing space viewed from above.

FIG. 29 is a plan view of the inside of the game object housing space 46 viewed from above. A cross section along a line D-D in FIG. 28 is shown in FIG. 29. As shown in FIG. 29, four feeding portions 461 (461*a*, 461*b*, 461*c*, and 461*d*) are provided at four corners of the game object housing space 46, respectively. The feeding portion 461*a* feeds small balls M11 transported in the vertical direction by the conveyor device 180*a* and supplied from the path switcher 280*a* into the game object housing space 46. The feeding portions 461*b*, 461*c*, and 461*d* also feed small balls M1 into the game object housing space 46 in the same manner.

The small balls M1 fed to the game object housing space 46 are placed on the mount portion 44. The mount portion 44 is a structure extending over the four game fields 110 as viewed from above in the vertical direction. Because the mount portion 44 is located above the four game fields 110 in the first embodiment as explained above, an advantage is obtained in that the inner space of the housing 41 can be effectively utilized.

As shown in FIGS. 28 and 29, the mount portion 44 in the first embodiment is configured to include a first plate-like member 441 and a second plate-like member 442. The first plate-like member 441 and the second plate-like member 442 are formed from, for example, a light transmissive material.

The first plate-like member 441 is a flat plate material including a first face Q1 on which small balls M1 are placed. The first face Q1 is a rectangular surface including an edge S11 and an edge S12 opposing to each other. The first plate-like member 441 includes a protrusion 445. The protrusion 445 is a linear portion protruding from the first face Q1 along the edge S12. As shown in FIG. 29, a discharger 446 through which the small balls M1 on the first face Q1 can pass is formed on the protrusion 445. Specifically, the protrusion 445 consists of a linear portion 445*b* located above the game field 110*b* and a linear portion 445*d* located above the game field 110*d*. A gap between the portion 445*b* and the portion 445*d* is the discharger 446. Each of the portion 445*b* and the portion 445*d* is arranged at an angle with respect to the Y direction in such a manner that a part closer to the discharger 446 is located in a more positive X direction (the opposite side to the second plate-like member 442).

The second plate-like member 442 is a flat plate material including a second face Q2 on which small balls M1 are placed. The second face Q2 is a rectangular surface including an edge S21 and an edge S22 provided in opposing relation to each other. The second plate-like member 442 is mounted such that the second face Q2 is at an angle with respect to the horizontal plane. Specifically, the second plate-like member 442 is mounted to locate the edge S21 at a position lower than the edge S22. An angle θ2 of the slope of the second face Q2 with respect to the horizontal plane is set to, for example, be equal to or lower than 10°. The angle θ2 is more preferably about 5°. The angle θ2 of the second face Q2 is fixed. As will be understood from FIG. 29, the feeding portions 461*a* and 461*c* feed small balls M1 from the high-level side of the second plate-like member 442 (that is, on the edge S22 side).

The first plate-like member 441 is pivoted about a rotation shaft O extending in the horizontal direction. The rotation shaft O is a linear shaft body along the edge S21 at a low-level side of the second plate-like member 442. A part of the first plate-like member 441 near the edge S11 is supported on the rotation shaft O. That is, the edge S11 of the first plate-like member 441 and the edge S21 of the second plate-like member 442 are close to each other. In the above configuration, the first plate-like member 441 is allowed to rotate about the rotation shaft O.

Specifically, the first plate-like member 441 is controlled to be in one of a first state and a second state in which an angle θ1 of the first face Q1 with respect to the horizontal plane are different from each other. The first plate-like member 441 of the first embodiment is controlled to be in either the first state or the second state by a drive mechanism 449 including a motor or the like. The drive mechanism 449 maintains the first plate-like member 441 of the first state under normal conditions and changes the first plate-like member 441 from the first state to the second state when payout of small balls M1 by the JP payout portion 150 is determined by the third lottery. When the payout by the JP payout portion 150 ends, the drive mechanism 449 changes the first plate-like member 441 from the second state to the first state.

The first state is a state in which the first face Q1 is sloped with respect to the horizontal plane as indicated by a solid line in FIG. 28. Specifically, the first plate-like member 441 is sloped in the first state to locate the edge S11 at a position lower than the edge S12. The angle θ1 of slope of the first face Q1 with respect to the horizontal plane in the first state is set to, for example, be equal to or lower than 10°. The angle θ1 is more preferably about 5°. The feeding portions 461*b* and 461*d* feed small balls M1 from the high-level side (that is, the side of the edge S12) of the first plate-like member 441 in the first state.

Small balls M1 fed from the feeding portion 461*b* or 461*d* onto the first face Q1 in the first state are arrayed in a single layer along the first face Q1. Specifically, small balls M1 fed onto the first face Q1 are brought into contact with small balls M1 existing on the first face Q1 in a direction parallel to the first face Q1. Therefore, small balls M1 are arrayed densely along the first face Q1 without being stacked in the perpendicular direction to the first face Q1 or the vertical direction. That is, small balls M1 are arranged in a single layer from the edge S11 on the low-level side of the first face Q1 toward the edge S12 on the high-level side. Similarly, small balls M1 fed onto the second face Q2 from the feeding portion 461*a* or 461*c* are arrayed in a single layer along the second face Q2. That is, small balls M1 are arrayed in a single layer from the edge S21 on the low-level side of the second face Q2 toward the edge S22 on the high-level side. That is, small balls M1 are gradually arrayed from a place near the rotation shaft O on the low-level side toward the edge S12 or the edge S22 on the high-level side.

The four feeding portions 461 (461*a*, 461*b*, 461*c*, and 461*d*) correspond to the four stations 100 (100*a*, 100*b*, 100*c*, and 100*d*), respectively. Each of the feeding portions 461 feeds small balls M1 according to the status of a play of the game in the station 100 corresponding to the feeding portion 461. Specifically, the number of small balls M1 corresponding to the number of small balls M1 fed onto the game field 110*a*, or the number of small balls M1 corresponding to the result of a physical lottery in the game field 110*a* are fed from the feeding portion 461*a* onto the game object housing space 46. For example, as the number of small balls M1 fed by the player to the game field 110*a* is larger or as the number of small balls M1 fed onto the game field 110*a* according to the result of a physical lottery is larger, more small balls M1 are fed from the feeding portion 461*a* into the game object housing space 46.

Figure 30:
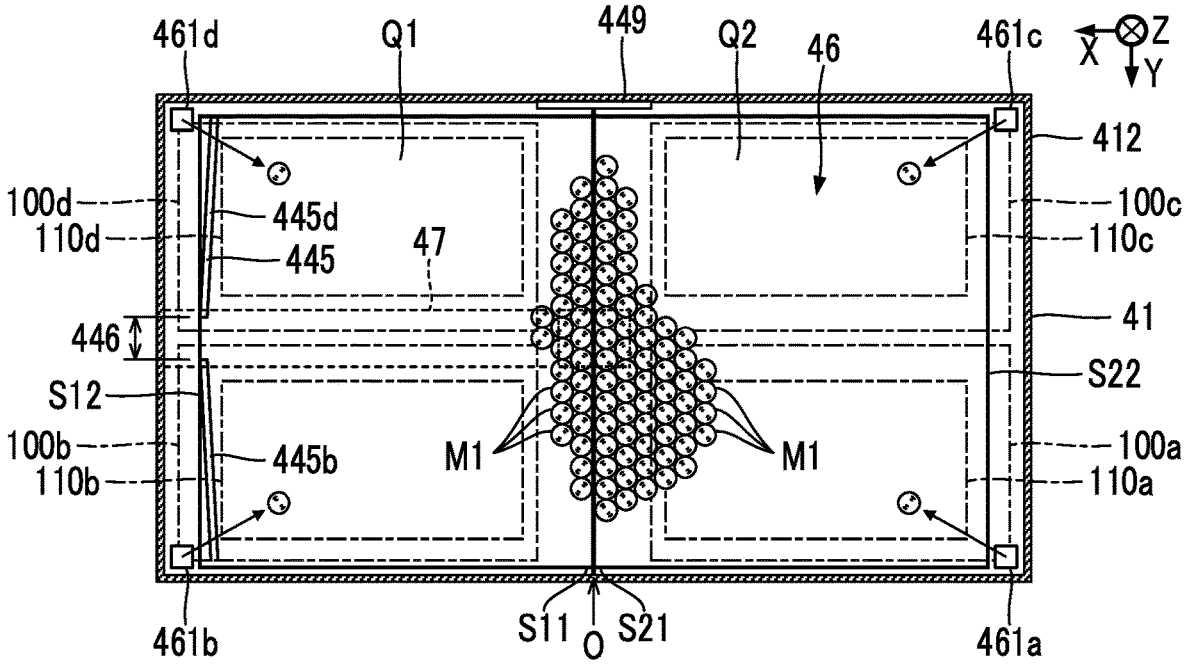
FIG. 30 is a plan view of the inside of the game object housing space viewed from above.

Small balls M1 placed on the mount portion 44 are distributed unevenly and concentrated on a region near a feeding portion 461 that has fed a larger number of small balls M1 among the four feeding portions 461. For example, when the number of small balls M1 fed by the feeding portion 461*a* is larger than the numbers of small balls M1 fed by other feeding portions 461 (461*b*, 461*c*, and 461*d*), more small balls M1 are located on a region near the feeding portion 461*a* (a region above the game field 110*a*) of the first face Q1 and the second face Q2 as shown in FIG. 30. That is, many small balls M1 are unevenly concentrated at a region above a game field 110 where the game has been played in such a way that many small balls M1 are fed to the game object housing space 46. In other words, many small balls M are unevenly concentrated at a region above a game field 110 when a player has vigorously played the game. According to the above configuration, which player contributes to accumulation of small balls M1 in the game object housing space 46 can be visually estimated by a distribution of the small balls M1 in the game object housing space 46. For example, in a state in which small balls M1 in the game object housing space 46 are distributed as shown in FIG. 30, it is possible to know that a player using the game field 110*a* contributes accumulation of small balls M1 in the game object housing space 46.

In FIG. 28, the first plate-like member 441 in the second state is indicated by a broken line. As shown in FIG. 28, the second state is a state in which the angle θ1 of the first face Q1 is changed from that in the first state. Specifically, the first plate-like member 441 is sloped to locate the edge S11 at a position higher than the edge S12 in the second state. That is, the first state and the second state have a relation in which the levels of the edge S11 and the edge S12 of the first face Q1 are inverted.

In the second state, the elevation between the first face Q1 and the second face Q2 is close to 180°. Specifically, as shown in FIG. 28, the first face Q1 and the second face Q2 are located in a same plane at an angle with respect to the horizontal plane in the second state. Therefore, small balls M1 placed on the first face Q1 and the second face Q2 roll all together toward the edge S12 on the low-level side of the first face Q1. The small balls M1 are guided along the protrusion 445 (the portions 445*b* and 445*d*) to the discharger 446 and fall through the discharger 446. That is, many small balls M1 housed in the game object housing space 46 are discharged from the discharger 446 to the game housing space 45. As explained above, according to the first embodiment, a dynamic presentation in which many small balls M1 placed on the mount portion 44 roll at the same time toward the discharger 446 is realized.

While small balls M1 are guided by the protrusion 445 to the discharger 446 in the above explanations, the configuration for guiding small balls M1 to the discharger 446 is not limited to the illustrated example. For example, small balls M1 may be guided to the discharger 446 by a configuration in which a part of the first face Q1 corresponding to the game field 110*b* and a part thereof corresponding to the game field 110*d* are at an angle with respect to the horizontal plane to locate the border therebetween at a lower position (that is, a configuration in which the cross section of the first face Q1 along a Y-Z plane is V-shaped). Also as for the second plate-like member 442, a part of the second face Q2 corresponding to the game field 110*a* and a part thereof corresponding to the game field 110*c* may be similarly formed to intersect with each other.

As shown in FIGS. 28 and 29, a discharge path 47 is placed in the inner space of the housing 41. The discharge path 47 is placed at a position corresponding to the discharger 446 of the first plate-like member 441 in the game housing space 45. Small balls M1 that have fallen from the discharger 446 are supplied to the discharge path 47. As shown in FIG. 28, the discharge path 47 includes a slope descending toward the JP payout portion 150. Therefore, small balls M1 supplied from the discharger 446 of the game object housing space 46 to the discharge path 47 roll on the slope of the discharge path 47 to enter the JP payout portion 150. The JP payout portion 150 supplies many small balls M1 supplied from the discharge path 47 to a game field 110 to which payout is determined to be carried out by the third lottery as described above.

As described above, the first plate-like member 441 and the second plate-like member 442 are formed from a light transmissive material. Therefore, each player is able to view many small balls M1 placed on the first face Q1 and the second face Q2 through the mount portion 44 from the side of the corresponding game field 110. Because small balls M1 are arrayed in a single layer along the first face Q1 and the second face Q2 particularly in the first embodiment, it is possible to effectively enable the players to view many small balls M1 placed on the mount portion 44.

As described above, the small balls M1 and the mount portion 44 are formed from light transmissive materials. Therefore, illumination light from the light source 413 penetrates through the small balls M1 and the mount portion 44, and is emitted toward the game fields 110. According to the above configuration, light is appropriately scattered by small balls M1 on the mount portion 44, penetrates through the mount portion 44, and can be viewed by the players. As a result, a visual effect can be enhanced.

Figure 31:
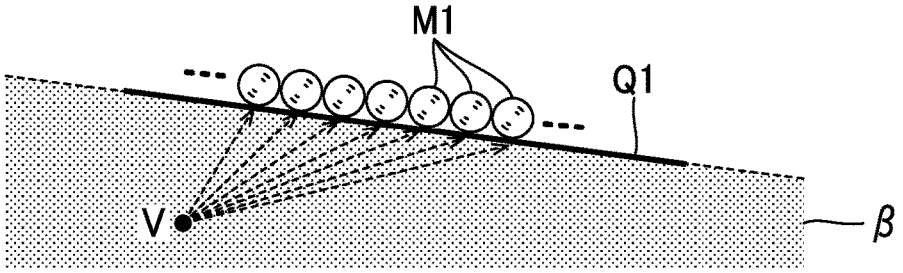
FIG. 31 is a schematic diagram for explaining a positional relation between the game object housing space and a player.

FIG. 31 is a schematic diagram for explaining a positional relation between the game object housing space 46 and a player. A virtual viewpoint V shown in FIG. 31 indicates the position (eye point) of the eyes of a virtual player playing the game provided by the game field 110. As shown in FIG. 31, the mount portion 44 is mounted such that the virtual viewpoint V is positioned in a space below the first face Q1 in the first embodiment. According to the above configuration, a player is able to view most of small balls M on the first face Q1 through the mount portion 44, as indicated by broken arrows in FIG. 31. Therefore, it is possible to enable the player to effectively view many small balls M1 placed on the mount portion 44. It is of note that the mount portion 44 may be mounted such that the virtual viewpoint V is positioned in a space below both the first face Q1 and the second face Q2.

Focusing on a tangent plane passing through a contact point between the first face Q1 and a small ball M1 placed on the first face Q1, the space below the first face Q1 indicates a space located below in the vertical direction as viewed from the tangent planes of all small balls M1 placed on the first face Q. In a configuration where the first face Q1 is a flat surface, a space β below a flat surface including the first face Q1 corresponds to the space below the first face Q1.

Figure 32:
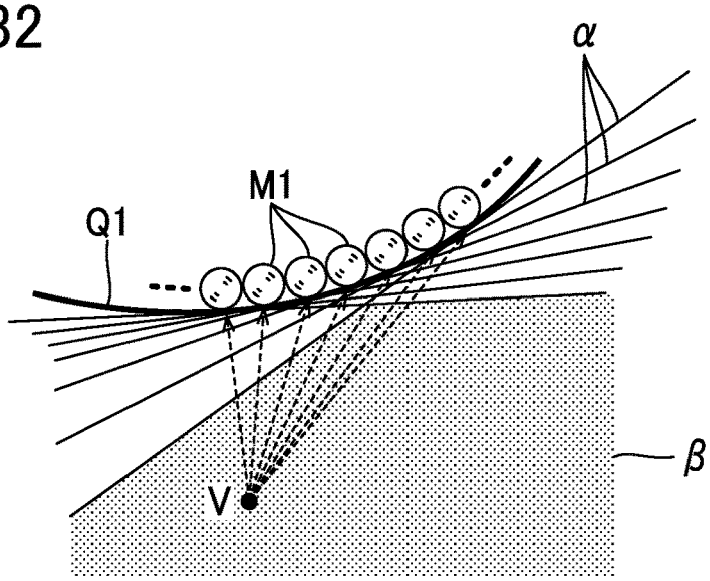
FIG. 32 is a schematic diagram for explaining a positional relation between the game object housing space and a player.

In a configuration where the first face Q1 is a curved surface (for example, a spherical surface or an arc surface), the angle of a tangent plane a is different for each small ball M1 placed on the first face Q1, as shown in FIG. 32. In the configuration shown in FIG. 32, a space β located below the tangent planes a of all small balls M1 on the first face Q1 corresponds to the space below the first face Q1.

The mount portion 44 may be mounted in such a manner that the virtual viewpoints V corresponding to different positions of players are positioned in a space below the first face Q1 (a space that is below the second face Q2 also). The virtual viewpoints V are virtual viewpoints of players playing the games in different stations 100. According to the above configuration, many small balls M placed on the mount portion 44 can be viewed from positions where players of the game apparatus 10 can be present.

Second Embodiment

A second embodiment of the present invention is explained. In the following illustrations, elements having functions that are substantially the same as those of the first embodiment are denoted by the same signs as used in the descriptions of the first embodiment, and detailed description of such elements is omitted, as appropriate.

Figure 33:
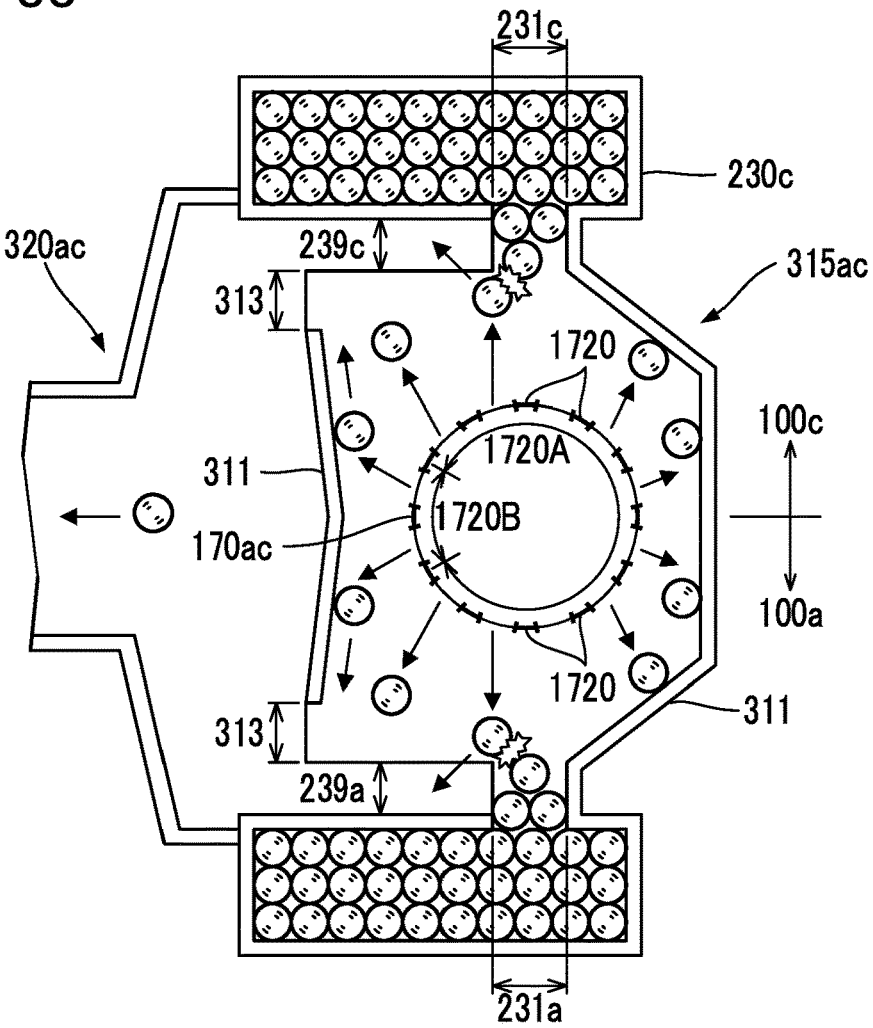
FIG. 33 is a plan view of the first discrete path in a second embodiment.

FIG. 33 is a plan view of the first discrete path 315*ac* in the second embodiment. As shown in FIG. 33, an opening 239*a* adjacent to the supply path 231*a*, and an opening 239*c* adjacent to the supply path 231*c* are formed on the first discrete path 315*ac* in the second embodiment. The openings 239*a* and 239*c* are openings formed above the second discrete path 320*ac*.

Similarly to the first embodiment, small balls M1 that have entered the supply path 231*a* are supplied to the first hopper 230*a*. When the first hopper 230*a* is full, small balls M1 that are not allowed to reach the first hopper 230*a* stay on the supply path 231*a*. A small ball M1 discharged from the conveyor device 170*ac* toward the supply path 231*a* in the above state changes the direction due to collision against one or more of existing small balls M1 staying on the supply path 231*a* and falls from the opening 239*a* to the second discrete path 320*ac* as shown in FIG. 33.

If too many small balls M1 are supplied to the first hopper 230*a*, there is a possibility that the bridge phenomenon will occur in the reserving container 231 of the first hopper 230*a*. In the second embodiment, occurrence of the bridge phenomenon in the first hopper 230*a* can be suppressed because small balls M1 moving toward the supply path 2311*a* fall from the opening 239*a* to the second discrete path 320*ac* if small balls M1 stay on the supply path 231*a*. Although the first hopper 230*a* is focused on in the above explanations, it is of note that substantially the same effect is also realized for the first hopper 230*c*.

Third Embodiment

Figure 34:
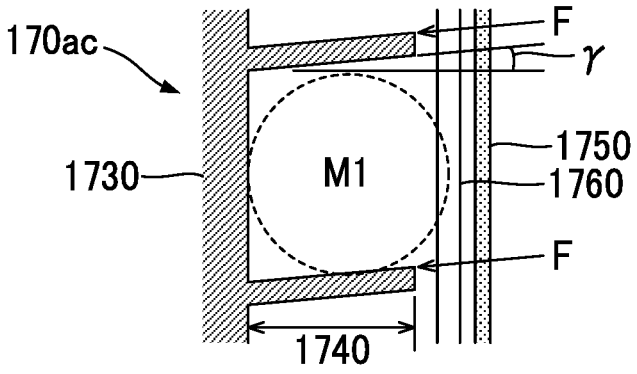
FIG. 34 is a partially enlarged sectional view illustrating a conveyor device according to a third embodiment.

FIG. 34 is a partially enlarged sectional view illustrating the conveyor device 170*ac* according to a third embodiment. As shown in FIG. 34, the mount face F of the supporter 1740 is sloped upward at an angle γ to a direction perpendicular to the rotation axis C (that is, the horizontal direction) in the conveyor device 170*ac* of the third embodiment. That is, the mount face F is a slope that a position that is farther from the rotation axis C is higher than a position that is closer to the rotation axis C. According to the above configuration, a possibility of small balls M1 falling from the mount face F can be reduced.

Fourth Embodiment

Figure 35:
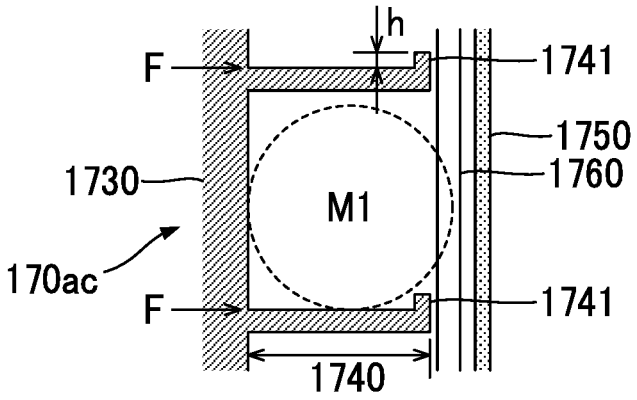
FIG. 35 is a partially enlarged sectional view illustrating a conveyor device according to a fourth embodiment.

FIG. 35 is a partially enlarged sectional view illustrating the conveyor device 170*ac* according to a fourth embodiment. As shown in FIG. 35, a protrusion 1741 extending from the mount face F is formed on an outer periphery of the supporter 1740 in the conveyor device 170*ac* of the fourth embodiment. A height h of the protrusion 1741 is, for example, smaller than the radius D/2 of the small ball M1. According to the above configuration, the possibility of the small balls M1 falling from the mount face F can be reduced similarly to the third embodiment.

It is of note that the third embodiment and the fourth embodiment may be combined. That is, the protrusion 1741 may be formed on an outer periphery of the mount face F at an angle to the direction perpendicular to the rotation axis C.

Modifications

Specific modified modes added to each of the embodiments illustrated above are illustrated below. Two or more aspects freely selected from the following illustrations may be combined with one another as appropriate, in so far as no contradiction arises from any such combination.

(1) In the embodiments described above, a state in which the first hopper 230*a* is full is illustrated as a state (hereafter, "entry restricted state") in which entry of small balls M1 into the first hopper 230*a* is restricted. However, the entry restricted state is not limited to the above example. For example, in a configuration in which an opening/closing mechanism that opens/closes the supply path 231*a* is provided, the entry restricted state may be a state in which the supply path 231*a* is closed by the opening/closing mechanism. Although the first hopper 230*a* is focused on in the above explanations, the same holds true for the entry restricted states of the second hopper 240*a* and the third hopper 250*a*.

(2) In the embodiments described above, the configuration in which there is one small ball M1 in the gap between two guides 1760 in the conveyor device 170*ac* is illustrated. However, two or more small balls M1 may be housed in the gap between two guides 1760.

(3) In the embodiments described above, the configuration in which the conveyor device 170*ac* includes the encircling member 1750 is illustrated. However, the encircling member 1750 may be omitted from the conveyor device 170*ac*. For example, in the configuration in the third embodiment in which the mount face F is sloped or the configuration in the fourth embodiment in which the protrusion 1741 is formed on the outer periphery of the supporter 1740, small balls M1 can be supported on the mount face F even if the encircling member 1750 is omitted. The rotating body 1730 may be rotated at such a speed that small balls M1 do not fall from the mount face F. Some small balls M1 falling from the mount face F may be acceptable.

(4) In the embodiments described above, multiple sets of the intake port 1710 and the discharge port 1720 are arrayed over the entire region around the circumferential direction of the conveyor device 170*ac*. However, the intake ports 1710 and the discharge ports 1720 may be arranged only in a specific region in the circumferential direction of the conveyor device 170*ac*. In a configuration in which, for example, k (k is a natural number equal to or larger than 2) guides 1760 are placed in a specific region in the circumferential direction, an intake port 1710 and a discharge port 1720 are formed in the gap between two guides 1760 adjacent to each other. That is, (k−1) sets of the intake port 1710 and the discharge port 1720, and (k−1) transport paths are formed. That is, transport paths as many as the intake ports 1710 or the discharge ports 1720 are formed.

It is of note that the number of guides 1760 actually involved in transport of small balls M1 through contact with the small balls M1 among the k guides 1760 is (k−1). In other words, as many (that is, (k−1)) intake ports 1710, discharge ports 1720, and transport paths as the guides 1760 involved in the transport of small balls M1 are formed. The same relation in the number described above holds for a configuration in which the guides 1760 are arrayed at the interval G on the entire region in the circumferential direction of the rotation axis C. In the configuration in which the guides 1760 are arrayed on the entire region in the circumferential direction, all the guides 1760 are involved in transport of small balls M1.

(5) As described above, small balls M1 transported by the conveyor device 170*ac* are supported by the supporter 1740. The support force on the small balls M1 by the supporter 1740 may be changed depending on the position on the transport path. For example, a configuration is assumed in which the support force on the small balls M1 by the supporter 1740 is reduced on an upper part (near the discharge ports 1720) of the transport path. According to the mode described above, the above configuration reduces the support force on the small balls M1 on an upper part of the transport path, so that the small balls M1 can be smoothly discharged from the transport path near the upper part.

In the configuration in which the support force on the small balls M1 by the supporter 1740 is reduced, a configuration is preferable in which the angle γ of the slope of the mount face F in a configuration in which the mount face F is sloped upward as in the third embodiment is reduced on the upper part of the transport path. In the configuration in which the protrusion 1741 is formed on the outer periphery of the supporter 1740 as in the fourth embodiment, the height h of the protrusion 1741 may be reduced at the upper part of the transport path. A configuration in which the width L1 of the mount face F is reduced at the upper part on the transport path is also preferable.

Figure 36:
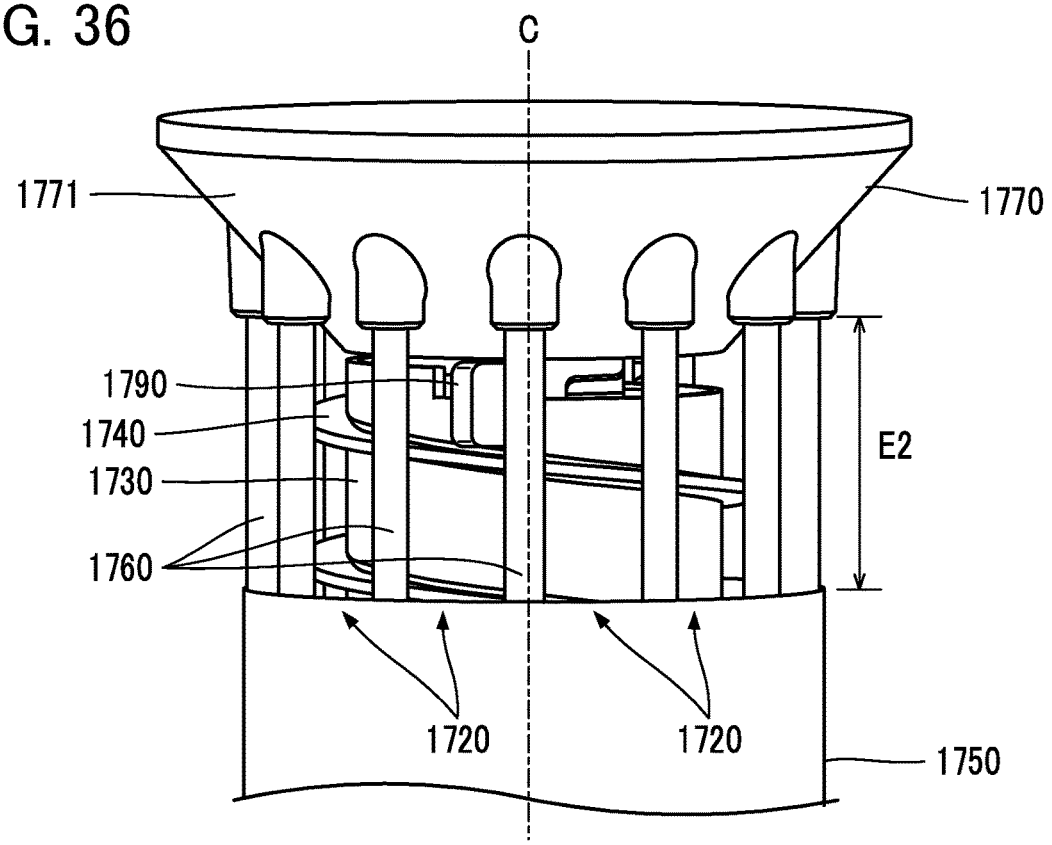
FIG. 36 is a perspective view illustrating in enlargement a part of a conveyor device in a modification near discharge ports.

(6) In the embodiments described above, the holder 1770 (the slope 1771) is illustrated as an example of the discharge guide that separates small balls M1 transported by the transport path from the rotation axis C. However, the specific configuration of the discharge guide is not limited to the example illustrated above. For example, as shown in FIG. 36, a protrusion 1790 protruding from the outer circumferential surface of the rotating body 1730 may be utilized as the discharge guide. Small balls M1 transported by the transport path collide against the protrusion 1790 to be forcibly discharged from the discharge ports 1720.

(7) In the embodiments described above, the supporter 1740 is placed on the outer circumferential surface of the rotating body 1730. However, the location to which the supporter 1740 is fixed is not limited to the rotating body 1730. For example, the bottom end of the supporter 1740 may be fixed to the supplier 1780 and the top end of the supporter 1740 may be fixed to the holder 1770. Further, the rotating body 1730 may be omitted.

(8) In the embodiments described above, the supplier 1780 having the supply surface 1781 formed thereon is illustrated as an example. However, the configuration for supplying small balls M1 to the conveyor device 170*ac* is not limited to the example illustrated above. For example, small balls M1 may be supplied to the intake ports 1710 by using belt conveyors placed radially around the conveyor device 170*ac* being the center.

(9) In the embodiments described above, the first path 310*ac* and the second path 340*ac* are separate paths. However, the first path 310*ac* and the second path 340*ac* may be a continuous integral path. In the embodiments described above, the first path 310*ac* consists of the first discrete path 315*ac* and the second discrete path 320*ac*. However, the first path 310*ac* may consist of a single path. The second path 340*ac* may consist of a plurality of paths. The angles of slopes of the first path 310*ac* and the second path 340*ac* may be constant along the entire length of the paths or they may vary in a continuous or stepwise manner. The planar shapes of the first path 310*ac* and the second path 340*ac* may be freely selected, and may be linear or curved.

(10) In the embodiments described above, the first hopper 230*a* is installed upstream of the second hopper 240*a* and the third hopper 250*a*. However, the first hopper 230*a* may be installed downstream of the second hopper 240*a* or the third hopper 250*a*.

(11) In the embodiments described above, the circulating mechanism 20*ac* is shared by the stations 100*a* and 100*c*. However, a circulating mechanism may be individually installed for each of the stations 100. The game object housing space 46 may be individually installed for each of the stations 100.

(12) In the embodiments described above, small balls M1 transported by the conveyor device 180*a* are supplied to either the third lottery portion 140*ab* or the game object housing space 46. However, the small balls M1 transported by the conveyor device 180*a* may be supplied only to the game object housing space 46. Small balls M1 are supplied from another supplier (the first hopper 230*a*, for example) to the third lottery portion 140*ab*.

(13) In the embodiments described above, the second hopper 240*a* or the third hopper 250*a* located downstream on the first path 310*ac* uses small balls M1 in a game, and the first hopper 230*a* located upstream on the first path 310*ac* uses small balls M1 in a physical lottery. In other words, in the above configuration, a first game object utilizer located upstream uses small balls M1 in a physical lottery and a second game object utilizer located downstream uses small balls M1 in a game. Focusing on the first hopper 230*a*, the second hopper 240*a*, and the third hopper 250*a*, the first hopper 230*a* corresponds to the first game object utilizer and the second hopper 240*a* or the third hopper 250*a* corresponds to the second game object utilizer. Focusing on the second hopper 240*a* and the third hopper 250*a*, the second hopper 240*a* corresponds to the first game object utilizer and the third hopper 250*a* corresponds to the second game object utilizer.

As shown in FIG. 12, small balls M1 supplied to the second game object utilizer (the second hopper 240*a* and the third hopper 250*a*) are fed directly to the game field 110*a*. Meanwhile, small balls M1 supplied to the first game object utilizer (the first hopper 230*a*) are supplied to the first lottery portion 120*a* via the path switcher 270*a*, are used by the first lottery portion 120*a*, and are thereafter fed to the game field 110*a*. That is, in the first embodiment, among the game object utilizers, a game object utilizer (for example, the first hopper 230*a*) that requires intervention of more devices (the path switcher 270*a* and the first lottery portion 120*a*) before feeding of small balls M1 to the game field 110*a* is placed upstream of other game object utilizers (for example, the second hopper 240*a* and the third hopper 250*a*).

In contrast to the above configuration, a configuration (hereafter, "modified mode") is assumed in which the first game object utilizer located upstream uses small balls M1 in a game, and the second game object utilizer located downstream uses small balls M1 in a physical lottery. For example, the first game object utilizer feeds small balls M1 to the game field 110, and the second game object utilizer uses small balls M1 in a physical lottery. In the modified mode, a configuration is preferable in which the number of small balls M1 used by the first game object utilizer in a game is more than the number of small balls M1 used by the second game object utilizer in a physical lottery. According to the above configuration, small balls M1 can be used preferentially for a game in the first game object utilizer over a physical lottery in the second game object utilizer.

(14) In the embodiments described above, small balls M1 fed by the feeding portion 461*a* into the game object housing space 46 are unevenly concentrated in the region above the game field 110*a*, as shown in FIG. 30. However, the positional relation between the feeding portions 461 and the regions where more small balls M1 are located is not limited to the example illustrated above.

Figure 37:
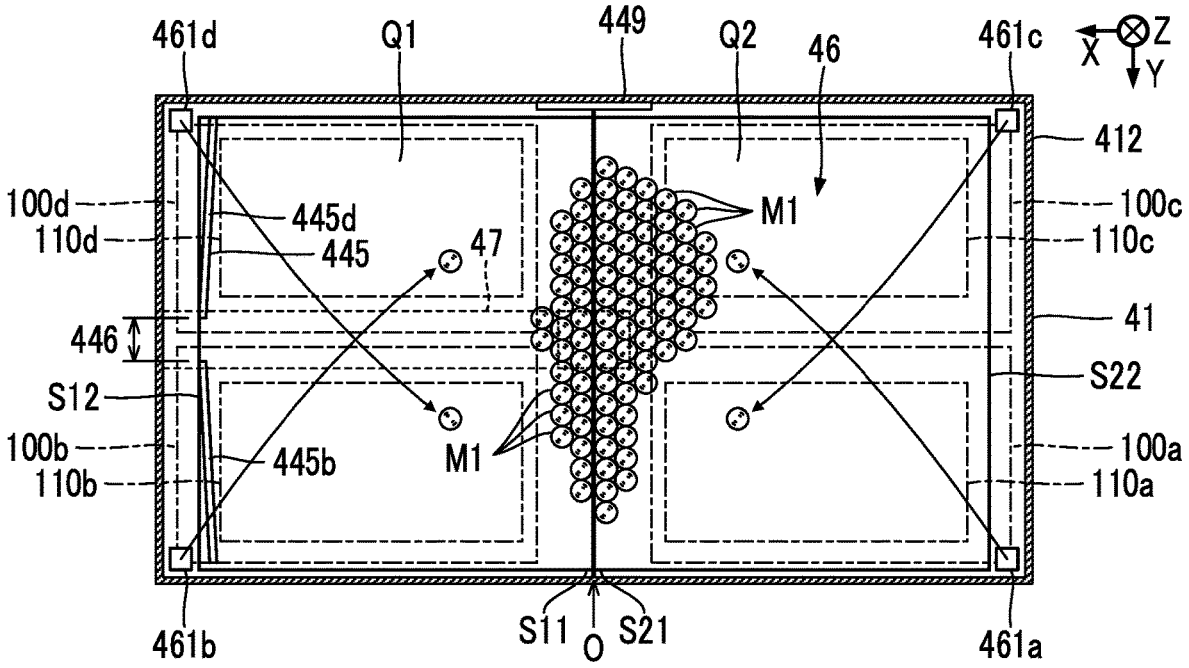
FIG. 37 is a plan view of the inside of a game object housing space viewed from above in the modification.

For example, as shown in FIG. 37, the feeding portions 461*a* and 461*c* may feed small balls M1 in such a manner that small balls M1 fed by the feeding portion 461*a* are arrayed above the game field 110*c* and small balls M1 fed by the feeding portion 461*c* are arrayed above the game field 110*a*. That is, a trajectory of small balls M1 fed by the feeding portion 461*a* and a trajectory of small balls M1 fed by the feeding portion 461*c* intersect with each other. Therefore, for example, when the number of small balls M1 fed by the feeding portion 461*a* is more than the number of small balls M1 fed by other feeding portions 461 (461*b*, 461*c*, and 461*d*), more small balls M1 are located in the region above the game field 110*c*, as shown in FIG. 37.

As will be understood from the above example, in the state shown in FIG. 30 or 37, more small balls M1 are unevenly located and concentrate in a region corresponding to a feeding portion that has input more small balls M1 out of a first feeding portion (461*b* or 461*d*) and a second feeding portion (461*a* or 461*c*). Assuming the example shown in FIG. 30 or 37, "a region corresponding to a feeding portion that has fed more small balls M1" is at least a partial region of the first face Q1 when the number of small balls M1 fed by the first feeding portion (461*b* or 461*d*) is larger, and is at least a partial region of the second face Q2 when the number of small balls M1 fed by the second feeding portion (461*a* or 461*c*) is larger. In other words, "a region corresponding to a feeding portion that has fed more small balls M1" is a slope at an angle from a place near a feeding portion (461*a*, 461*b*, 461*c*, or 461*d*) that has fed more small balls M1 to a low-level side.

Specifically, the state shown in FIG. 30 is one in which small balls M1 are located unevenly and concentrate in a region near a feeding portion 461 that has fed more small balls M1 on a slope (Q1 or Q2) at an angle from the feeding portion 461 to a low-level side. For example, when the feeding portion 461*a* has fed more small balls M1, small balls M1 are located unevenly and concentrate in a region (a region above the game field 110*a*) near the feeding portion 461*a* on the second face Q2. For example, when the second face Q2 is divided into two regions including a region on the feeding portion 461*a* side and a region on the feeding portion 461*c* side, small balls M1 are unevenly concentrated in the half region on the feeding portion 461*a* side on the second face Q2 in a case in which the feeding portion 461*a* feeds more small balls M1. Meanwhile, the state shown in FIG. 37 is one in which small balls M1 are unevenly concentrated in a region far from a feeding portion 461 that has fed more small balls M1 on the slope (Q1 or Q2) at an angle from the feeding portion 461 to the low-level side. For example, when the feeding portion 461*a* has fed more small balls M1, small balls M are unevenly concentrated in a region (the region above the game field 110*c*) far from the feeding portion 461*a* on the second face Q2. For example, when the second face Q2 is divided into two regions including a region on the feeding portion 461*a* side and a region on the feeding portion 461*c* side, small balls M1 are unevenly concentrated in the half region of the second Q2 on the feeding portion 461*c* side in a case in which the feeding portion 461*a* feeds more small balls M1.

APPENDIX

The following preferred aspects of the present invention are understood based on the above descriptions. In the following descriptions, reference signs in the drawings are denoted in parentheses in order to facilitate understanding of each aspect, but the present invention is not limited to these aspects illustrated in the drawings.

Appendix 1

A game apparatus (10) according to a preferred aspect of the present invention is a game apparatus for providing a game in which three-dimensional game objects (M1) rollable regardless of an orientation of the three-dimensional game objects (M1) are used, the game apparatus comprising: a circulating mechanism (20*ac*) configured to circulate the three-dimensional game objects (M1), where the circulating mechanism (20*ac*) includes a conveyor device (170*ac*) configured to transport the three-dimensional game objects (M1) from a first position (P1) to a second position (P2) that is higher than the first position (P1), a first path (310*ac*) configured to move the three-dimensional game objects (M1) from the second position (P2) to a third position (P3) that is lower than the second position (P2), a supply path (231*a*, 241*a*, 251*a*) for supply of a part of the three-dimensional game objects (M1) to a game object utilizer (230*a*, 240*a*, 250*a*) that uses the supplied three-dimensional game objects (M1) in the game, the part of the three-dimensional game objects (M1) entering the supply path (231*a*, 241*a*, 251*a*) at a position between the second position (P2) and the third position (P3), and a second path (340*ac*) configured to move a part of the three-dimensional game objects (M1) not entering the supply path (231*a*, 241 *a*, 251*a*) to the first position (P1) that is lower than the third position (P3). In this description, "a part of" the three-dimensional game objects (M1) includes "one or more" three-dimensional game objects (M1).

According to the above configuration, by transporting the three-dimensional game objects (M1) with the conveyor device (170*ac*) from the first position (P1) to the second position (P2), the three-dimensional game objects (M1) can be circulated without the need of power on a path from the second position (P2) to the first position (P1) via the third position (P3). Three-dimensional game objects (M1) having entered the supply path (231*a*, 241*a*, 251*a*) on the first path (310*ac*) are used for the game by the game object utilizer (230*a*, 240*a*, 250*a*) while three-dimensional game objects (M1) not entering the supply path (2311*a*, 241*a*, 251*a*) can be returned to the first position (P1) via the third position (P3).

"An m-th position that is higher (lower) than an n-th position" means that the height in the vertical direction of the m-th position is higher (lower) than that of the n-th position, and the positional relation (for example, the distance) between the n-th position and the m-th position in the horizontal direction is not limited to any relation.

"Fall" of a three-dimensional game object (M1) means fall to a lower position due to the action of gravity and includes fall along a specific object as well as free fall in a state where no external force other than gravity exists. For example, a state in which a three-dimensional game object (M1) falls on a helical trajectory along a helical member is also included the concept of "fall."

Each of "the first path (310*ac*)" and "the second path (340*ac*)" includes a path that consists of a single member, a path that consists of a plurality of members, or a trajectory along which three-dimensional game objects (M1) fall freely. For example, at least one of "the first path (310*ac*)" and "the second path (340*ac*)" may be constituted as a first discrete path upstream and as a second discrete path downstream, to allow three-dimensional game objects (M1) to fall (for example, fall freely) from the first discrete path to the second discrete path.

Each of "the first path (310*ac*)" and "the second path (340*ac*)" has, for example, a slope that allows three-dimensional game objects (M1) to roll. While typically being a flat surface, the slope may include a curved surface in which an angle of a slope in the path changes. A flat part (that is, a part parallel to the horizontal plane) or a step may be included in the middle of the path. It is of note that the slope that allows three-dimensional game objects (M1) to roll under their own weight is not essential if the three-dimensional game objects (M1) can move on the path under kinetic energy provided by another mechanism such as the conveyor device (170*ac*).

"The game object utilizer (230*a*, 240*a*, 250*a*)" is any mechanism in which game objects are used. For example, a hopper that houses and discharges three-dimensional game objects (M1), a feeding portion for feeding three-dimensional game objects (M1) to a game field, or a lottery portion in which three-dimensional game objects (M1) are used for a physical lottery is a preferred example of the game object utilizer (230*a*, 240*a*, 250*a*).

Appendix 2

In the game apparatus (10) according to a preferred aspect of appendix 1, the conveyor device (170*ac*) is configured to continue to be in an operation state for transporting the three-dimensional game objects (M1), to thereby supply the part of the three-dimensional game objects (M1) to the game object utilizer (230*a*, 240*a*, 250*a*).

According to the above configuration, supply of three-dimensional game objects (M1) to the game object utilizer (230*a*, 240*a*, 250*a*) is continued by continuing the operation state of the conveyor device (170*ac*). Therefore, the three-dimensional game objects (M1) can be circulated by the circulating mechanism (20*ac*). It is of note that in a configuration in which the three-dimensional game objects (M1) are supplied to the game object utilizer (230*a*, 240*a*, 250*a*) only in a case in which the game object utilizer (230*a*, 240*a*, 250*a*) requires the three-dimensional game objects (M1), does a problem arise in that it is necessary to detect whether there are three-dimensional game objects (M1) in the game object utilizer (230*a*, 240*a*, 250*a*), and a configuration becomes complicated. The above problem is particularly significant in a configuration in which many game object utilizers (230*a*, 240*a*, 250*a*) are installed. In the preferred aspect described above, because the operation state of the conveyor device (170*ac*) is continued, an advantage is obtained in that it is not necessary to provide a configuration to detect whether there are three-dimensional game objects (M1) in the game object utilizer (230*a*, 240*a*, 250*a*), or to control the conveyor device (170*ac*) according to a result of detection. Further, if a player views the manner in which the three-dimensional game objects (M1) are circulated by the circulating mechanism (20*ac*), the player is able to see that the game apparatus (10) is operating, and a visual production effect is also promising.

"Continuing to be in an operation state for transporting the three-dimensional game objects (M1)" means maintaining the state in which the conveyor device (170*ac*) transports the three-dimensional game objects (M1) regardless of whether the game object utilizer (230*a*, 240*a*, 250*a*) uses game objects, without transporting the three-dimensional game objects (M1) intermittently for each use of the three-dimensional game object (M1) by the game object utilizer (230*a*, 240*a*, 250*a*). That is, the conveyor device (170*ac*) is operated to enable transport of the three-dimensional game object (M1) even in a state where the game object utilizer (230*a*, 240*a*, 250*a*) does not use the three-dimensional game objects (M1). For example, in a configuration in which the game object utilizer (230*a*, 240*a*, 250*a*) reserves the three-dimensional game objects (M1), it means that the conveyor device (170*ac*) is operated regardless of whether the game object utilizer (230*a*, 240*a*, 250*a*) reserves the three-dimensional game object (M1) (empty or full). However, it is unnecessary to always operate the conveyor device (170*ac*) during a period in which the game apparatus (10) is operated or a period in which a game is provided.

The "period in which a game is provided" is a period in which the game apparatus (10) is operated to enable a player to play a game, and whether a player is actually playing a game is irrelevant. However, a presence of a player may be determined directly or indirectly, and a period in which it is determined that a player is present can be regarded as the "period in which a game is provided." A direct determination is, for example, a determination using a human detecting sensor that detects a player. Meanwhile, an indirect determination indicates a presence of a player indirectly, as determined from other elements derived from an action of a player. For example, an indirect determination corresponds to determining a presence of a player according to whether an operation panel is manipulated or whether game values (for example, token coins or credits) required for a play of a game remain. For example, a period from a last time it was directly or indirectly determined that a player was present until a predetermined time (for example, 30 minutes) passes can be regarded as the "period in which a game is provided."

Appendix 3

In a preferred example of appendix 1 or 2, the game object utilizer (230*a*, 240*a*, 250*a*) is positioned higher than the first position (P1), and the three-dimensional game objects (M1) used in the game are collected by the second path (340*ac*) by moving downward.

According to the above configuration, three-dimensional game objects (M1) used in a game by the game object utilizer (230*a*, 240*a*, 250*a*) are supplied to the second path (340*ac*) to enable the three-dimensional game objects (M1) to return to the circulating mechanism (20*ac*). Because the three-dimensional game objects (M1) are collected by the second path (340*ac*) by moving downward, no power is required for collection of the three-dimensional game objects (M1). Therefore, in the entire circulating mechanism (20*ac*), the three-dimensional game object (M1) can be circulated without any need for power except for the conveyor device (170*ac*).

"Collect" means supply of the three-dimensional game objects (M1) that have been used in a game to the second path (340*ac*) and may be rephrased as return of the used three-dimensional game objects (M1) to the circulating mechanism (20*ac*).

Various configurations can be used for collection of the three-dimensional game objects (M1) used in a game by the second path (340*ac*). For example, a configuration can be assumed that allows the three-dimensional game objects (M1) to fall to the second path (340*ac*), or a configuration can be assumed that supplies the three-dimensional game objects (M1) to the second path (340*ac*) via a predetermined path.

Appendix 4

In a preferred example of any of appendices 1 to 3, the game object utilizer (230*a*, 240*a*, 250*a*) includes a first game object utilizer (230*a*, 240*a*) and a second game object utilizer (240*a*, 250*a*), in each of which three-dimensional game objects (M1) are reserved, the supply path (231*a*, 241*a*, 251*a*) includes a first supply path (231*a*, 241*a*) for supply of a part of the three-dimensional game objects (M1) to the first game object utilizer (230*a*, 240*a*), and a second supply path (2411*a*, 251*a*) positioned in a downstream of the first supply path (231*a*, 241*a*) for supply of a part of the three-dimensional game objects (M1) to the second game object utilizer (240*a*, 250*a*), and a part of the three-dimensional game objects (M1) that moves toward the first supply path (231*a*, 241*a*) from the second position (P2) moves toward the third position (P3) in a case in which the first game object utilizer (230*a*, 240*a*) is in an entry restricted state, and then is allowed to enter the second supply path (241*a*, 251 *a*).

In the above configuration, a three-dimensional game object (M1) that moves toward the first path (231*a*, 241*a*) from the second position (P2) moves toward the third position (P3) in a case in which the first game object utilizer (230*a*, 240*a*) is in an entry restricted state, and is then allowed to enter the second supply path (241*a*, 251*a*). Therefore, the three-dimensional game objects (M1) can be supplied preferentially to the first game object utilizer (230*a*, 240*a*) over the second game object utilizer (240*a*, 250*a*). In a case in which the first game object utilizer (230*a*, 240*a*) is in the entry restricted state, the three-dimensional game objects (M1) can be effectively used by being supplied to the second supply path (241*a*, 251*a*) or the third position (P3).

The "entry restricted state" is a state in which supply of the three-dimensional game objects (M1) to the first game object utilizer (230*a*, 240*a*) is restricted (for example, a state in which the three-dimensional game objects (M1) cannot be supplied thereto or a state in which the supply is difficult). For example, a state in which the first game object utilizer (230*a*, 240*a*) is full of the three-dimensional game objects (M1) or a state in which the supply path (231*a*, 241*a*, 251*a*) for supply of the three-dimensional game objects (M1) to the first game object utilizer (230*a*, 240*a*) is mechanically closed is a typical example of the entry restricted state. The entry restricted state is, in other words, a state in which the supply path is blocked by the three-dimensional game objects (M1) (a state in which the supply path is filled with the three-dimensional game objects (M1)). A state in which the three-dimensional game objects (M1) are full is a state in which the first game object utilizer (230*a*, 240*a*) is sufficiently filled with three-dimensional game objects (M1) and it is difficult to add another three-dimensional game object (M1). That is, a three-dimensional game object (M1) moving toward the first game object utilizer (230*a*, 240*a*) collides with existing three-dimensional game objects (M1) supplied to the first game object utilizer (230*a*, 240*a*), changes direction, and consequently can be supplied to another game object utilizer. It is of note that, while for convenience in the above explanations the focus is on "the first game object utilizer (230*a*, 240*a*)," the same holds true for other game object utilizers.

There is a possibility that three-dimensional game objects (M1) on the first path (310*ac*) may move to the second supply path (241*a*, 251*a*) or the third position (P3) without passing through the first supply path (231*a*, 241*a*). There is also a possibility that three-dimensional game objects (M1) moving toward the third position (P3) may move to the third position (P3) without passing through the second supply path (241*a*, 251 *a*) due to the entry restricted state of the first game object utilizer (230*a*, 240*a*).

The movement destination of the three-dimensional game objects (M1) moving toward the third position (P3) can be either the third position (P3) or the second supply path (241*a*, 251*a*). In a preferred aspect of the present invention, the three-dimensional game objects (M1) moving toward the third position (P3) can enter the second supply path (241*a*, 251*a*) and then be supplied to the second game object utilizer (240*a*, 250*a*) in a case in which the second game object utilizer (240*a*, 250*a*) is not in the entry restricted state. On the other hand, in a case in which the second game object utilizer (240*a*, 250*a*) is in the entry restricted state, the three-dimensional game objects (M1) move to the third position (P3). That is, three-dimensional game objects (M1) that have not been supplied to any of the first game object utilizer (230*a*, 240*a*) and the second game object utilizer (240*a*, 250*a*) are returned to the first position (P1) through the third position (P3).

Appendix 5

The game apparatus (10) according to a preferred example of any of appendices 1 to 3 includes a first game field (110*a*) and a second game field (110*c*) configured to provide a first game and a second game in parallel to different players, respectively, and the game object utilizer (230*a*, 240*a*, 250*a*) includes a third game object utilizer (230*a*, 240*a*, 250*a*) that uses a part of the three-dimensional game objects (M1) in the first game provided in the first game field (110*a*), and a fourth game object utilizer (230*c*, 240*c*, 250*c*) that uses a part of the three-dimensional game objects (M1) in the second game provided in the second game field (110*c*), and the supply path (231*a*, 241 *a*, 251*a*) includes a third supply path (231*a*, 241*a*, 251*a*) for supply of the part of the three-dimensional game objects (M1) to the third game object utilizer (230*a*, 240*a*, 250*a*), and a fourth supply path (231*a*, 241*a*, 251*a*) for supply of the part of the three-dimensional game objects (M1) to the fourth game object utilizer (230*c*, 240*c*, 250*c*).

In the above configuration, the circulating mechanism (20*ac*) is shared by the first game field (110*a*) and the second game field (110*c*). Therefore, an advantage is obtained in that the configuration of the game apparatus (10) is simplified as compared to a configuration in which a separate circulating mechanism (20*ac*) is installed for each of the first game field (110*a*) and the second game field (110*c*). The circulating mechanism (20*ac*) is also shared by the third game object utilizer (230*a*, 240*a*, 250*a*) and the fourth game object utilizer (230*c*, 240*c*, 250*c*), where the third game object utilizer and the fourth game object utilizer correspond to different players. According to the above configuration, for example, even in a case in which many three-dimensional game objects (M1) are supplied to one of the first game field (110*a*) and the second game field (110*c*), uneven distribution of the three-dimensional game objects (M1) between the third game object utilizer (230*a*, 240*a*, 250*a*) and the fourth game object utilizer (230*c*, 240*c*, 250*c*) is suppressed. Therefore, an advantage is also obtained in that a mechanism for correcting uneven distribution of the three-dimensional game objects (M1) is not required.

A "game field" is a space for providing a player with a game in which the three-dimensional game objects (M1) are used. For example, a space for providing various games such as a pusher game in which the three-dimensional game objects (M1) are used is a preferred example of the game field.

"To provide games in parallel" means that a game using the first game field (110*a*) and a game using the second game field (110*c*) can progress in parallel. While the game using the first game field (110*a*) and the game using the second game field (110*c*) basically progress independently of each other, progression of the games may be related to each other.

Appendix 6

A game apparatus (10) according to a preferred aspect of the present invention is a game apparatus (10) for providing a game in which three-dimensional game objects (M1) that are rollable regardless of an orientation of the three-dimensional game objects (M1) are used, the game apparatus comprising: a first game field (110*a*) and a second game field (110*b*) configured to provide a first game and a second game in parallel to different players, respectively; a first circulating mechanism (20*ac*) corresponding to the first game field (110*a*); and a second circulating mechanism (20*bd*) corresponding to the second game field (110*b*). The three-dimensional game objects (M1) includes a first subset and a second subset. The first circulating mechanism (20*ac*) includes: a conveyor device (170*ac*) configured to transport the first subset of the three-dimensional game objects (M1) from a first position (P1) to a second position (P2) that is higher than the first position (P1); a first path (310*ac*) configured to move the first subset of the three-dimensional game objects (M1) from the second position (P2) to a third position (P3) that is lower than the second position (P2); a supply path (231*a*, 241*a*, 251*a*) for supply of a part of the first subset of the three-dimensional game objects (M1) to a game object utilizer (230*a*, 240*a*, 250*a*) that uses the supplied three-dimensional game objects (M1) in the first game, the part of the first subset of the three-dimensional game objects (M1) entering the supply path (231*a*, 241 *a*, 251*a*) at a position between the second position (P2) and the third position (P3); and a second path (340*ac*) configured to move a part of the three-dimensional game objects (M1) not entering the supply path (231*a*, 241*a*, 2511*a*) to the first position (P1) that is lower than the third position (P3). The second circulating mechanism (20*bd*) includes: a conveyor device (170*bd*) configured to transport the second subset of the three-dimensional game objects (M1) from a first position (P1) to a second position (P2) that is higher than the first position (P1); a first path (310*bd*) configured to move the second subset of the three-dimensional game objects (M1) from the second position (P2) to a third position (P3) that is lower than the second position (P2); a supply path (231*b*, 241*b*, 251*b*) for supply of a part of the second subset of the three-dimensional game objects (M1) to a game object utilizer (230*b*, 240*b*, 250*b*) that uses the supplied three-dimensional game objects (M1) in the second game, the part of the second subset of the three-dimensional game objects (M1) entering the supply path (231*b*, 241*b*, 251*b*) at a position between the second position (P2) and the third position (P3); and a second path (340*bd*) configured to move a part of the three-dimensional game objects (M1) not entering the supply path (231*b*, 241 *b*, 251*b*) to the first position (P1) that is lower than the third position (P3).

Appendix 7

A game apparatus (10) according to a preferred aspect of the present invention is a game apparatus (10) for providing a game in which three-dimensional game objects (M1) that are rollable regardless of an orientation of the three-dimensional game objects (M1) are used, the game apparatus comprising: a first game field (110*a*), a second game field (110*b*), a third game field (110*c*), and a fourth game field (110*d*), configured to provide a first game, a second game, a third game, and a fourth game in parallel to different players, respectively; a first circulating mechanism (20*ac*) corresponding to the first game field (110*a*) and the second game field (110*c*); and a second circulating mechanism (20*bd*) corresponding to the third game field (110*b*) and the fourth game field (110*d*). The three-dimensional game objects (M1) include a first subset and a second subset. The first circulating mechanism (20*ac*) includes: a conveyor device (170*ac*) configured to transport the first subset of the three-dimensional game objects (M1) from a first position (P1) to a second position (P2) that is higher than the first position (P1); a first path (310*ac*) configured to move the first subset of the three-dimensional game objects (M1) from the second position (P2) to a third position (P3) that is lower than the second position (P2); a supply path (231*a*, 241 *a*, 251*a*) for supply of a part of the first subset of the three-dimensional game objects (M1) to a game object utilizer (230*a*, 240*a*, 250*a*, 230*c*, 240*c*, 250*c*) that uses the supplied three-dimensional game objects (M1) in at least one of the first game or the second game, the part of the three-dimensional game objects (M1) entering the supply path (231*a*, 241*a*, 251*a*, 231 *c*, 241*c*, 251*c*) at a position between the second position (P2) and the third position (P3); and a second path (340*ac*) configured to move a part of the first subset of the three-dimensional game object (M1) not entering the supply path (231*a*, 241*a*, 251*a*, 231*c*, 241*c*, 251 *c*) to the first position (P1) that is lower than the third position (P3). The second circulating mechanism (20*bd*) includes: a conveyor device (170*bd*) configured to transport the second subset of the three-dimensional game objects (M1) from a first position (P1) to a second position (P2) that is higher than the first position (P1); a first path (310*bd*) configured to move the second subset of the three-dimensional game objects (M1) from the second position (P2) to a third position (P3) that is lower than the second position (P2); a supply path (231*b*, 241*b*, 251*b*, 231*d*, 241*d*, 251*d*) for supply of a part of the second subset of the three-dimensional game objects (M1) to a game object utilizer (230*b*, 240*b*, 250*b*, 230*d*, 240*d*, 250*d*) that uses the supplied three-dimensional game objects (M1) in at least one of the third game or the fourth game, the part of the second subset of the three-dimensional game objects (M1) entering the supply path (231*b*, 241*b*, 251 *b*, 231*d*, 241*d*, 251*d*) at a position between the second position (P2) and the third position (P3); and a second path (340*bd*) configured to move a part of the second subset of the three-dimensional game object (M1) not entering the supply path (2311*b*, 241*b*, 251*b*, 231*d*, 241*d*, 251*d*) to the first position (P1) that is lower than the third position (P3).

Appendix 8

A preferred example of appendix 6 or 7 includes a sorter (260) configured to sort a part of the first subset of the three-dimensional game objects (M1) not entering the supply path (231*a*, 241*a*, 251 *a*) of the first circulating mechanism (20*ac*), and a part of the second subset of the three-dimensional game objects (M1) not entering the supply path (231*a*, 241*a*, 251*a*) of the second circulating mechanism (20*bd*), into the second path (340*ac*) of the first circulating mechanism (20*ac*), and the second path (340*ac*) of the second circulating mechanism (20*bd*).

According to the above configuration, even in a case in which a number of three-dimensional game objects (M1) circulating in the first circulating mechanism (20*ac*) and a number of three-dimensional game objects (M1) circulating in the second circulating mechanism (20*bd*) temporarily differ from each other by a large amount, the respective numbers of game objects can be balanced out with time.

The "sorter (260)" is an element that sorts three-dimensional game objects (M1) into the second path (340*ac*) of the first circulating mechanism (20*ac*) and the second path (340*ac*) of the second circulating mechanism (20*bd*). Specifically, a member mounted at a point where a path on which three-dimensional game objects (M1) fall from the first path (310*ac*) of the first circulating mechanism (20*ac*) and a path on which three-dimensional game objects (M1) fall from the first path (310*bd*) of the second circulating mechanism (20*bd*) merge is a preferred example of the sorter (260). The probability of the three-dimensional game objects (M1) moving to the second path (340*ac*) of the first circulating mechanism (20*ac*) and the probability of them moving to the second path (340*ac*) of the second circulating mechanism (20*bd*) after having been brought into contact with the sorter (260) is substantially equal. That is, three-dimensional game objects (M1) are distributed proportionally to the second path (340*ac*) of the first circulating mechanism (20*ac*) and the second path (340*ac*) of the second circulating mechanism (20*bd*).

Appendix 9

In a preferred example of any of appendices 1 to 8, the conveyor device (170*ac*) has a plurality of transport paths configured to transport the three-dimensional game objects (M1) in parallel.

Appendix 10

In a preferred example of appendix 9, a total number of the game object utilizers (230*a*, 240*a*, 250*a*) is less than a total number of the plurality of transport paths.

Appendices A to C

Game apparatuses using three-dimensional game objects such as spherical objects have been proposed in the conventional art. For example, Japanese Patent Application Laid-Open Publication No. 2011-36423 discloses a conveyor device that includes a transport screw member having a helical blade portion formed thereon, and two guide rails that support the spherical objects in coordination with the blade portion.

In the technique described in Japanese Patent Application Laid-Open Publication No. 2011-36423, two guide rails are provided side by side at an interval smaller than the outer diameter of the spherical objects and the spherical objects are supported at a total of three positions including the blade portion of the transport screw member and the two guide rails. In the above configuration in which the interval of the two guide rails is smaller than the outside diameter of the spherical objects, spherical objects cannot be supplied to a transport rail that transports the spherical objects upward in the vertical direction through the interval of the two guide rails. Therefore, a drawback exists in that a special mechanism (a transport start rail portion) is required to guide the spherical objects to the transport rail, whereby the configuration of the conveyor device becomes complicated. In view of the above circumstances, an object of the aspects illustrated is to simplify a configuration for supplying three-dimensional game objects to a transport path.

Appendix A1

A conveyor device (170*ac*) according to a preferred aspect of the present invention includes: a reserver (1780) configured to reserve a plurality of three-dimensional game objects (M1); a supporter (1740) that extends in a helical manner along a rotation axis (C) and on which the plurality of three-dimensional game objects (M1) are placed; and a plurality of guides (1760) that are located outside the supporter (1740) and are spaced at intervals, each interval being larger than an outside diameter of each three-dimensional game object (M1), and that extend along the rotation axis (C). In this configuration, a transport path is formed for each of the plurality of guides (1760), where the transport path moves the three-dimensional game objects (M1) such that they are in contact with the supporter (1740) and with the guides (1760) from a lower side to an upper side in a vertical direction along the rotation axis (C) under rotation of the supporter (1740), and the plurality of three-dimensional game objects (M1) reserved in the reserver (1780) is supplied to the transport paths corresponding to respective ones of the plurality of guides (1760) and move upward.

In the above configuration, the interval between two guides (1760) adjacent to each other in the circumferential direction of the rotation axis (C) among the plurality of guides (1760) is larger than the outside diameter of the three-dimensional game object (M1). Thus, the three-dimensional game object (M1) is supplied to each of the transport paths through the corresponding two guides (1760), and the configuration for supplying the three-dimensional game objects (M1) to the transport paths can be simplified. Because the interval between two guides (1760) adjacent to each other is larger than the outside diameter of the three-dimensional game object (M1), each of the three-dimensional game objects (M1) moves along a guide (1760) in a state in which it is supported at two positions including the supporter (1740) and the guide (1760). Further, because one transport path is formed for each of the guides (1760), a further advantage is obtained in that many three-dimensional game objects (M1) reserved in the reserver (1780) can be efficiently transported by a plurality of transport paths.

The "three-dimensional game object (M1)" is a game object that has three dimensions. Specifically, an object that is rollable regardless of the orientation of the object is a preferred example of the three-dimensional game object (M1). For example, a spherical game object is a typical example of the three-dimensional game object (M1). However, other three-dimensional shapes such as a polyhedron are also usable for the three-dimensional game object (M1).

The state in which the guides (1760) "extend along the rotation axis (C)" is typically a state in which the guides (1760) extend in a direction parallel to the rotation axis (C). However, a configuration in which the guides (1760) are at an angle to the rotation axis (C) is also included in the scope of the present invention. The "outside diameter of the three-dimensional game object (M1)" is the diameter of a spherical object when the three-dimensional game object (M1) is a spherical object, and is the diameter of a spherical object circumscribing a polyhedron when the three-dimensional game object (M1) is a polyhedron.

As described above, each of the three-dimensional game objects (M1) is supported at two positions including the supporter (1740) and the guide (1760). However, a configuration in which each of the three-dimensional game objects (M1) can be brought into contact with other elements (for example, an encircling member in appendix A6) in addition to the two positions is not excluded from the present invention.

A plurality of guides (1760) need not be installed uniformly along the entire circumference of the supporter (1740), and may instead be installed only within a specific range along the circumferential direction of the supporter (1740). Further, the interval between the two guides (1760) adjacent to each other in the circumferential direction of the rotation axis (C) need not be uniform among all the guides (1760).

The upper limit of the interval between two guides (1760) adjacent to each other in the circumferential direction may be freely selected. For example, a configuration in which one three-dimensional game object (M1) can be housed between two guides (1760) (a configuration in which the interval between two guides (1760) is smaller than the sum of the outside diameters of two three-dimensional game objects (M1)) is included in the scope of the present invention. Also included in the scope of the present invention is a configuration in which two or more three-dimensional game objects (M1) can be housed between two guides (1760). It is of note that the interval between the two guides (1760) adjacent to each other in the circumferential direction of the rotation axis (C) is a distance in straight line therebetween.

Appendix A2

In a preferred example of appendix A1, a width of each of mount faces (F) of the supporter (1740) on which one of the three-dimensional game objects (M1) is placed is larger than a radius of the three-dimensional game object (M1).

In the above aspect, the width of each of the mount faces (F) for the three-dimensional game objects (M1) on the supporter (1740) is larger than the radius of the three-dimensional game object (M1). That is, the center of gravity of the three-dimensional game object (M1) is located above the mount face (F). Therefore, a possibility of the three-dimensional game objects (M1) falling from the mount faces (F) can be reduced.

The "width of each of mount faces (F)" is, for example, a difference between the outside diameter and the inside diameter of the helical supporter (1740). The "radius of the three-dimensional game object (M1)" is the radius of a spherical object when the three-dimensional game object (M1) is a spherical object, and is the radius of a spherical object circumscribing a polyhedron when the three-dimensional game object (M1) is a polyhedron.

Appendix A3

In a preferred example of appendix A1 or A2, each of the mount faces (F) of the supporter (1740) on which one of the three-dimensional game objects (M1) is placed slopes upward in a direction perpendicular to the rotation axis (C).

In the above aspect, because the mount faces (F) for the three-dimensional game objects (M1) on the supporter (1740) slope upward, the possibility of the three-dimensional game objects (M1) falling from the mount faces (F) can be reduced.

Appendix A4

In a preferred example of any of appendices A1 to A3, a support force acting on the three-dimensional game objects (M1) applied by the supporter (1740) decreases at an upper part of the transport paths.

In the above aspect, because the support force acting on the three-dimensional game objects (M1) applied by the supporter (1740) decreases at an upper part on the transport paths, the three-dimensional game objects (M1) can be discharged from the transport paths at that part.

Examples of a configuration for decreasing the support force acting on the three-dimensional game objects (M1) at a certain part on the transport paths include:

(1) a configuration in which the angle of the slope decreases at a certain part of the transport paths, where the mount faces (F) for the three-dimensional game objects (M1) on the supporter (1740) slope upward in a direction perpendicular to the rotation axis (C);

(2) a configuration in which the height of the protrusion (1741) decreases (or the protrusion (1741) is not formed) at a certain part of the transport paths, where the protrusion (1741) is formed on the outer periphery of each of the mount faces (F) for the three-dimensional game objects (M1) on the supporter (1740); and (3) a configuration in which the width of the mount faces (F) for the three-dimensional game objects (M1) on the supporter (1740) decreases at a certain part of the transport paths.

That the support force "decreases at an upper part on the transport paths" indicates that, when focusing on a first point on the transport paths and a second point higher than the first point, the support force acting at the second point is lower than that acting at the first point.

Appendix A5

A preferred example of any of appendices A1 to A4 includes a discharge guide (1771, 1790) configured to move the three-dimensional game objects (M1) transported by the transport path in a direction away from the rotation axis (C).

In the above aspect, the three-dimensional game objects (M1) transported by the transport path are moved in a direction away from the rotation axis (C) by the discharge guide (1771, 1790). That is, the three-dimensional game objects (M1) are discharged from the transport paths. Therefore, a possibility that the three-dimensional game objects (M1) remain on the transport paths to a greater extent than necessary can be reduced.

A specific mode of the "discharge guide (1771, 1790)" may be freely selected. For example, a slope (for example, a curved surface in the shape of a truncated cone) at an angle with respect to the direction of the rotation axis (C), or a protrusion located above the transport paths and coming into contact with (abutting on) the three-dimensional game objects (M1) is a specific example of the discharge guide (1771, 1790).

Appendix A6

A preferred example of any of appendices A1 to A5 includes an encircling member (1750) located on an opposite side across the plurality of guides (1760) relative to the supporter (1740), and an interval between an outer periphery of the supporter (1740) and the encircling member (1750) is smaller than the outside diameter of the three-dimensional game object (M1).

In the above aspect, because the encircling member (1750) is mounted on the opposite side across each of the guides (1760) relative to the supporter (1740), a possibility of the three-dimensional game objects (M1) falling from the supporter (1740) can be reduced.

While the encircling member (1750) is basically mounted at a position spaced from the guides (1760), the encircling member (1750) may be in contact with the guides (1760).

While a typical example of the encircling member (1750) is a tubular member encircling the supporter (1740) and the guides (1760), the encircling member (1750) may be of any specific shape. For example, the encircling member (1750) can be constituted by a plurality of elongated members along the rotation axis (C).

Appendix A7

In a preferred example of appendix A6, the three-dimensional game objects (M1) move through the transport paths while in contact with the supporter (1740), the guide (1760), and the encircling member (1750).

In the above aspect, because the three-dimensional game objects (M1) move while being in contact with the supporter (1740), the guide (1760), and the encircling member (1750), the three-dimensional game objects (M1) can be reliably transported by reducing a possibility of the three-dimensional game objects (M1) falling from the supporter (1740).

Although the three-dimensional game objects (M1) are in contact with the supporter (1740), the guide (1760), and the encircling member (1750), the three-dimensional game objects (M1) and the encircling member (1750) need not maintain contact with each other throughout the entire transport paths.

Appendix A8

In a preferred example of appendix A6 or A7, a gap between first end parts (E1) of two guides (1760) adjacent to each other in the circumferential direction of the rotation axis (C) is an intake port (1710) for supplying the three-dimensional game objects (M1) to each of the transport paths, where the first end parts (E1) is exposed from an end of the encircling member (1750) on a lower side of the transport paths.

In the above aspect, the three-dimensional game objects (M1) are taken into the transport paths through the intake ports (1710), each of which is a gap between the first end parts (E1) of two guides (1760) adjacent to each other in the circumferential direction, where the first end parts (E1) are exposed from an end (for example, a lower end) of the encircled member (1750). Therefore, the three-dimensional game objects (M1) can be supplied to the transport paths by use of a relatively simple configuration in which the first end parts (E1) of the guides (1760) are exposed from the encircling member (1750).

Appendix A9

In a preferred example of any of appendices A6 to A8, a gap between second end parts (E2) of two guides (1760) adjacent to each other in the circumferential direction of the rotation axis (C) is a discharge port (1720) for discharging the three-dimensional game objects (M1) from the transport path, where the second end parts (E2) are exposed from an end on an upper side of each of the transport paths in a direction of the rotation axis (C).

In the above aspect, the three-dimensional game objects (M1) are discharged from the transport paths through the discharge ports (1720), each of which is a gap between the second end parts (E2) of two guides (1760) adjacent to each other in the circumferential direction, where the second end parts (E2) are exposed from an end of the encircling member (1750). Therefore, the three-dimensional game objects (M1) can be discharged from the transport paths by use of a relatively simple configuration in which the second end parts (E2) of the guides (1760) are not covered by the encircling member (1750).

Appendix B1

A conveyor device (170*ac*) according to a preferred aspect of the present invention includes a supporter (1740) that extends in a helical manner along a rotation axis (C) and on which three-dimensional game objects (M1) are placed, and a plurality of guides (1760) that are located outside the supporter (1740) and are spaced from each other at intervals, each interval being larger than an outside diameter of each of the three-dimensional game objects (M1) and that extend along the rotation axis (C). By this configuration, there is formed for each of the plurality of guides (1760) a transport path configured to move the three-dimensional game objects (M1) along the rotation axis (C) while being in contact with the supporter (1740) and the guides (1760) with rotation of the supporter (1740), and a plurality of intake ports (1710) are provided for supplying the three-dimensional game objects (M1) to the transport paths, each intake port being constituted by a corresponding interval between two guides (1760) adjacent to each other in the circumferential direction of the rotation axis (C) among the plurality of guides (1760).

In the above configuration, the intake ports (1710) for supply of the three-dimensional game objects (M1) to the transport paths are formed, where each of the intake ports (1710) is a gap between two guides (1760) adjacent to each other in the circumferential direction of the rotation axis (C). That is, the guides (1760) for moving the three-dimensional game objects (M1) along the rotation axis (C) are also used to form the intake ports (1710). Therefore, the configuration of the conveyor device (170*ac*) can be simplified as compared to a configuration in which the three-dimensional game objects (M1) are supplied to the transport paths by a mechanism different from the guides (1760). Further, because the number of intake ports (1710) corresponding to a total number of intervals each constituted by a combination of two guides (1760) are formed, many three-dimensional game objects (M1) can be taken in parallel from the intake ports (1710) and many three-dimensional game objects (M1) can be transported in parallel by the transport paths.

Typically, the intake ports (1710) are formed at an end (for example, the lower end) of the supporter (1740). However, a configuration in which the intake ports (1710) are formed in the middle of the supporter (1740) in addition to the end (or instead of the end) is also included in the scope of the invention.

Appendix B2

In a preferred example of appendix B1, the three-dimensional game objects (M1) are rollable regardless of an orientation of the three-dimensional game objects (M1), and a supplier (1780) having a slope (1781) that allows the three-dimensional game objects (M1) to roll toward each of the plurality of intake ports (1710) formed thereon is included.

In the above configuration, because the slope (1781) that allows the three-dimensional game objects (M1) to roll toward each of the intake ports (1710) is formed on the supplier (1780), many three-dimensional game objects (M1) can be efficiently supplied to the transport paths.

The "slope (1781)" is a flat surface, a curved surface, or a combination thereof. Further, "rollable regardless of the orientation" means that the three-dimensional game objects (M1) have a shape that enables rolling in any orientation under the action of an external force. For example, a spherical object is a typical example of a shape that is "rollable regardless of the orientation." However, a polyhedron close to a spherical object is also included in the shapes that is "rollable regardless of the orientation." On the other hand, a disk-shaped object such as a medal does not roll in an orientation with the flat, back side or front side down, but rolls when it is in a vertical orientation with the circular side (i.e., edge) down in contact with a rolling surface. Therefore, the disk-shaped object does not satisfy the condition that an object is "rollable regardless of the orientation."

Appendix B3

In a preferred example of appendix B2, the slope (1781) is a curved surface extending all around the rotation axis (C).

In the above configuration, because the slope (1781) of the supplier (1780) extends all around the rotation axis (C), the three-dimensional game objects (M1) are supplied to the intake ports (1710) in all directions around the rotation axis (C). Therefore, the effect described above that many three-dimensional game objects (M1) can be efficiently supplied to each of the transport paths is of notable significance.

The "slope (1781)" can be either linear or curved in a cross section including the rotation axis (C). For example, a curved surface having the inside diameter continuously decreasing at a position closer to the intake ports (1710) as the side surface of a truncated cone or a concave (for example, basin-like) curved surface is a typical example of the slope (1781).

Appendix B4

In a preferred example of appendix B2 or B3, a maximum angle of the slope (1781) with respect to a horizontal plane is 20° or smaller.

In the above configuration, because the angle of the slope (1781) is suppressed to 200 or smaller, three-dimensional game objects (M1) are sequentially supplied to the transport paths without overlapping each other. Therefore, occurrence of a phenomenon (a bridge phenomenon) in which three-dimensional game objects (M1) are clogged near the intake ports (1710) can be suppressed. The angle of the slope (1781) to the horizontal plane may vary along the slope (1781).

Appendix B5

In a preferred example of any of appendices B2 to B4, a first guide (51) configured to guide the three-dimensional game objects (M1) to some or all of the plurality of intake ports (1710) is formed on the slope (1781).

In the above configuration, because the three-dimensional game objects (M1) are guided on the slope (1781) by the first guide (51) to the intake ports (1710), the three-dimensional game objects (M1) can be efficiently supplied to the intake ports (1710). A portion that can regulate the direction of rolling of the three-dimensional game objects (M1) suffices as the first guide (51), and the first guide (51) is typically a protrusion or a groove formed on the slope (1781).

Appendix B6

In a preferred example of appendix B5, the first guide (51) guides the three-dimensional game objects (M1) in a manner such that a plurality of the three-dimensional game objects (M1) is arrayed toward the intake ports (1710).

In the above configuration, because the three-dimensional game objects (M1) are guided in a manner such that a plurality of the three-dimensional game objects (M1) is arrayed toward the intake ports (1710), occurrence of clogging (the bridge phenomenon) due to concentration of many three-dimensional game objects (M1) on a narrow path can be suppressed. Although the first guide (51) may be of any specific configuration, a path with a width smaller than two outside diameters of the three-dimensional game objects (M1) is a preferred example of the first guide (51) as a configuration for arraying a plurality of the three-dimensional game objects (M1) toward the intake ports (1710).

Appendix B7

A conveyor mechanism (170*ac*, 340*ac*) according to a preferred aspect of the present invention includes: the conveyor device (170*ac*) of any of appendices B2 to B6; a path (340*ac*) on which the three-dimensional game objects (M1) supplied to the supplier (1780) move; and a regulator (52, 53) configured to regulate movement of the three-dimensional game objects (M1) to be supplied to the supplier (1780) or to the path (340*ac*).

In the above configuration, because the three-dimensional game objects (M1) to be supplied from the path (340*ac*) to the supplier (1780) are regulated by the regulator (52, 53), the three-dimensional game objects (M1) can be preferentially supplied to specific intake ports (1710) among a plurality of intake ports (1710).

The "regulator (52, 53)" can be placed on either the supplier (1780) or the path (340*ac*). For example, the entire regulator (52, 53) can be formed on either the path (340*ac*) or the supplier (1780). Alternatively, a part of the regulator (52, 53) may be formed on the path (340*ac*) and another part of the regulator (52, 53) may be formed on the supplier (1780).

Appendix B8

In a preferred example of appendix B7, the regulator (52, 53) includes a second guide (52) configured to guide the three-dimensional game objects (M1) traveling toward the supplier (1780) to lateral sides of the supporter (1740).

In the above configuration, because the three-dimensional game objects (M1) are guided by the second guide (52) to the lateral sides of the supporter (1740), the three-dimensional game objects (M1) can be preferentially supplied to intake ports (1710) formed at positions from the lateral sides to the back side of the supporter (1740), as viewed from the path (340*ac*) (that is, on the opposite side of the path (340*ac*) relative to the supporter (1740)).

Appendix B9

In a preferred example of appendix B8, the second guide (52) guides the three-dimensional game objects (M1) traveling toward the supplier (1780) to intake ports (1710) on an opposite side of the supporter (1740) relative to the path (340*ac*) without traveling directly to intake ports (1710) on a side of the path (340*ac*) as viewed from the supporter (1740) among the plurality of intake ports (1710).

In a configuration that does not include any special feature for regulating movement of the three-dimensional game objects (M1), the three-dimensional game objects (M1) are likely to be supplied to intake ports (1710) on the path (340*ac*) side as viewed from the supporter (1740) among the plurality of intake ports (1710). According to the configuration in which the second guide (52) guides the three-dimensional game objects (M1) not to directly travel to intake ports (1710) on the path (340*ac*) side but to travel toward intake ports (1710) on the opposite side, the possibility of concentration of many three-dimensional game objects (M1) on intake ports (1710) on the path (340*ac*) side can be reduced.

Appendix B10

In a preferred example of any of appendices B7 to B9, the regulator (52, 53) includes a third guide (53) configured to guide the three-dimensional game objects (M1) toward intake ports (1710) on an opposite side of the supporter (1740) relative to the path (340*ac*).

According to the above configuration, the three-dimensional game objects (M1) can be preferentially supplied to intake ports (1710) on the opposite side to the path (340*ac*) among the plurality of intake ports (1710).

Appendix B11

In a preferred example of appendix B10, the third guide (53) is formed with a height that allows the three-dimensional game objects (M1) to move beyond the third guide (53) due to pushing by other three-dimensional game objects (M1).

As described above, according to the configuration in which the third guide (53) is mounted, three-dimensional game objects (M1) are preferentially supplied to, among the plurality of intake ports (1710), intake ports (1710) that are on the opposite side of the supporter (1740) relative to the path (340*ac*). However, if too many three-dimensional game objects (M1) are concentrated at the intake ports (1710) on the opposite side to the path (340*ac*), defects such as clogging of three-dimensional game objects (M1) may occur. According to the configuration in which three-dimensional game objects (M1) are able to move beyond the third guide (53), three-dimensional game objects (M1) from the path (340*ac*) move beyond the third guide (53) and are supplied to intake ports (1710) on the path (340*ac*) side when three-dimensional game objects (M1) excessively concentrate at the intake ports (1710) on the opposite side to the path (340*ac*). Therefore, excessive concentration of three-dimensional game objects (M1) can be suppressed.

Appendix B12

In a preferred example of any of appendices B7 to B9, the regulator (52, 53) includes a third guide (53) configured to guide the three-dimensional game objects (M1) toward the intake ports (1710), and the third guide (53) is formed with a height that allows the three-dimensional game objects (M1) to move beyond the third guide (53) due to pushing by other three-dimensional game objects (M1).

Appendix C1

A conveyor device (170*ac*) according to a preferred aspect of the present invention includes: a supporter (1740) that extends in a helical manner along the rotation axis (C) and on which three-dimensional game objects (M1) are placed; and a plurality of guides (1760) that are located outside the supporter (1740) and are spaced at intervals, with each interval being larger than an outside diameter of each three-dimensional game object (M1) and that extend along the rotation axis (C). In this configuration, a transport path is formed for each of the plurality of guides (1760), wherein the transport path moves the three-dimensional game objects (M1) in contact with the supporter (1740) and the guides (1760) along the rotation axis (C) due to rotation of the supporter (1740), and a plurality of discharge ports (1720) for discharging the three-dimensional game objects (M1) from the transport paths are formed. Each of the discharge ports (1720) consists of a gap between two guides (1760) adjacent to each other in a circumferential direction of the rotation axis (C) among the plurality of guides (1760).

In the above configuration, the discharge ports (1720) for discharging the three-dimensional game objects (M1) from the transport paths are formed, where each of the discharge ports (1720) consists of a gap between two guides (1760) adjacent to each other in the circumferential direction of the rotation axis (C). That is, the guides (1760) for moving the three-dimensional game objects (M1) along the rotation axis (C) are also used for formation of the discharge ports (1720). Therefore, the configuration of the conveyor device (170*ac*) can be simplified as compared to a configuration in which the three-dimensional game objects (M1) are discharged from the transport paths by use of a mechanism different from the guides (1760).

Typically, the discharge ports (1720) are formed at an end (for example, the upper end) of the supporter (1740). However, a configuration including the discharge ports (1720) formed in the middle of the supporter (1740) in addition to the end (or in place of the end) is also included in the scope of the invention.

Appendix C2

A preferred example of appendix C1 includes a discharge guide (1771, 1790) configured to move the three-dimensional game objects (M1) transported by the transport paths in directions away from the rotation axis (C).

In the above aspect, the three-dimensional game objects (M1) transported by the transport paths are moved by the discharge guide (1771, 1790) in directions away from the rotation axis (C). That is, the three-dimensional game objects (M1) are discharged from the transport paths. Therefore, a possibility that the three-dimensional game object (M1) will stay on the transport paths for longer than necessary can be reduced.

A specific mode of the "discharge guide (1771, 1790)" can be freely selected. For example, a slope (for example, a curved surface in the shape of a truncated cone) at an angle to the direction of the rotation axis (C) or a protrusion mounted in a downstream of the transport paths and abutting on the three-dimensional game objects (M1) is a specific example of the discharge guide (1771, 1790).

Appendix C3

In a preferred example of appendix C1 or C2, a support force on the three-dimensional game objects (M1) applied by the supporter (1740) decreases near the discharge ports (1720) on the transport paths.

In the above aspect, because the support force on the three-dimensional game objects (M1) applied by the supporter (1740) decreases near the discharge ports (1720), the three-dimensional game objects (M1) can be efficiently discharged from the discharge ports (1720).

Appendix D

For example, as disclosed in Japanese Patent Application Laid-Open Publication No. 2013-99632, a pusher game apparatus that moves disk-shaped token coins fed in a game field has been proposed. A lift hopper or the like that moves the token coins along a rail is used to transport the token coins to a feeding portion in the pusher game apparatus.

Elements (hereafter, "game object utilizers") that use game objects such as token coins are provided in a game apparatus. In a case where a special mechanism that supplies game objects to each of the game object utilizers with a predetermined ratio in the number is provided, a problem arises in that the configuration of the game apparatus becomes complex. In view of the above circumstances, a preferred aspect (appendix D) of the present invention has as an object sorting of the game objects into the game object utilizers without need of a special mechanism.

Appendix D1

A conveyor mechanism according to a preferred aspect of the present invention includes: a conveyor device (170*ac*) configured to transport a plurality of three-dimensional game objects (M1) and discharge the plurality of three-dimensional game objects (M1) from each of a plurality of discharge ports (1720); and a plurality of game object utilizers (230*a*, 240*a*, 250*a*) configured to use the three-dimensional game objects (M1) discharged from each of the plurality of discharge ports (1720), and first discharge ports (1720A) among the plurality of discharge ports (1720) discharge the three-dimensional game objects (M1) in a direction toward a first game object utilizer (230*a*, 240*a*) from among the plurality of game object utilizers (230*a*, 240*a*, 250*a*), second discharge ports (1720B) different from the first discharge ports (1720A) from among the plurality of discharge ports (1720) discharge the three-dimensional game objects (M1) in a direction toward a second game object utilizer (240*a*, 250*a*) different from the first game object utilizer (230*a*, 240*a*) from among the plurality of game object utilizers (230*a*, 240*a*, 250*a*), and the number of the three-dimensional game objects (M1) discharged from the first discharge ports (1720A) to the first game object utilizer (230*a*, 240*a*) and the number of the three-dimensional game objects (M1) discharged from the second discharge ports (1720B) to the second game object utilizer (240*a*, 250*a*) are different.

In the above configuration, the three-dimensional game objects (M1) transported by the conveyor device (170*ac*) are discharged in a direction from the first discharge ports (1720A) to the first game object utilizer (230*a*, 240*a*), and are discharged in a direction from the second discharge ports (1720B) to the second game object utilizer (240*a*, 250*a*). Therefore, the three-dimensional game objects (M1) transported by the conveyor device (170*ac*) can be sorted into the game object utilizers (230*a*, 240*a*, 250*a*) without need of a special mechanism to change the discharge direction of the transported three-dimensional game objects (M1). Because the number of the three-dimensional game objects (M1) supplied from the first discharge ports (1720A) to the first game object utilizer (230*a*, 240*a*) and the number of the three-dimensional game objects (M1) supplied from the second discharge ports (1720B) to the second game object utilizer (240*a*, 250*a*) are different, the ratio between the number of the three-dimensional game objects (M1) supplied to the first game object utilizer (230*a*, 240*a*) and the number of the three-dimensional game objects (M1) supplied to the second game object utilizer (240*a*, 250*a*) a predetermined value of the number of objects supplied can be approximated.

"Discharging the three-dimensional game objects (M1) in a direction toward a first game object utilizer (230*a*, 240*a*)" means discharging the three-dimensional game objects (M1) to be preferentially supplied to the first game object utilizer (230*a*, 240*a*) among the game object utilizers (230*a*, 240*a*, 250*a*), and includes, for example, discharging the three-dimensional game objects (M1) in a direction of a supply path (231*a*, 241 *a*, 251*a*) corresponding to the first game object utilizer (230*a*, 240*a*). The above description does not exclude supply of the three-dimensional game objects (M1) to a game object utilizer (230*a*, 240*a*, 250*a*), alternatively to supply to the first game object utilizer (230*a*, 240*a*). For example, even in a case in which the three-dimensional game objects (M1) are discharged from the first discharge ports (1720A) in a direction toward the first game object utilizer (230*a*, 240*a*), the three-dimensional game objects (M1) can further move without being supplied to the first game object utilizer (230*a*, 240*a*), and can be supplied to another game object utilizer (230*a*, 240*a*, 250*a*) in a state in which entry of three-dimensional game objects (M1) to the first game object utilizer (230*a*, 240*a*) is restricted (an entry restricted state). The conveyor device (170*ac*) transports, for example, the three-dimensional game objects (M1) through each of a plurality of transport paths corresponding to different discharge ports (1720). However, one transport path may be shared by a plurality of discharge ports (1720). That is, three-dimensional game objects (M1) transported by one transport path are discharged from a plurality of discharge ports (1720).

Appendix D2

In a preferred example of appendix D1, a total number of the game object utilizers (230*a*, 240*a*, 250*a*) is less than a total number of the discharge ports (1720), and the number of the first discharge ports (1720A) differs from the number of the second discharge ports (1720B).

In the above configuration, because the number of the first discharge ports (1720A) and the number of the second discharge ports (1720B) are different, the number of three-dimensional game objects (M1) supplied to the first game object utilizer (230*a*, 240*a*) and the number of three-dimensional game objects (M1) supplied to the second game object utilizer (240*a*, 250*a*) can also be made different.

Appendix D3

In a preferred example of appendix D1 or D2, a size of an opening of a supply path (231*a*, 241*a*, 251*a*) for the three-dimensional game objects (M1) to the first game object utilizer (230*a*, 240*a*) and a size of an opening of a communication path (313) to which the three-dimensional game objects (M1) discharged from the second discharge ports (1720B) travel are different.

In the above configuration, because the size of the opening of the supply path (231*a*, 241 *a*, 251*a*) for the three-dimensional game objects (M1) to the first game object utilizer (230*a*, 240*a*) and the size of the opening of the communication path (313) to which the three-dimensional game objects (M1) discharged from the second discharge ports (1720B) travel are different, the number of three-dimensional game objects (M1) supplied to the first game object utilizer (230*a*, 240*a*) and the number of three-dimensional game objects (M1) supplied to the second game object utilizer (240*a*, 250*a*) can be made different. It is of note that the size of the opening of the supply path (231*a*, 241 *a*, 251*a*) for the three-dimensional game objects (M1) to the first game object utilizer (230*a*, 240*a*) and the size of the opening of the supply path (231*a*, 241*a*, 2511*a*) for the three-dimensional game objects (M1) to the second game object utilizer (240*a*, 250*a*) may be made different.

The number of the supply paths (231*a*, 241*a*, 251*a*) for the three-dimensional game object (M1) to each of the game object utilizers (230*a*, 240*a*, 250*a*) is not limited to one. In a configuration in which a plurality of supply paths (231*a*, 241*a*, 251*a*) are formed for the game object utilizer (230*a*, 240*a*, 250*a*), the "size of the opening of the supply path (231*a*, 241*a*, 251*a*)" corresponding to the game object utilizer (230*a*, 240*a*, 250*a*) may be interpreted as the sum of the sizes of the openings of the plurality of supply paths (231*a*, 241*a*, 251*a*). The number of the communication paths (313) also is not limited to one. In a configuration in which a plurality of communication paths (313) are formed, the "size of the opening of the communication path (313)" can be interpreted as the sum of the sizes of the openings of the plurality of communication paths (313).

The size of the opening of the supply path (231*a*, 241 *a*, 251*a*) refers to the area of an opening to which the three-dimensional game objects (M1) enter on the supply path (231*a*, 241*a*, 251*a*). Similarly, the size of the opening of the communication path (313) refers to the area of an opening to which the three-dimensional game objects (M1) enter on the communication path (313).

Appendix D4

In a preferred example of appendix D3, the opening of the supply path (231*a*, 241*a*, 251*a*) for the three-dimensional game objects (M1) to the first game object utilizer (230*a*, 240*a*) is larger than the opening of the supply path (231*a*, 241 *a*, 251*a*) for the three-dimensional game objects (M1) to the second game object utilizer (240*a*, 250*a*).

According to the above configuration, the three-dimensional game objects (M1) can be supplied preferentially to the first game object utilizer (230*a*, 240*a*).

Appendix D5

In a preferred example of any of appendices D1 to D4, the three-dimensional game objects (M1) discharged in a direction from the first discharge ports (1720A) to the first game object utilizer (230*a*, 240*a*) move toward the second game object utilizer (240*a*, 250*a*) in a case in which the first game object utilizer (230*a*, 240*a*) is in an entry restricted state.

In the above configuration, the three-dimensional game objects (M1) move toward the second game object utilizer (240*a*, 250*a*) away from the first game object utilizer (230*a*, 240*a*) in a case in which the first game object utilizer (230*a*, 240*a*) is in the entry restricted state. Thus, the three-dimensional game objects (M1) discharged from the conveyor device (170*ac*) can be effectively used.

The three-dimensional game objects (M1) that have moved from the first game object utilizer (230*a*, 240*a*) toward the second game object utilizer (240*a*, 250*a*) do not actually need to be supplied to the second game object utilizer (240*a*, 250*a*). For example, in a case in which the second game object utilizer (240*a*, 250*a*) is in the entry restricted state, the three-dimensional game objects (M1) move further away from the second game object utilizer (240*a*, 250*a*) toward another location (for example, another game object utilizer).

Appendix D6

In a preferred example of appendix D4 or D5, the supply path (231*a*, 241 *a*, 251*a*) for the three-dimensional game objects (M1) to the first game object utilizer (230*a*, 240*a*) is located at a higher position than the supply path (231*a*, 241 *a*, 251*a*) for the three-dimensional game objects (M1) to the second game object utilizer (240*a*, 250*a*).

According to the above configuration, the three-dimensional game objects (M1) can be easily moved from the first game object utilizer (230*a*, 240*a*) to the second game object utilizer (240*a*, 250*a*) in a case in which the first game object utilizer (230*a*, 240*a*) is in the entry restricted state.

Appendix D7

A conveyor mechanism according to a preferred aspect of the present invention includes: a conveyor device (170*ac*) configured to transport a plurality of three-dimensional game objects (M1) and discharge the plurality of three-dimensional game objects (M1) from each of a plurality of discharge ports (1720); and a plurality of game object utilizers (230*a*, 240*a*, 250*a*) configured to use the three-dimensional game objects (M1) discharged from each of the plurality of discharge ports (1720), where first discharge ports (1720A) among the plurality of discharge ports (1720) discharge the three-dimensional game objects (M1) in a direction toward a first game object utilizer (230*a*, 240*a*) among the plurality of game object utilizers (230*a*, 240*a*, 250*a*), and second discharge ports (1720B) different from the first discharge ports (1720A) among the plurality of discharge ports (1720) discharge the three-dimensional game objects (M1) in a direction toward a second game object utilizer (240*a*, 250*a*) different from the first game object utilizer (230*a*, 240*a*) among the plurality of game object utilizers (230*a*, 240*a*, 250*a*).

Appendix E

For example, as disclosed in Japanese Patent Application Laid-Open Publication No. 2013-99632, disclosed in the art is a pusher game apparatus that moves disk-shaped token coins fed in a game field. A lift hopper or the like that moves the token coins along a rail is used to transport the token coins to a feeding portion in the pusher game apparatus.

Also assumed is use of game objects (for example, spherical game objects) that are rollable regardless of an orientation of the game objects, instead of token coins used in conventional pusher game apparatuses. In a configuration using three-dimensional game objects, a mechanism suitable for transporting the three-dimensional game objects is required in place of the lift hopper that transports the token coins. In view of these circumstances, a preferred aspect (appendix E) of the present invention has as an object provision of a technique that enables efficient transport of three-dimensional game objects.

Appendix E1

A game apparatus (10) according to a preferred aspect of the present invention includes; a game field (110*a*) configured to provide a game in which three-dimensional game objects (M1) that are rollable regardless of an orientation of the three-dimensional game objects (M1) are used; a physical lottery portion (120*a*, 130*a*, 140*ab*) configured to perform a physical lottery; a path (310*ac*) configured to move the three-dimensional game objects (M1), the path including a first supply path (231*a*, 241*a*) and a second supply path (241*a*, 251*a*); a first game object utilizer (230*a*, 240*a*) configured to use, of the three-dimensional game objects (M1), a part that enters from the first supply path (231*a*, 241*a*) for a physical lottery performed by the physical lottery portion (120*a*, 130*a*, 140*ab*); and a second game object utilizer (240*a*, 250*a*) configured to use, of the three-dimensional game objects (M1), a part that enters from the second supply path (241*a*, 251*a*) for the game in the game field (110*a*).

According to the above configuration, three-dimensional game objects (M1) rolling on the path (310*ac*) are also used in the game in the game field (110*a*) and a physical lottery. Therefore, there is no need to separately install a mechanism that supplies game objects to the game field (110*a*) and a mechanism that supplies game objects to the physical lottery portion (120*a*, 130*a*, 140*ab*). As a result, a configuration of the game apparatus (10) can be simplified.

The "physical lottery" is a physical lottery in which the three-dimensional game objects (M1) are used. Specifically, a preferred example of the physical lottery is processing of determining winning of a prize when a three-dimensional game object (M1) passes through a specific one of the discharge paths, by use of a physical lottery portion (120*a*, 130*a*, 140*ab*) (distributer or accessory) that includes a rolling surface on which three-dimensional game objects (M1) roll, and a plurality of discharge paths through which the three-dimensional game objects (M1) are able to pass.

The "game field (110*a*)" is a space that provides a player with a game in which the three-dimensional game objects (M1) are used. For example, a preferred example of the game field (110*a*) is a space in which various games are provided, such games including a pusher game in which the three-dimensional game objects (M1) are used.

The "path (310*ac*)" has, for example, a slope that allows three-dimensional game objects (M1) to roll. While being typically a flat surface, the slope can include a curved surface having the slope angle changing on the path (310*ac*). A step may be included in the middle of the path (310*ac*). It is of note that a slope that allows three-dimensional game objects (M1) to roll under their own weight is not essential, for example, if the three-dimensional game objects (M1) can move on the path (310*ac*) using kinetic energy provided by a specific mechanism. There is also assumed a configuration in which the path (310*ac*) includes a first part on which the first supply path (231*a*, 241*a*) is located and a second part on which the second supply path (241*a*, 251*a*) is located, and in which one of the first part and the second part is a slope, and the other is a horizontal surface.

Appendix E2

A preferred example of appendix E1 includes a conveyor device (170*ac*) configured to collect from among the three-dimensional game objects (M1) those used by the first game object utilizer (230*a*, 240*a*) in the physical lottery, and those used by the second game object utilizer (240*a*, 250*a*) in the game, and to transport the collected three-dimensional game objects (M1) upstream of the path (310*ac*).

According to the above configuration, three-dimensional game objects (M1) used in a game and three-dimensional game objects (M11) used in a physical lottery can be transported upstream of the path (310*ac*) to enable reuse thereof.

A configuration to "collect the three-dimensional game objects (M1) and to transport the collected three-dimensional game objects (M1) upstream of the path (310*ac*)" includes not only a configuration that transports all three-dimensional game objects (M1) collected after having been used, upstream of the path (310*ac*), but also a configuration that transports only some of the collected three-dimensional game objects (M1) upstream of the path (310*ac*). For example, three-dimensional game objects (M1) not transported to the upstream of the path (310*ac*) among the three-dimensional game objects (M1) collected after having been used may be used in other game object utilizers.

Appendix E3

In a preferred example of appendix E1 or E2, the second game object utilizer (240*a*, 250*a*) uses the three-dimensional game objects (M1) of the number determined according to a progress status of the game, for the physical lottery.

Appendix E4

In a preferred example of any of appendices E1 to E3, the second supply path (241*a*, 251*a*) is positioned downstream of the first supply path (231*a*, 241*a*) on the path (310*ac*), and the number of the three-dimensional game objects (M1) used in the game by the first game object utilizer (230*a*, 240*a*) is greater than the number of the three-dimensional game objects (M1) used in the physical lottery by the second game object utilizer (240*a*, 250*a*).

According to the above configuration, the second supply path (241*a*, 251*a*) is positioned downstream of the first supply path (231*a*, 241*a*) on the path (310*ac*). Therefore, the three-dimensional game objects (M1) can be used preferentially for the game by the first game object utilizer (230*a*, 240*a*) over the physical lottery by the second game object utilizer (240*a*, 250*a*).

Appendix F

For example, as disclosed in Japanese Patent Application Laid-Open Publication No. 2013-99632, disclosed in the art is a pusher game apparatus that moves disk-shaped token coins fed in a game field. A lift hopper or the like that moves the token coins along a rail is used to transport the token coins to a feeding portion in the pusher game apparatus.

Also assumed is use of game objects (for example, spherical game objects) that are rollable regardless of an orientation of the game objects, in place of token coins used in conventional pusher game apparatuses. In a configuration in which three-dimensional game objects are used, a mechanism suitable for transporting the three-dimensional game objects is required in place of the lift hopper that transports the token coins. In view of these circumstances, a preferred aspect (appendix F) of the present invention has as its object provision of a technique that enables efficient transport of three-dimensional game objects.

Appendix F1

A game apparatus (10) according to a preferred aspect of the present invention is a game apparatus (10) for providing a game in which three-dimensional game objects (M1) that are rollable regardless of an orientation of the three-dimensional game objects (M1) are used, the game apparatus comprising: a path (310*ac*) configured to roll the three-dimensional game objects (M1), the path (310*ac*) including a first supply path (231*a*, 241*a*) and a second supply path (241*a*, 251*a*) positioned downstream of the first supply path (231*a*, 241*a*); a first game object utilizer (230*a*, 240*a*) configured to reserve and use a part of the three-dimensional game objects (M1), the part entering from the first supply path (231*a*, 241*a*); and a second game object utilizer (240*a*, 250*a*) configured to use a part of the three-dimensional game objects (M1), the part entering from the second supply path (241*a*, 251*a*), and three-dimensional game objects (M1) rolling on the path (310*ac*) enter the first supply path (231*a*, 241*a*) in a case in which the first game object utilizer (230*a*, 240*a*) is not in an entry restricted state, and roll toward the second supply path (241*a*, 251*a*) away from the first supply path (231*a*, 241*a*) in a case in which the first game object utilizer (230*a*, 240*a*) is in an entry restricted state.

In the above configuration, three-dimensional game objects (M1) rolling on the path (310*ac*) can enter the first supply path (231*a*, 241*a*), and those of the three-dimensional game objects (M1) that enter the first supply path (231*a*, 241*a*) are reserved for use by the first game object utilizer (230*a*, 240*a*). In a case in which the first game object utilizer (230*a*, 240*a*) is in the entry restricted state, the three-dimensional game objects (M1) roll toward the second supply path (241*a*, 251*a*). Thus, the three-dimensional game objects (M1) can accordingly be preferentially supplied to the first game object utilizer (230*a*, 240*a*) over the second game object utilizer (240*a*, 250*a*).

In some cases, the three-dimensional game objects (M1) on the path (310*ac*) may roll toward the second supply path (241*a*, 251*a*) without passing through the first supply path (231*a*, 241*a*).

The term "downstream" refers to a direction in which the three-dimensional game objects (M1) may move. For example, in a configuration in which the path (310*ac*) includes a slope, a low-level side of the slope is "downstream." That is, the second supply path (241*a*, 251*a*) is positioned lower than the first supply path (231*a*, 241*a*).

Appendix F2

In a preferred example of appendix F1, the second game object utilizer (240*a*, 250*a*) reserves a part of the three-dimensional game objects (M1), the part entering from the second supply path (241*a*, 251*a*).

In the above configuration, when the first game object utilizer (230*a*, 240*a*) is full, the three-dimensional game objects (M1) are reserved in the second game object utilizer (240*a*, 250*a*). That is, the three-dimensional game objects (M1) can be reserved preferentially in the first game object utilizer (230*a*, 240*a*) over the second game object utilizer (240*a*, 250*a*).

Appendix F3

A preferred example of appendix F1 or F2 includes a guide mounted on the path (310*ac*) and configured to guide the three-dimensional game objects (M1) to the first supply path (231*a*, 241*a*).

In the above configuration, the guide is mounted on the path (310*ac*), and an effect thereby obtained of preferential reservation of the three-dimensional game objects (M1) in the first game object utilizer (230*a*, 240*a*) is remarkable.

Appendix G

For example, as disclosed in Japanese Patent Application Laid-Open Publication No. 2013-99632, a pusher game apparatus that moves disk-shaped token coins fed in a game field has been conventionally proposed.

In the conventional pusher game apparatus, token coins are merely stacked in the game field and there is room for improvement from the viewpoint of sufficiently providing a visual production effect. A preferred aspect (appendix G) of the present invention is a configuration provided in view of the above circumstances.

Appendix G1

A game apparatus (10) according to a preferred aspect of the present invention includes: a feeding portion (461*a*) configured to feed a plurality of three-dimensional game objects (M1) that are rollable regardless of an orientation of the three-dimensional game objects (M1), a mount portion (44) including a first face (Q1) on which the plurality of three-dimensional game objects (M1) fed by the feeding portion (461*a*) are placed; and a discharger (446) configured to discharge the plurality of three-dimensional game objects (M1) placed on the mount portion (44), and the plurality of three-dimensional game objects (M1) fed by the feeding portion (461*a*) in a first state where the first face (Q1) is sloped with respect to a horizontal plane are arrayed in a single layer along the first face (Q1), and the three-dimensional game objects (M1) placed on the mount portion (44) in a second state where an angle of the first face (Q1) is changed from that in the first state roll to a low-level side of the first face (Q1), and are supplied to the discharger (446).

In the above configuration, three-dimensional game objects (M1) are arrayed in a single layer along the first face (Q1). Therefore, a state in which many three-dimensional game objects (M1) are placed on the first face (Q1) can be readily viewed by a player. Further, with a change in the angle of the first face (Q1), three-dimensional game objects (M1) roll on the first face (Q1) to a low-level side and are supplied to the discharger (446). As a result, dynamic movement of many three-dimensional game objects (M1) placed on the first face (Q1) at the same time toward the discharger (446) is realized.

Although basically provided as a flat surface, the first face (Q1) may be a curved surface. Further, "arrayed in a single layer" means that three-dimensional game objects (M1) are densely arranged along the first face (Q1) without being stacked in a perpendicular direction of the first face (Q1). It is of note that "(being) arrayed" is not limited to a state in which three-dimensional game objects (M1) are arranged in a linear state in a single line, but rather includes three-dimensional game objects (M1) that are arranged in a planar state. Specifically, the feeding portion (461*a*) feeds three-dimensional game objects (M1) in a manner such that the three-dimensional game objects (M1) fed from the feeding portion (461*a*) are caused to abut on existing three-dimensional game objects (M11) on the first face (Q1) in a direction parallel to the first face (Q1). According to the above configuration, three-dimensional game objects (M1) are arrayed in a single layer from a low-level side to a high-level side of the first face (Q1).

Appendix G2

In a preferred example of appendix G1, the mount portion (44) includes a second face (Q2) sloped relative to a horizontal plane and intersecting with the first face (Q1), an edge (S11) on the low-level side of the first face (Q1) and an edge (S21) on a low-level side of the second face (Q2) are close to each other in the first state, and the feeding portion (461*a*) includes a first feeding portion (461*b*, 461*d*) configured to feed the plurality of three-dimensional game objects (M1) from a high-level side of the first face (Q1), and a second feeding portion (461*a*, 461*c*) configured to feed the plurality of three-dimensional game objects (M1) from a high-level side of the second face (Q2).

In the configuration described, three-dimensional game objects (M1) are fed from the respective high-level sides of the first face (Q1) and the second face (Q2) and the three-dimensional game objects (M1) accumulate on the low-level side of the first face (Q1) and the low-level side of the second face (Q2). Because the edge (S11) on the low-level side of the first face (Q1) and the edge (S21) on the low-level side of the second face (Q2) are close to each other, the three-dimensional game objects (M1) are arrayed from a part where the first face (Q1) and the second face (Q2) are close to each other, toward the ends at the respective high-level sides. Therefore, the three-dimensional game objects (M1) placed on the mount portion (44) can be easily viewed by players.

Appendix G3

In a preferred example of appendix G2, with an angle of the first face (Q1) becoming close to an angle of the second face (Q2) in the second state, the plurality of three-dimensional game objects (M1) placed on the first face (Q1) and the second face (Q2) roll to the low-level side of the first face (Q1) and are supplied to the discharger (446).

In the above configuration, with the angle of the first face (Q1) becoming close to (ideally matching) the angle of the second face (Q2) in the second state, three-dimensional game objects (M1) on both the first face (Q1) and the second face (Q2) can be rolled to the low-level side of the first face (Q1) and supplied to the discharger (446).

Appendix G4

A preferred example of any of appendices G1 to G3 includes a game field (110*a*) configured to provide a player with a game in which the plurality of three-dimensional game objects (M1) are used, wherein the mount portion (44) is located above the game field (110*a*), and at least a part of the mount portion (44) is configured to enable the plurality of three-dimensional game objects (M1) to be viewed from an opposite side across the mount portion (44) relative to the three-dimensional game objects (M1).

In the above configuration, because the mount portion (44) is located above the game field (110*a*), a space inside the game apparatus (10) can be effectively used. Further, at least a part of the mount portion (44) enables three-dimensional game objects (M1) to be viewed from the opposite side across the mount portion (44) relative to the three-dimensional game objects (M1). That is, a player can view three-dimensional game objects (M1) from the side of the game field (110*a*) through the mount portion (44). Therefore, a state in which many three-dimensional game objects (M1) are placed on the mount portion (44) is enabled to be effectively viewed by a player.

"Enable ( . . . ) to be viewed" means that the mount portion (44) transmits light. A typical example of a configuration that "enables ( . . . ) to be viewed" is a configuration in which the mount portion (44) is formed from a light transmissive member. However, for example, a configuration in which the mount portion (44) is formed in a net-like manner is also included in the concept that "enables ( . . . ) to be viewed" because light transmits through the mount portion (44).

Appendix G5

A preferred example of any of appendices G1 to G3 includes a plurality of game fields (110*a*, 110*b*, 110*c*, 110*d*) each configured to provide a game in which the plurality of three-dimensional game objects (M1) are used, and the mount portion (44) is located above the plurality of game fields (110*a*, 110*b*, 110*c*, 110*d*) across the plurality of game fields (110*a*, 110*b*, 110*c*, 110*d*), and at least a part of the mount portion (44) is configured to enable the plurality of three-dimensional game objects (M1) to be viewed from the opposite side across the mount portion (44) relative to the three-dimensional game objects (M1).

Appendix G6

In a preferred example of appendix G5, a plurality of game fields (110*a*, 110*b*, 110*c*, 110*d*) include a first game field (110*a*) and a second game field (110*b*, 110*c*, 110*d*), the feeding portion (461) includes a first feeding portion (461*a*) configured to feed the three-dimensional game objects (M1) in accordance with a status of a play of a game in the first game field (110*a*) and a second feeding portion (461*b*, 461*c*, 461*d*) configured to feed the three-dimensional game objects (M1) in accordance with a status of play of a game in the second game field (110*b*, 110*c*, 110*d*), and the plurality of three-dimensional game objects (M1) placed on the mount portion (44) are distributed unevenly on a region corresponding to one of the first feeding portion (461*a*) and the second feeding portion (461*b*, 461*c*, 461*d*) that has fed a larger number of the three-dimensional game objects (M1).

In the above configuration, because three-dimensional game objects (M1) are distributed unevenly on a region corresponding to one of the first feeding portion (461*a*) and the second feeding portion (461*b*, 461*c*, 461*d*) that has fed a larger number of the three-dimensional game objects (M1), it is possible to infer a game field in which a game that has contributed to accumulation of three-dimensional game objects (M1) on the mount portion (44) among the game fields has been played (further, a player that has contributed to the accumulation), from the distribution of the three-dimensional game objects (M1).

The "region corresponding to one that has fed a larger number of the three-dimensional game objects (M1)" is, for example, a region close to one having fed a larger number of three-dimensional game objects (M1) among the feeding portions (461*a*, 461*b*, 461*c*, 461*d*). However, such a region is not limited to that described above. For example, assumed is the configuration described above in which the mount portion (44) includes the first face (Q1) and the second face (Q2). The first feeding portion (461*b*, 461*d*) feeds three-dimensional game objects (M1) onto the first face (Q1) from the high-level side of the first face (Q1). The second feeding portion (461*a*, 461*c*) feeds three-dimensional game objects (M1) onto the second face (Q2) from the high-level side of the second face (Q2). In the above configuration, the "region corresponding to one that has fed a larger number of the three-dimensional game objects (M1)" is at least a partial region on the first face (Q1) when the number of three-dimensional game objects (M1) fed by the first feeding portion (461*b*, 461*d*) is larger, and is at least a partial region on the second face (Q2) when the number of three-dimensional game objects (M1) fed by the second feeding portion (461*a*, 461*c*) is larger. For example, the "region corresponding to one that has fed a larger number of the three-dimensional game objects (M1)" is, for example, a slope at an angle from a position near one of the feeding portions (461*a*, 461*b*, 461*c*, 461*d*) that has fed a larger number of three-dimensional game objects (M1) to a low-level side.

Appendix G7

In a preferred example of any of appendices G4 to G6, the plurality of three-dimensional game objects (M1) are light transmissive, and a planar light source (413) installed on an opposite side across the mount portion (44) relative to the game field (110*a*) is included.

In the above configuration, illumination light from the planar light source (413) transmits through the three-dimensional game objects (M1) and the mount portion (44) to be output to the side of the game field (110*a*). That is, light appropriately scattered by three-dimensional game objects (M1) on the mount portion (44) and transmitted through the mount portion (44) is viewed by a player. Therefore, the visual production effect can be increased.

The "planar light source (413)" is an illuminating device that emits light in a planar manner. Specifically, the concept of the "planar light source (413)" includes a light source including a plurality of point light sources or line light sources arrayed in a planner manner, in addition to a light source (413) including a light emitter formed to have a planar shape.

Appendix G8

In a preferred example of appendices G1 to G7, the first face (Q1) includes a first edge (S11) and a second edge (S12) opposing each other, the first edge (S11) is located at a lower position than the second edge (S12) in the first state, and the second edge (S12) is located at a lower position than the first edge (S11) in the second state.

In the above configuration, three-dimensional game objects (M1) arrayed near the first edge (S11) in the first state move at the same time to a place near the second edge (S12) due to a change to the second state. Therefore, effective production in which many three-dimensional game objects (M1) greatly move at the same time is realized.

Appendix G9

A game apparatus (10) according to a preferred aspect of the present invention includes: a feeding portion (461*a*) configured to feed a plurality of three-dimensional game objects (M1) that are rollable regardless of the orientation of the three-dimensional game objects (M1); a mount portion (44) including a first face (Q1) on which the plurality of three-dimensional game objects (M1) fed by the feeding portion (461*a*) are placed; and a game field (110*a*) configured to provide a game in which the plurality of three-dimensional game objects (M1) are used to a player, and the plurality of three-dimensional game objects (M1) fed by the feeding portion (461*a*) are arrayed in a single layer along the first face (Q1), a virtual viewpoint (V) of the player is within a space below the first face (Q1), and at least a part of the mount portion (44) is configured to enable the player to view the plurality of three-dimensional game objects (M1) from an opposite side across the mount portion (44) relative to the three-dimensional game objects (M1).

In the above configuration, the three-dimensional game objects (M1) are arrayed in a single layer along the first face (Q1) and the player is positioned in a space below the first face (Q1). Therefore, most of the three-dimensional game objects (M1) on the mount portion (44) can be viewed by the player through the mount portion (44). That is, a state in which many three-dimensional game objects (M1) are placed on the mount portion (44) is effectively enabled to be viewed by the player.

The virtual viewpoint (V) of the player means the position (eye point) of the eyes of a virtual player playing a game provided by the game field (110*a*). The virtual viewpoint (V) means the position of the eyes of a virtual player of average physical size in a seated state in a case in which, from a point of view of use-status of the game apparatus (10), a player is supposed to play a game in a seated state, and means the position of the eyes of the player of an average physical size in a standing state in a case in which, from a point of view of use-status of the game apparatus (10), a player is supposed to play a game in a standing state.

The virtual viewpoint (V) is not necessarily limited only to one point, and is assumed to be within a specific range having a spatial extent. "A virtual viewpoint (V) of the player is located in a space below a plane including the first face (Q1)" means that a specific space supposed to include the virtual viewpoint (V) is located below a plane including the first face (Q1).

Focusing on tangent planes respectively passing through contact points between three-dimensional game objects (M1) placed on the first face (Q1) of the mount portion (44) and the first face (Q1) (planes being in contact with spherical three-dimensional game objects (M1) on the contact points), the "space below the first face (Q1)" means a space located below in the vertical direction viewed from the tangent planes of all the three-dimensional game objects (M1) placed on the first face (Q1). In a configuration where the first face (Q1) is a flat surface, a space below a flat surface including the first face (Q1) is the "space below the first face (Q1)." However, the first face (Q1) is not limited to a flat surface. For example, if a condition that the virtual viewpoint (V) of a player is located in the "space below the first face (Q1)" in the definition described above is satisfied, the first face (Q1) may be a curved surface (for example, a spherical surface or an arc surface). For example, an arc surface having a small curvature can satisfy this condition. A curved surface constituting the first face (Q1) is ideally a curved surface that is formed in such a manner that in a space above the tangent plane there is no contact point where the virtual viewpoint (V) is located.

Appendix G10

In a preferred example of appendix G9, a plurality of virtual viewpoints (V) corresponding to different positions of players are located in a space below the first face (Q1).

According to the above configuration, placement of many three-dimensional game objects (M1) on the mount portion (44) can be viewed from a plurality of positions where players of the game apparatus (10) may be located. Ideally, all of the virtual viewpoints (V) are located in a space below the first face (Q1).

DESCRIPTION OF REFERENCE SIGNS

10 . . . game apparatus, 100*a*, 100*b*, 100*c*, 100*d* . . . station, 110*a*, 110*b*, 110*c*, 110*d* . . . game field, 120*a* . . . first lottery portion, 130*a* . . . second lottery portion, 140*ab* . . . third lottery portion, 150 . . . JP payout portion, 160*a* . . . operating panel, 170*ac* . . . conveyor device, 180*a* . . . conveyor device.

What is claimed is:

1. A game apparatus for providing a game in which three-dimensional game objects rollable regardless of an orientation of the three-dimensional game objects are used, the game apparatus comprising:

a circulating mechanism configured to circulate the three-dimensional game objects, wherein the circulating mechanism includes:

a conveyor device configured to transport the three-dimensional game objects from a first position to a second position that is higher than the first position;

a first path configured to move the three-dimensional game objects from the second position to a third position that is lower than the second position;

a supply path for supply of a part of the three-dimensional game objects to a game object utilizer that uses the supplied three-dimensional game objects in the game, wherein the part of the three-dimensional game objects enters the supply path at a position between the second position and the third position; and a second path configured to move a part of the three-dimensional game objects not entering the supply path, to the first position that is lower than the third position.

2. The game apparatus according to claim 1, wherein the conveyor device is configured to continue to be in an operation state for transporting the three-dimensional game objects, to thereby continue to supply the part of the three-dimensional game objects to the game object utilizer.

3. The game apparatus according to claim 1, wherein:

the game object utilizer is positioned higher than the first position, and the part of the three-dimensional game objects used in the game moves downward, and is then collected by the second path.

4. The game apparatus according to claim 1, wherein:

the game object utilizer includes a first game object utilizer and a second game object utilizer, in each of which three-dimensional game objects are reserved, the supply path includes a first supply path and a second supply path positioned downstream of the first supply path, wherein the first supply path is for supply of a part of the three-dimensional game objects to the first game object utilizer, and wherein the second supply path is for supply of a part of the three-dimensional game objects to the second game object utilizer, and a part of the three-dimensional game objects that moves toward the first supply path from the second position moves toward the third position in a case in which the first game object utilizer is in an entry restricted state, and then is allowed to enter the second supply path.

5. The game apparatus according to claim 1, further comprising a first game field and a second game field, wherein the game includes a first game and a second game that are provided in parallel to different players, and wherein the first game is provided in the first game field and the second game is provided in the second game field, wherein:

the game object utilizer includes a third game object utilizer and a fourth game object utilizer, wherein the third game object utilizer uses a part of the three-dimensional game objects in the first game provided in the first game field and wherein the fourth game object utilizer uses a part of the three-dimensional game objects in the second game provided in the second game field, and the supply path includes a third supply path and a fourth supply path, wherein the third supply path is for supply of the part of the three-dimensional game objects to the third game object utilizer and wherein the fourth supply path is for supply of the part of the three-dimensional game objects to the fourth game object utilizer.

6. The game apparatus according to claim 1, wherein the conveyor device has a plurality of transport paths configured to transport the three-dimensional game objects in parallel.

7. The game apparatus according to claim 6, wherein a total number of the game object utilizers is less than a total number of the plurality of transport paths.

8. A game apparatus for providing games in which three-dimensional game objects rollable regardless of an orientation of the three-dimensional game objects are used, the game apparatus comprising:

a first game field and a second game field, wherein the games includes a first game and a second game that are provided in parallel to different players in the first game field and in the second game field, respectively, and wherein the three-dimensional game objects include a first subset and a second subset;

a first circulating mechanism corresponding to the first game field; and a second circulating mechanism corresponding to the second game field, wherein the first circulating mechanism includes:

a conveyor device configured to transport the first subset of the three-dimensional game objects from a first position to a second position that is higher than the first position;

a first path configured to move the first subset of the three-dimensional game objects from the second position to a third position that is lower than the second position;

a supply path for supply of a part of the first subset of the three-dimensional game objects to a game object utilizer that uses the supplied three-dimensional game objects in the first game, wherein the part of the first subset of the three-dimensional game objects enters the supply path at a position between the second position and the third position; and a second path configured to move a part of the first subset of the three-dimensional game objects not entering the supply path, to the first position that is lower than the third position, wherein the second circulating mechanism includes:

a conveyor device configured to transport the second subset of the three-dimensional game objects from a first position to a second position that is higher than the first position;

a first path configured to move the second subset of the three-dimensional game objects from the second position to a third position that is lower than the second position;

a supply path for supply of a part of the second subset of the three-dimensional game objects to a game object utilizer that uses the supplied three-dimensional game objects in the second game, wherein the part of the second subset of the three-dimensional game objects enters the supply path at a position between the second position and the third position; and a second path configured to move a part of the second subset of the three-dimensional game objects not entering the supply path, to the first position that is lower than the third position.

9. The game apparatus according to claim 8, further comprising a sorter configured to sort a part of the first subset of the three-dimensional game objects that does not enter the supply path of the first circulating mechanism and a part of the second subset of the three-dimensional game objects that does not enter the supply path of the second circulating mechanism, into the second path of the first circulating mechanism and the second path of the second circulating mechanism.

10. The game apparatus according to claim 8, wherein the conveyor device has a plurality of transport paths configured to transport the three-dimensional game objects in parallel.

11. The game apparatus according to claim 8, wherein a total number of the game object utilizers is less than a total number of the plurality of transport paths.

12. A game apparatus for providing games in which three-dimensional game objects rollable regardless of an orientation of the three-dimensional game objects are used, the game apparatus comprising:

a first game field, a second game field, a third game field, and a fourth game field, wherein the games include a first game, a second game, a third game, and a fourth game that are provided in parallel to different players in the first game field, the second game field, the third game field, and in the fourth game field, respectively, and wherein the three-dimensional game objects include a first subset and a second subset;

a first circulating mechanism corresponding to the first and the second game fields; and a second circulating mechanism corresponding to the third and fourth game fields, wherein the first circulating mechanism includes:

a conveyor device configured to transport the first subset of the three-dimensional game objects from a first position to a second position that is higher than the first position;

a first path configured to move the first subset of the three-dimensional game objects from the second position to a third position that is lower than the second position;

a supply path for supply of a part of the first subset of the three-dimensional game objects to a game object utilizer that uses the supplied three-dimensional game objects in at least one of the first game or the second game, wherein the part of the first subset of the three-dimensional game objects enters the supply path at a position between the second position and the third position; and a second path configured to move a part of the first subset of the three-dimensional game objects not entering the supply path, to the first position that is lower than the third position, wherein the second circulating mechanism includes:

a conveyor device configured to transport the second subset of the three-dimensional game objects from a first position to a second position that is higher than the first position;

a first path configured to move the second subset of the three-dimensional game objects from the second position to a third position that is lower than the second position;

a supply path for supply of a part of the second subset of the three-dimensional game objects to a game object utilizer that uses the supplied three-dimensional game objects in at least one of the third game or the fourth game, wherein the part of the second subset of the three-dimensional game objects enters the supply path at a position between the second position and the third position; and a second path configured to move a part of the second subset of the three-dimensional game objects not entering the supply path, to the first position that is lower than the third position.

13. The game apparatus according to claim 12, further comprising a sorter configured to sort a part of the first subset of the three-dimensional game objects that does not enter the supply path of the first circulating mechanism and a part of the second subset of the three-dimensional game objects that does not enter the supply path of the second circulating mechanism, into the second path of the first circulating mechanism and the second path of the second circulating mechanism.

14. The game apparatus according to claim 12, wherein the conveyor device has a plurality of transport paths configured to transport the three-dimensional game objects in parallel.

15. The game apparatus according to claim 12, wherein a total number of the game object utilizers is less than a total number of the plurality of transport paths.

* * * * *